US006112537A

United States Patent [19]

Broadbent

[11] Patent Number: 6,112,537

[45] Date of Patent: Sep. 5, 2000

[54] BEVERAGE CONTAINER WITH ICE COMPARTMENT

[75] Inventor: John A. Broadbent, 5558 S. Yampa St., Aurora, Colo. 80015

[73] Assignee: John A. Broadbent, Aurora, Colo.

[21] Appl. No.: 09/339,713

[22] Filed: Jun. 24, 1999

[51] Int. Cl.[7] ..... F25D 3/08

[52] U.S. Cl. ..... 62/293; 62/372; 62/457.4

[58] Field of Search ..... 62/293, 372, 457.3, 62/457.4

[56] References Cited

U.S. PATENT DOCUMENTS

| | | | |
|---|---|---|---|
| 2,462,757 | 2/1949 | Loyocz | 62/293 |
| 4,485,636 | 12/1984 | Hilado | 62/457.3 |
| 4,735,063 | 4/1988 | Brown | 62/293 |
| 4,816,048 | 3/1989 | Kimmelshue | 62/293 |
| 4,831,846 | 5/1989 | Sungaila | 62/293 |
| 4,843,836 | 7/1989 | Chiders | 62/293 |
| 5,444,992 | 8/1995 | Bell | 62/372 |
| 5,799,501 | 9/1998 | Leonard et al. | 62/457.3 |
| 5,972,085 | 7/1999 | Waldman | 62/457.4 |

*Primary Examiner*—William E. Topolcal
*Attorney, Agent, or Firm*—Gibson, Dunn & Crutcher, LLP

[57] ABSTRACT

A beverage container having a beverage compartment and an ice compartment separated by a removable seal which, when removed, allows the ice and beverage to mix thereby cooling the beverage. The removable seal prevents premature mixing of the beverage and the ice and allows the container to be stored warm, with water in the ice compartment, indefinitely. Prior to use, the container is placed in a dual-temperature environment that freezes the water in the ice compartment but doesn't freeze the beverage. Freezing of the beverage is prevented by an air gap between the beverage and the ice that acts as a thermal barrier. An ice anchor and an air gap in the ice compartment reduce the melting rate of the ice by suspending the ice within the ice compartment, out of contact with the melt water and surrounded by an insulating layer of air.

31 Claims, 41 Drawing Sheets

BEVERAGE CONTAINER WITH ICE COMPARTMENT

FIELD OF THE INVENTION

The present invention relates to the field of beverage containers. Specifically, the present invention relates to beverage containers having a beverage compartment and an ice compartment separated by a removable seal which, when removed, allows the ice and beverage to mix thereby cooling the beverage.

BACKGROUND OF THE INVENTION AND PRIOR ART

It is common practice for consumer beverages to be packaged in plastic bottles and sold cold, from some type of refrigerated storage. These beverages are usually purchased for immediate consumption, since they cannot stay cold very long without refrigeration. With the larger sized bottles (20 fluid ounces or more), the beverage usually warms up substantially before it is finished, even if consumed immediately.

If a person wants to buy a beverage and keep it cold for several hours, he or she must put the beverage in a refrigerator, thermos or ice chest. Sometimes people will freeze water inside a bottle so that it will stay cold longer without refrigeration. However this only works with water, since soft drinks and sports drinks separate when frozen. And even with water, freezing a bottle requires prior planning and effort.

Other than dispensing a beverage into an ice-filled cup, there are no commercially available beverages (e.g., soft drinks, sports drinks, etc.) sold in containers that will keep a beverage cold for any significant length of time. And even an ice-filled cup will warm up after a couple of hours.

U.S. Pat. No. 5,284,028 issued to Wilco R. Stuhmer describes a beverage container having a main beverage chamber and an ice chamber consisting of a polymeric film pouch located within the main chamber. By filling the ice chamber with ice, a beverage in the beverage chamber can be kept cold by virtue of the heat transfer from the beverage to the ice through the polymeric film. This configuration prevents dilution of the beverage from the melting ice. However, this invention requires that the container be filled with both the ice and the beverage just prior to consumption. There is no way to pre-package the beverage and the ice combination and store it without having either the ice melt or the beverage freeze.

U.S. Pat. No. 5,487,486 issued to David M. Menco describes a beverage container having an ice compartment below, and in heat exchange contact with, an upper beverage compartment. By scooping ice into the ice compartment (which opens downward) and closing the ice compartment with a watertight lid, the beverage in the beverage compartment can be kept cold by contact with the cold ice compartment. This invention is intended for use as a pitcher, not as a retail beverage container. And again, the container must be filled with ice and beverage just prior to use—there is no way to use this invention for pre-packaged beverages.

A number of patents have been issued relating to self-cooling beverage cans containing a refrigerant cooling system. For example, U.S. Pat. No. 4,669,273 to Fischer et al., U.S. Pat. No. 4,791,789 to Wilson, U.S. Pat. No. 5,447,039 to Allison, and U.S. Pat. No. 5,692,391 to Joslin all discuss beverage cans with a refrigerant-vaporization-based cooling systems (i.e., the cans all contain refrigerant which, when released, vaporizes thereby cooling the can). However no refrigerant-containing can has yet proven to be commercially viable.

Thus none of the prior art has provided a commercially viable means for selling pre-packaged beverages in self-cooling containers.

A primary objective of this invention is to provide a beverage container for selling pre-packaged beverages that will have a built-in ice cube, allowing the beverage to remain cold for many hours after it has been removed from refrigeration. If the container is opened immediately after removal from refrigerated storage, the beverage inside will remain cold for four hours or more.

Another primary objective of this invention is to provide a beverage container containing ice and having a slow-melting feature that will, if unopened, retain sufficient ice inside to cool the beverage for six or more hours after the un-insulated container has been removed from refrigeration.

Another primary objective of this invention is to provide a container having a beverage compartment and an ice compartment that can be kept in a dual-temperature-refrigerating device that will keep the ice frozen while simultaneously keeping the beverage unfrozen. Such dual-temperature refrigerating devices could include refrigerated display cases, freezers, vending machines, domestic refrigerator-freezers or other refrigerated display apparatus.

Another primary objective of this invention is to provide a self-cooling beverage container that is cost-effective to manufacture.

Another primary objective of this invention is to provide a self-cooling beverage container can be cost-effectively bottled (i.e., filled and capped).

Another primary objective of this invention is to provide a self-cooling beverage container that after bottling can be cost-effectively shipped, stored and/or displayed for retail sale.

Another primary objective of this invention is to provide a self-cooling beverage container utilizing ice as a source of cooling yet one that can be stored warm for any length of time.

Another primary objective of this invention is to provide a self-cooling beverage container that is structurally strong enough for use with carbonated beverages and will not cause those beverages to overflow from the container due to foaming.

SUMMARY OF THE INVENTION

As used herein, the term "beverage" shall not be limited to liquids for drinking, but shall include any fluid, including water. Likewise the terms "water" and "ice" are used for convenience herein to refer to the liquid and solid phases of any phase-change type refrigerant, and 32° F. is used to refer to the liquid-solid phase change temperature for such a refrigerant.

The present invention is a beverage container that keeps beverages chilled for an extended period of time. The beverage container has two compartments: a beverage compartment and an ice compartment. The two compartments are separated by a removable seal that, when removed, allow the ice and beverage to mix, thereby cooling the beverage. Prior to removal of the seal, the ice causes minimal cooling of the beverage. A slow-melting device located in the ice compartment allows the ice to melt at a much slower rate than it would normally. This slow-melting device allows retention of sufficient ice, even after six hours without refrigeration, to cool the beverage to a desirably cold temperature.

Because the ice and beverage compartments are initially sealed from one another, it is possible to fill the container with the two fluids and store the container warm for any length of time. There is no need to freeze the water in the ice compartment until the day of its intended use or sale.

By not completely filling the ice or the beverage compartments, a gap is created between the two fluids. This gap (consisting of air or any other suitable gas) provides an insulating thermal barrier between the two fluids and makes it possible for the water to be frozen while the beverage is not. By placing the container in a dual-temperature environment that exposes the ice compartment to sub-freezing temperatures (i.e., below 32° F.) and the beverage compartment to above-freezing temperatures, the ice will freeze and the beverage will not.

Special equipment will be required to provide the dual-temperature environment described above. In its simplest form, the equipment would consist of an insulated, internally heated box that would be placed inside a freezer. This box would surround the beverage compartment of the container, keeping that part of the container warm (above freezing). The ice compartment of the container, however, would protrude outside the box and into the freezer. Thus the beverage compartment would see above-freezing temperatures while the ice compartment would see the sub-freezing temperatures in the freezer.

A variety of other, more elaborate equipment types are also anticipated for providing the needed dual-temperature environment. The other equipment types include walk-in and reach-in refrigerators and freezers, refrigerated display cases, vending machines, and domestic refrigerator-freezers. The common element in these new equipment types is that they would all be configured to provide a sub-freezing temperature environment for the ice compartments of the containers while providing an above-freezing temperature environment for the beverage compartments. How this is accomplished will become apparent from the following detailed description, discussion and the appended claims, taken in conjunction with the drawings.

BRIEF DESCRIPTION OF THE DRAWINGS

A better understanding of the invention can be had by reference to the following Detailed Description in conjunction with the accompanying Drawings, wherein:

FIG. 19 shows this alternate embodiment prior to freezing of the water.

FIG. 27 shows this alternate embodiment after freezing of the water.

Figure 1:
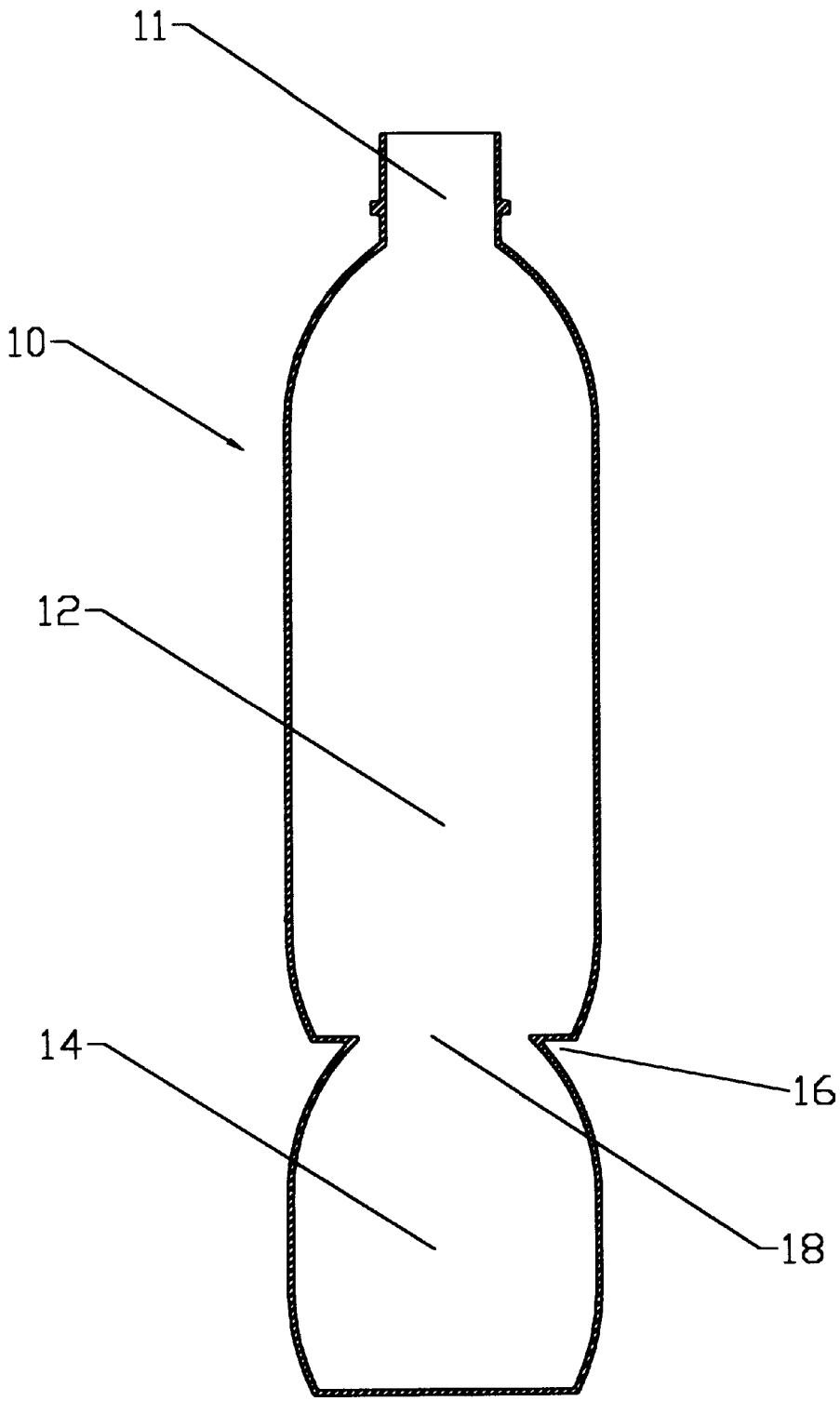
FIG. 1 is a vertical cross-section of a beverage container showing the beverage and ice compartments.

| Reference Numerals in Drawings | |
|---|---|
| Beverage container | 10 |
| Mouth | 11 |
| Beverage compartment | 12 |
| Ice compartment | 14 |
| Waist | 16 |

-continued

| Reference Numerals in Drawings | |
|---|---|
| Opening | 18 |
| Ice anchor | 20 |
| Perforations | 22 |
| Walls of ice compartment | 24 |
| Grooves | 26 |
| Water | 28 |
| Seal | 30 |
| large area | 30A |
| narrow tail | 30B |
| Ledge | 32 |
| Beverage | 36 |
| Cap | 38 |
| Beverage compartment air gap | 40 |
| Ice compartment air gap | 42 |
| Ice | 44 |
| Gap | 46 |
| Melt water | 48 |
| Melt air gap | 50 |
| Gap | 52 |
| Insulated sleeve | 54 |
| Webs | 60 |
| Dimple | 62 |
| Tack | 64 |
| Hole | 66 |
| No-mix beverage container | 70 |
| Heat exchange barrier | 72 |
| Convolutions | 74 |
| Protrusion | 76 |
| Walls | 78 |
| Blue Ice | 80 |
| No-mix beverage container | 82 |
| Heat exchange element | 84 |
| Barrier | 86 |
| Seal | 88 |
| Rods | 92 |
| Beverage container | 100 |
| Separate ice container | 102 |
| Ice compartment | 104 |
| Top opening | 106 |
| Bottom opening | 108 |
| Bottom plug | 110 |
| Gap | 112 |
| Bottle (#1) | 120 |
| Bottle (#2) | 130 |
| Cap | 132 |
| Spout | 134 |
| Ice cup | 136 |
| Pins | 138 |
| Thermos bottle | 146 |
| Insulated container | 142 |
| Insulated lid | 144 |
| Cup | 146 |
| Ice anchor | 148 |
| Gap | 150 |
| Heated, insulated box | 160 |
| Sides | 162 |
| Bottom | 164 |
| Top | 166 |
| Opening | 168 |
| Heat source | 170 |
| Thermostat | 172 |
| Compliant barrier | 174 |
| Walk-in freezer | 180 |
| Display rack | 182 |
| Angle | 184 |
| Display door | 186 |
| Front wall of box | 188 |
| Cord | 189 |
| Back wall of box | 190 |
| Refrigerated channel | 200 |
| Opening | 202 |
| Walls of channel | 204 |
| Tubes | 206 |
| Insulation | 208 |
| Compliant barrier | 210 |
| Walk-in refrigerator | 212 |
| Angle | $\alpha$ |

-continued

| Reference Numerals in Drawings | |
|---|---|
| Refrigerator/Freezer | 220 |
| Refrigerator compartment | 222 |
| Freezer compartment | 224 |
| Aperture | 226 |
| Door | 228 |
| Heated insulated sleeve | 240 |
| Heater | 242 |
| Power cord | 244 |

DETAILED DESCRIPTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Container Construction—Preferred Embodiment

Referring to FIG. 1, a vertical cross-section of a beverage container 10 is shown. In the preferred embodiment, the beverage container 10 is a blow-molded plastic beverage container made of a clear plastic resin such as PETE (Polyethylene Terephthalate) or other material suitable for use with beverages. Container 10 has a mouth 11 and two compartments: a beverage compartment 12 and an ice compartment 14. While it would be possible to have the two compartments arranged in other configurations, the preferred embodiment is to have beverage compartment 12 located above ice compartment 14. A waist 16 in the container 10 delineates the bottom of beverage compartment 12 and the top of ice compartment 14. An opening 18 at waist 16 connects the two compartments. The beverage container 10 illustrated in FIG. 1 is representative of the preferred embodiment of the present invention as it would exist as it came out of the blow mold, but prior to any other manufacturing or bottling operations.

Figure 2:
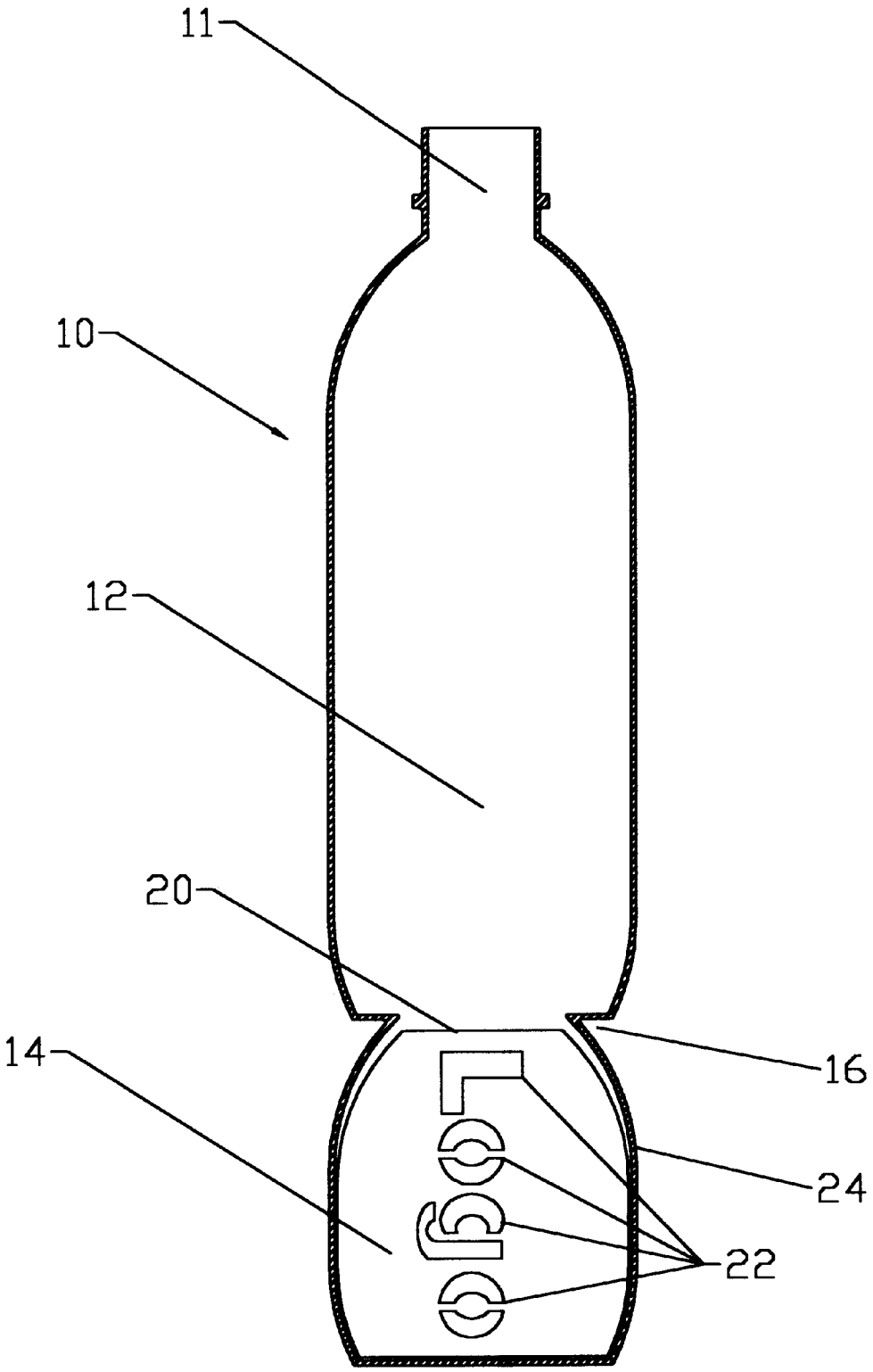
FIG. 2 is a vertical cross-section of the beverage container after insertion of an ice anchor.

FIG. 2 shows a vertical cross-section of beverage container 10 after insertion of an ice anchor 20. The ice anchor 20 is the device that provides the slow-melting feature of container 10, as will be explained later. In the preferred embodiment, ice anchor 20 is a thin, perforated, semi-rigid piece of plastic film that has been cut into a shape that matches the internal profile of ice compartment 14. A close fit between the walls 24 of ice compartment 14 and the ice anchor 20 is needed to insure that ice anchor 20 will securely nest within ice compartment 14. As will be explained, if ice anchor 20 is loosely fit into ice compartment 14, the slow-melting feature of container 10 will be diminished. Thus it is important that ice anchor 20 fit securely into ice compartment 14. It is also important that the width of ice anchor 20 be equal to or very slightly less than the internal width of the ice compartment 14. If the ice anchor 20 is any wider that the ice compartment 14, then the ice anchor 20 will be warped or bowed inside ice compartment 14 and may not pass through the center of the ice compartment 14, potentially diminishing the slow-melting feature of container 10.

Perforations 22 shown in ice anchor 20 are needed to allow the water in the ice compartment 14 to freeze solidly onto and through ice anchor 20, as will be explained in detail below. At least one of the perforations 22 should be located such that it ends up being near the top and along the centerline of ice compartment 14. This is where the last bit of ice to melt in ice compartment 14 will be located, thus the need for a perforation in this spot.

In FIG. 2, perforations 22 have been cut such that they form a discernible pattern. In this case, the perforations 22 spell the word "Logo". If ice anchor 20 is made from a colored piece of plastic film, this pattern created by perforations 22 will be visible through the walls 24 of ice compartment 14 as well as through the ice itself. The pattern created by perforations 22 could be any desired pattern, for example a name, logo or slogan associated with the beverage in container 10.

An ice anchor 20 of the type shown in FIG. 2 would be inserted into the ice compartment 14 by first rolling it up so that it would fit through the mouth 11, through the opening 18 and into ice compartment 14. Once inside ice compartment 14 the ice anchor 20 would be allowed to unroll. Unrolled, ice anchor 20 would securely nest itself between the ice compartment walls 24, essentially locking itself in place. The material chosen for the ice anchor 20 must be flexible enough to allow it to be rolled up so that it will fit through the mouth 11 of the container 10, yet stiff enough so that it will securely lock itself into position within the ice compartment 14 when unrolled. Obviously the material chosen for ice anchor 20 must also be one that is suitable for contact with potable beverages.

Figure 3:
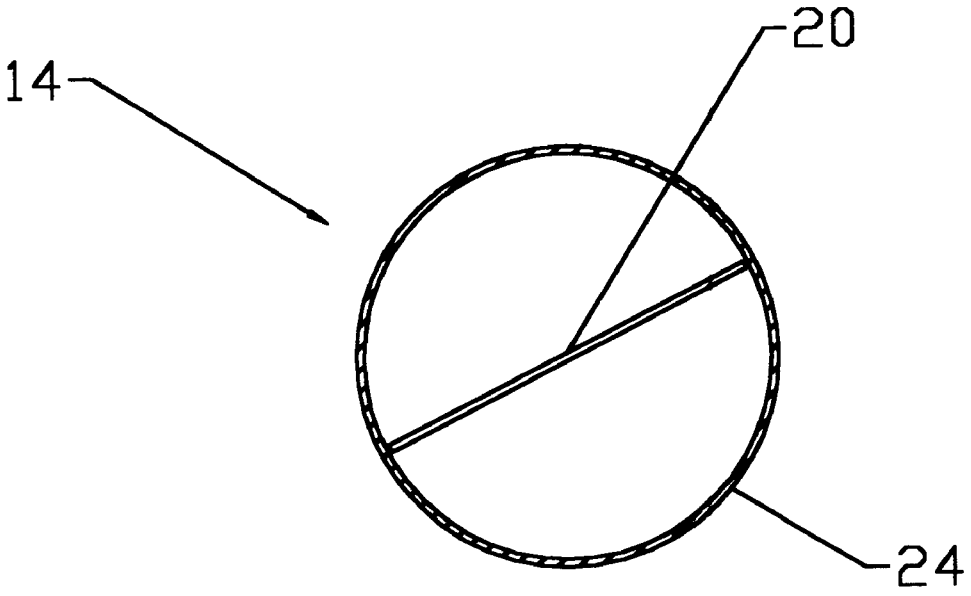
FIG. 3 is a horizontal cross-section of the beverage container taken through the ice compartment showing the ice anchor.
Figure 4:
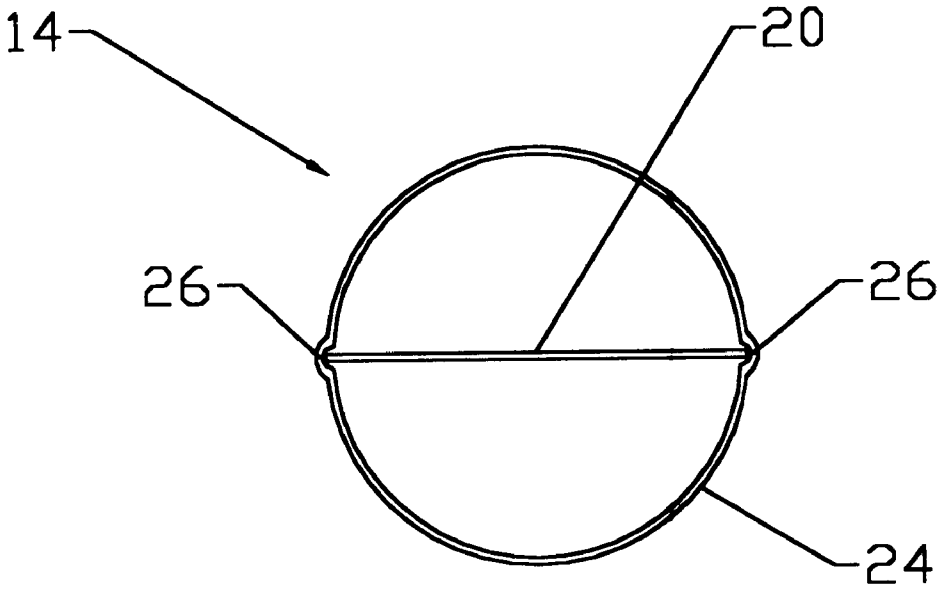
FIG. 4 is a horizontal cross-section of a beverage container taken through the ice compartment wherein the ice compartment has grooves in its walls for accommodating the ice anchor.

FIG. 3 and FIG. 4 show horizontal cross-sections of two embodiments of container 10 taken through ice compartment 14. FIG. 3 shows a configuration where ice compartment 14 is round in cross-section, such that the angular position of ice anchor 20 relative to the compartment 14 is random, and ice anchor 20 would be somewhat free to rotate within it. FIG. 4 shows an alternate embodiment of the horizontal cross-section of ice compartment 14 wherein special grooves 26 have been provided in the walls 24 specifically for fixing the angular position of ice anchor 20. This configuration may be desirable to more rigidly secure the position of ice anchor 20, and thereby improve the slow-melting feature of container 10.

Filling the Container

Figure 5:
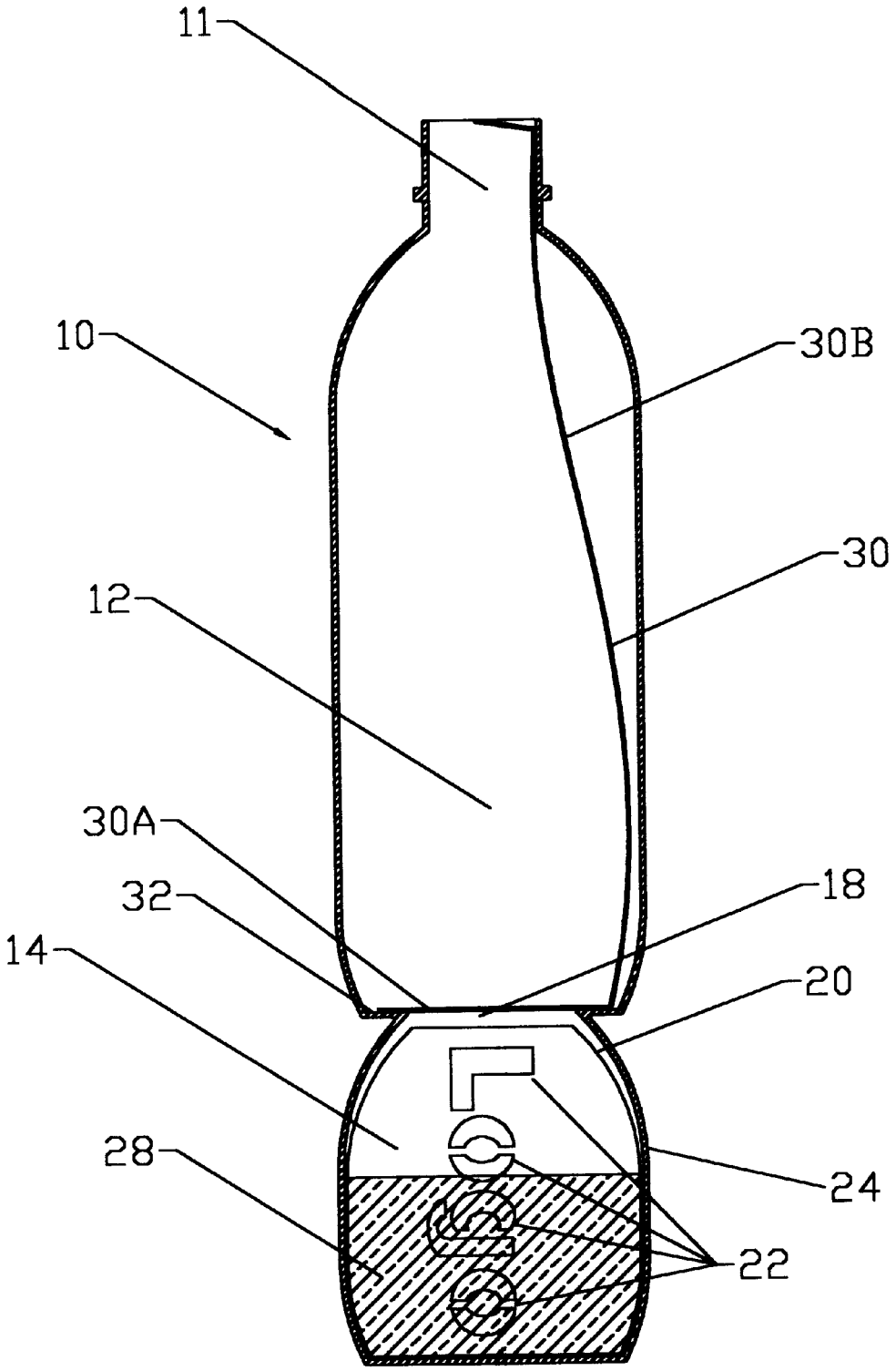
FIG. 5 is a vertical cross-section of the beverage container after filling the ice compartment with water and attaching a seal.

FIG. 5 is a vertical cross-section of beverage container 10 illustrating how it would look after the ice compartment 14 has been filled with water 28 and a seal 30 has been attached. The purpose of seal 30 is to physically separate the ice compartment 14 from the beverage compartment 12 so that container 10 can hold both water and a beverage (both in a liquid state) without having the two mix. It is the separate, sealed ice and beverage compartments that allow the filled container 10 to be stored or shipped without refrigeration.

Figure 6:
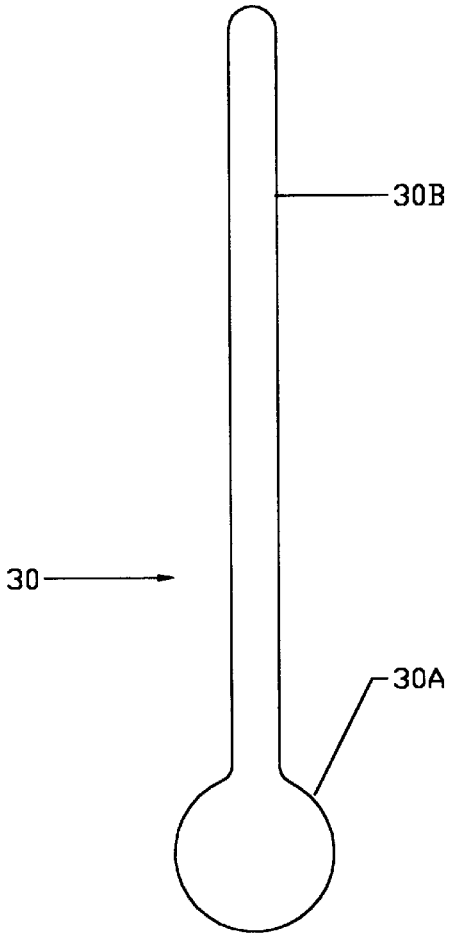
FIG. 6 is a plan view of the seal before it is attached inside the beverage container.
Figure 7:
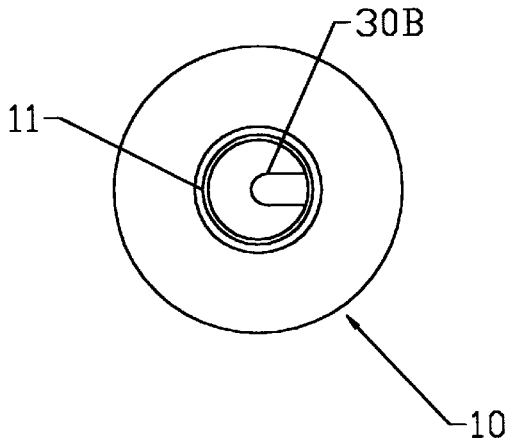
FIG. 7 is a top view of the beverage container showing the tail end of the seal in the mouth of the beverage container.

Seal 30 is attached to ledge 32, a flat area at the bottom of beverage compartment 12 surrounding opening 18. Seal 30 is preferably a foil or thin plastic barrier having a large area 30A at its bottom. This large area 30A of seal 30 is used to cover opening 18 and separates the ice compartment 14 from the beverage compartment 12. Seal 30 also has a narrow tail 30B that extends up to the mouth 11 of container 10. Seal 30 would be preferably attached to container 10 at ledge 32 and mouth 11 with an adhesive that would allow the seal 30 to be easily peeled from container 10 by the consumer of the beverage. The end of tail 30B would extend into the mouth 11 of container 10 so that it can be easily grasped and pulled out of container 10 by the consumer of the beverage. FIG. 6 is a plan view of seal 30 before it is attached inside container 10. FIG. 7 is a top view of container 10 showing the end of tail 30B in mouth 11 as the consumer would see it after removing the cap from container 10.

Figure 8:
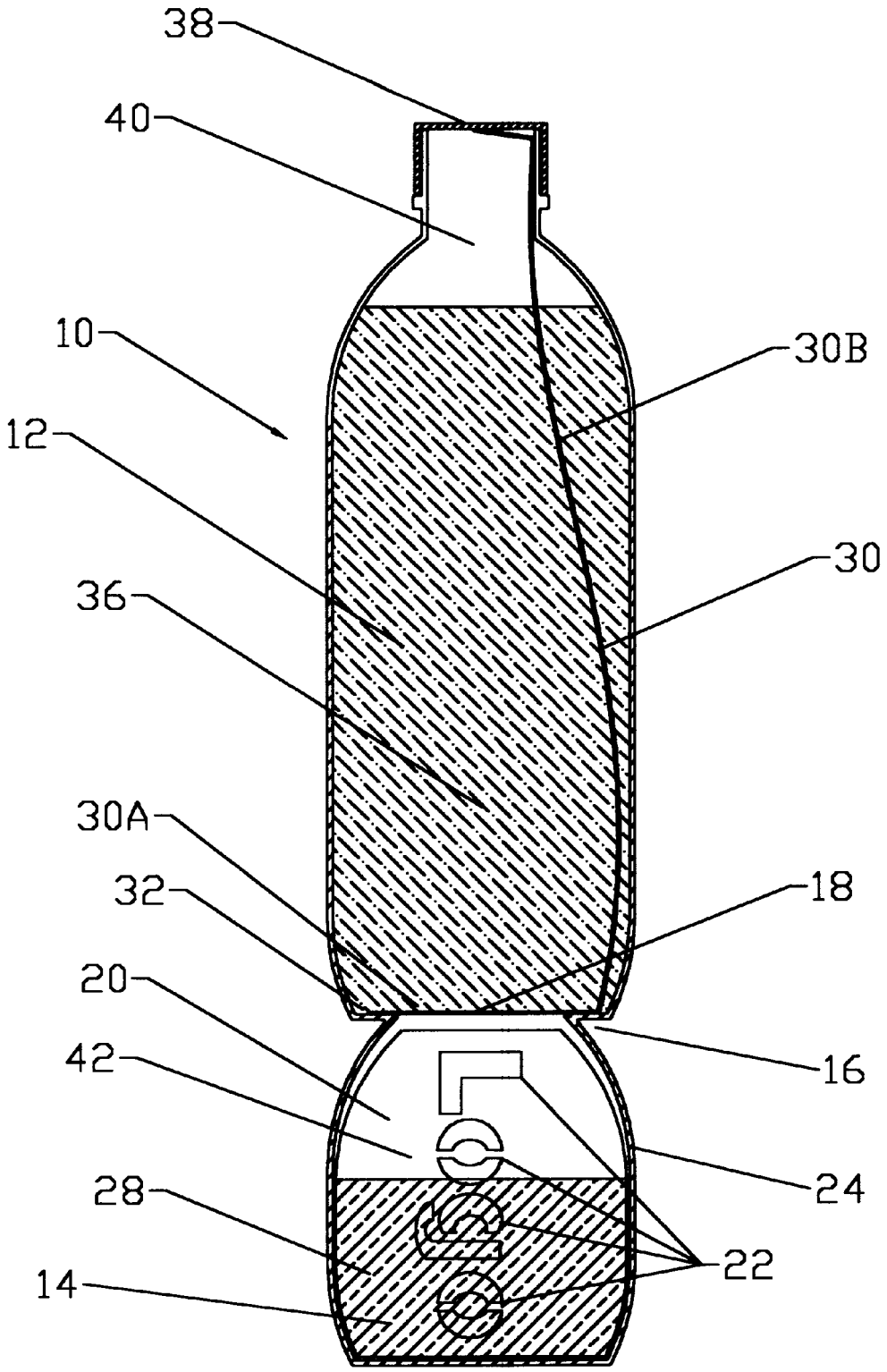
FIG. 8 is a vertical cross-section of the beverage container after it has been filled with a beverage and capped.

FIG. 8 is another vertical cross-section of beverage container 10, this time showing container 10 after it has been filled with a beverage 36 and sealed with a cap 38. It should be noted that both the ice compartment 14 and the beverage compartment 12 have been filled such that there are significant air gaps left inside each of the two compartments. Specifically, there is an air gap 40 at the top of beverage compartment 12 and there is an air gap 42 at the top of ice compartment 14. These air gaps 40 and 42 may be filled with air, $CO_2$, or any other suitable gas, and could be created simply by not completely filling the ice compartment 14 and the beverage compartment 12. Air gap 40 forms the thermal barrier between the water 28 and beverage 36 that allows the water 28 to be frozen without freezing the beverage 36, as will be explained below. Air gap 42 will facilitate the slow-melting feature of container 10, as will also be explained below.

Freezing the Container

Figure 9:
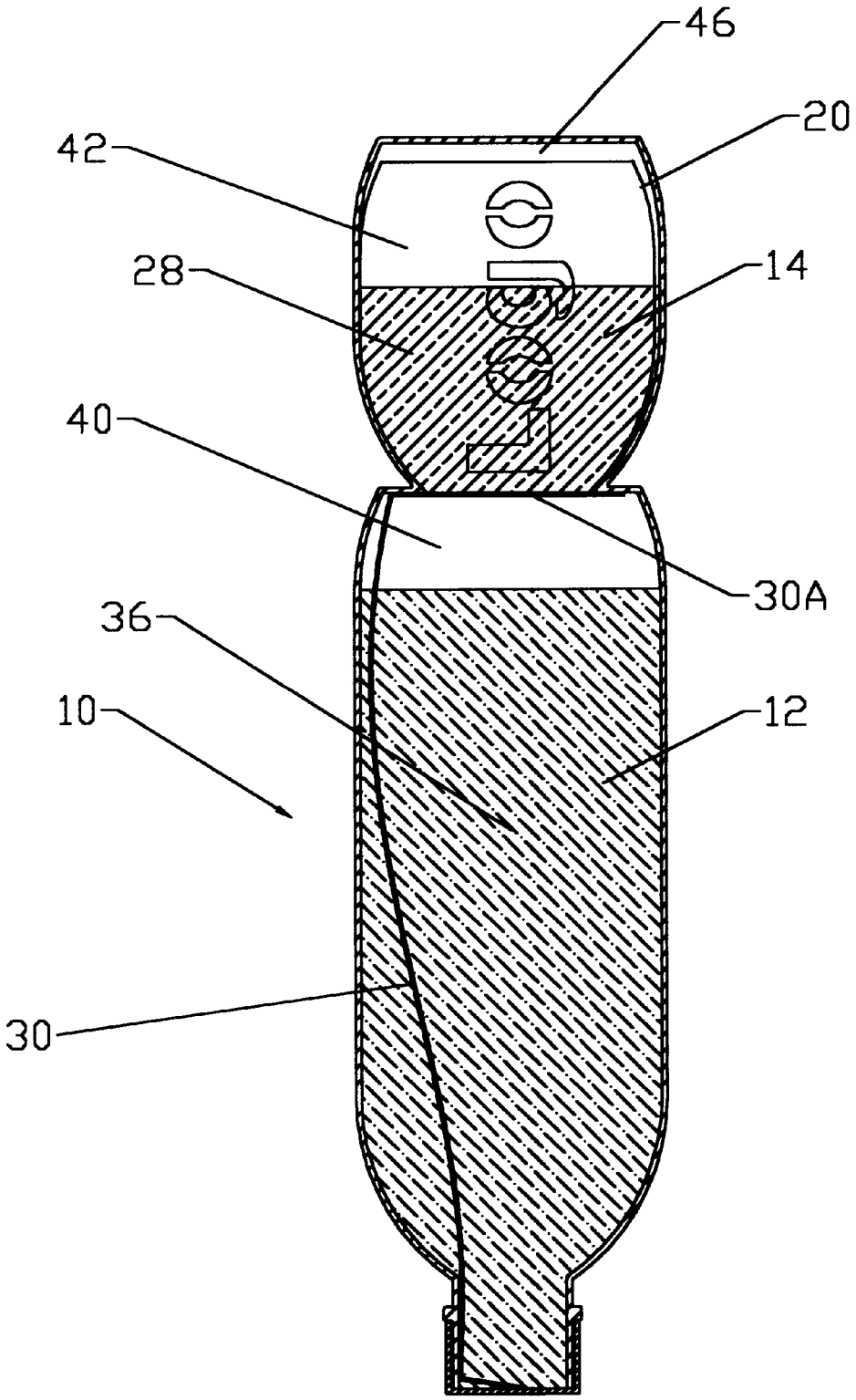
FIG. 9 is a vertical cross-section of the beverage container after it has been filled, capped and inverted for freezing.

FIG. 9 shows a vertical cross-section of container 10 after it has been filled, capped and then inverted. This is the preferred configuration of container 10 during the freezing of the water 28 in the ice compartment 14. In this configuration, air gap 40 (in the beverage compartment 12) is situated between the beverage 36 and the large area 30A of seal 30. In this configuration, the exterior of the ice compartment 14 can be exposed to sub-freezing (below 32° F.) temperatures while the exterior of beverage compartment 12 is exposed to above-freezing temperatures and the water 28 will freeze but the beverage 36 will not. This is made possible by the insulating effect of air gap 40, which creates a thermal barrier between the water 28 and the beverage 36. If there were no air gap 40 and both the water 28 and the beverage 36 were in contact with the large area 30A of seal 30 (for example, if the container 10 were laid on its side) while the water 28 was frozen, it would be virtually impossible to prevent some freezing of the beverage 36 from occurring. However, having air gap 40 and with container 10 positioned upright, there is enough of an insulating barrier between the two fluids to freeze the water 28 without causing any freezing of the beverage 36.

Because ice anchor 20 is immersed in water 28 as it freezes, the water 28 will freeze solidly to the ice anchor 20. It will freeze around and through the perforations 22, essentially locking itself onto the ice anchor 20.

The ice anchor 20 illustrated in FIG. 9 is slightly shorter than the height of the ice compartment 14. Because of this, if the container 10 is upright, there is a slight gap between the seal 30A and the top of the ice anchor 20. Conversely, if the container 10 is inverted as shown in FIG. 9, the ice anchor will slip and fall into contact with the seal 30A, leaving a gap 46 between the bottom of the ice anchor 20 and the bottom of container 10. As will be explained below, this gap is instrumental in improving the slow-melting feature of container 10.

It should be noted that the water 28 in the ice compartment 14 could be frozen with container 10 in orientations other than inverted and vertical. As long as the beverage 36 and the water 28 are not both in contact with seal 30, then the water 28 can be frozen without also freezing the beverage 36. However, for the slow-melting feature of the container 10 to work as described below, the container 10 should be frozen with the ice compartment 14 above the beverage compartment 12 and with water 28 in contact with seal 30. The water 28 in ice compartment 14 can also be frozen with no beverage 36 in beverage compartment 12. This would also allow the water 28 to be frozen without also freezing beverage 36 since there would be no beverage 36 in the container 10.

Figure 10:
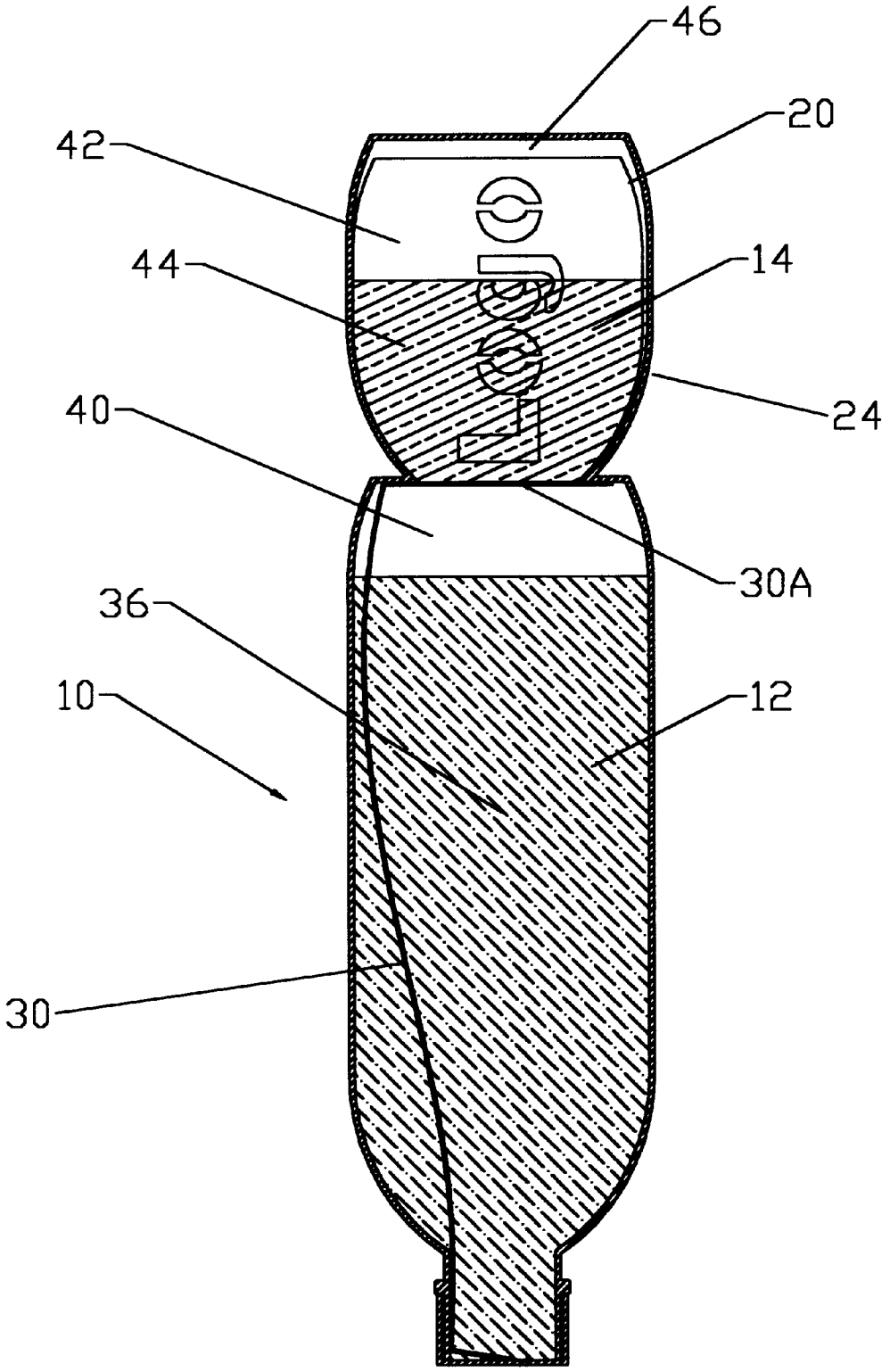
FIG. 10 is a vertical cross-section of the inverted beverage container after the water in the ice compartment has been frozen into ice.

FIG. 10 shows a vertical cross-section of container 10 after the water 28 in the ice compartment 14 has been frozen into ice 44. Freezing of the water 28 into ice 44 is designed to occur with the container 10 in this inverted position as it will enable the slow-melting feature of the container 10, as will be explained. The water 28 is frozen by exposing the walls of ice compartment 14 to sub-freezing temperatures while simultaneously exposing the walls of the beverage compartment 12 to temperatures that are above the freezing temperature of the beverage 36. Equipment needed to accomplish this dual-temperature freezing will be described below.

As the ice compartment 14 is cooled below freezing, the water 28 will expand as it turns to ice 44. Simultaneously the air in ice compartment 14 will contract due to the reduction in temperature. It may be necessary for the walls 24 of ice compartment 14 to have ridges or other means in it to help accommodate this expansion of the ice and change in air pressure.

Container Function—Opening the Container, Removing the Seal, Cooling the Beverage FIG. 11 again shows a vertical cross-section of container 10, this time with container 10 turned upright after ice 44 has been frozen into ice compartment 14. This is the configuration container 10 would be in right after it had been removed from refrigeration by the consumer or immediately after purchase. At this point the temperature of beverage 36 will still be quite cold and ice 44 will be solidly frozen to the top of ice compartment 14. however, assuming seal 30 is made of a thermally conductive material (e.g., metal foil or thin plastic), ice 44 will not be frozen to seal 30. As soon as container 10 is turned upright, beverage 36 contacts seal 30 and, because of thermal conduction through seal 30, melts the portion of ice 44 that is in contact with the other side of seal 30. If on the other hand seal 30 were made of a nonconductive material (e.g., paper), ice 44 would still be stuck (frozen) to it, making it difficult to remove seal 30 at this time.

The consumer can now either open container 10 to drink the beverage 36 immediately, or he or she can keep the container 10 closed for later consumption. To open container 10 now, the consumer would first remove cap 38 in the usual manner. He or she would then grasp the tail end 30B of seal 30 and pull it. This would peel the tail end 30B of seal 30 from the mouth 11 of container 10 and then peel large end 30A of seal 30 free from ledge 32. Removal of seal 30 from ledge 32 would open the ice compartment 14 to the beverage 36. The consumer would continue to pull seal 30 until it was completely removed from container 10.

Figure 12:
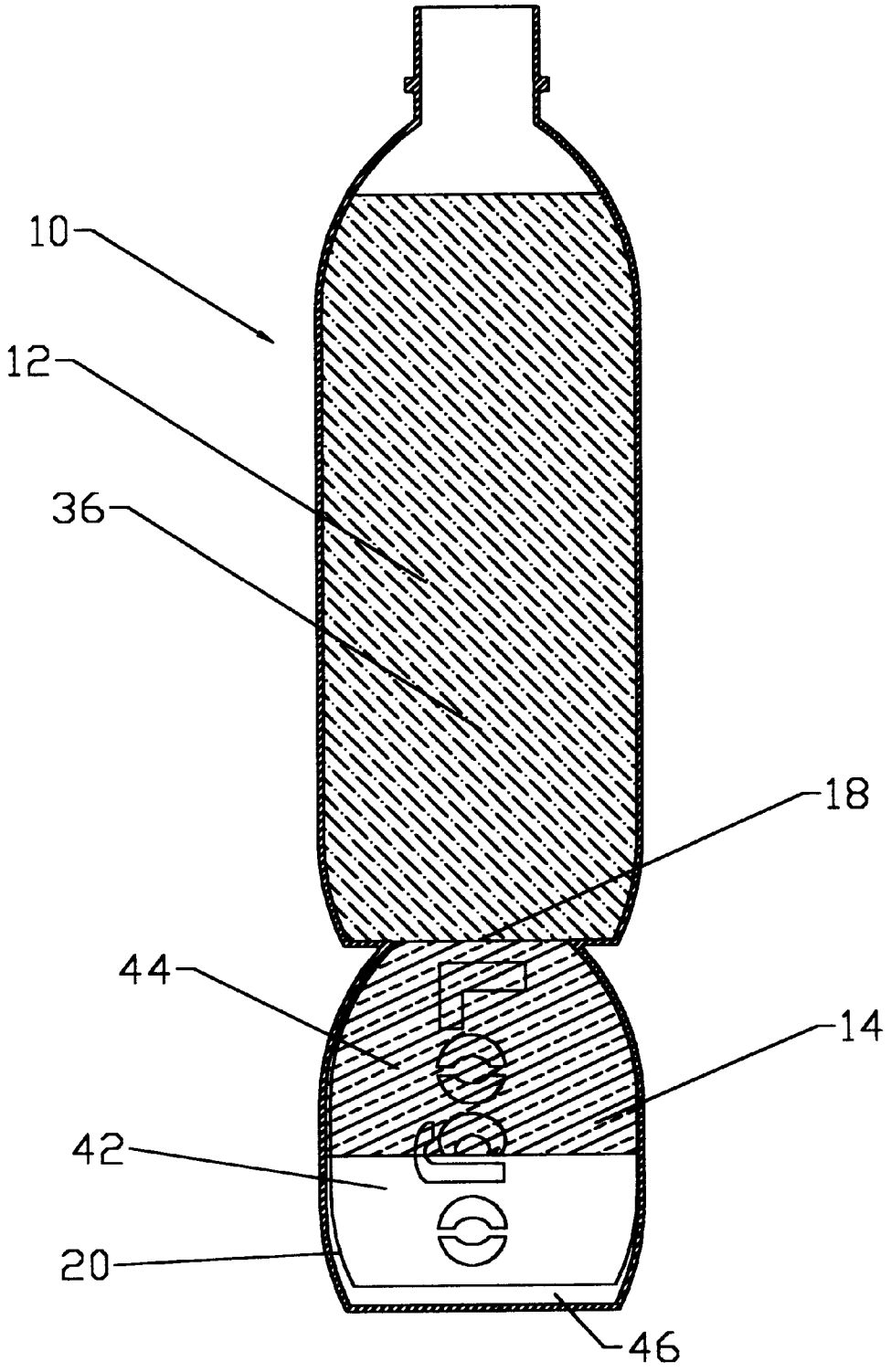
FIG. 12 is a vertical cross-section of the beverage container when it has been opened and unsealed immediately after removing the bottle from refrigeration.

If the seal 30 is removed right away, beverage 36 will not flow into ice compartment 14 since the ice 44 will still be blocking the opening 18, as shown in FIG. 12. This minimizes the amount of cooling beverage 36 receives, since there would be little surface area of the ice 44 exposed to beverage 36. However, since the beverage 36 would still be cold at this time, little cooling would be needed.

Figure 13:
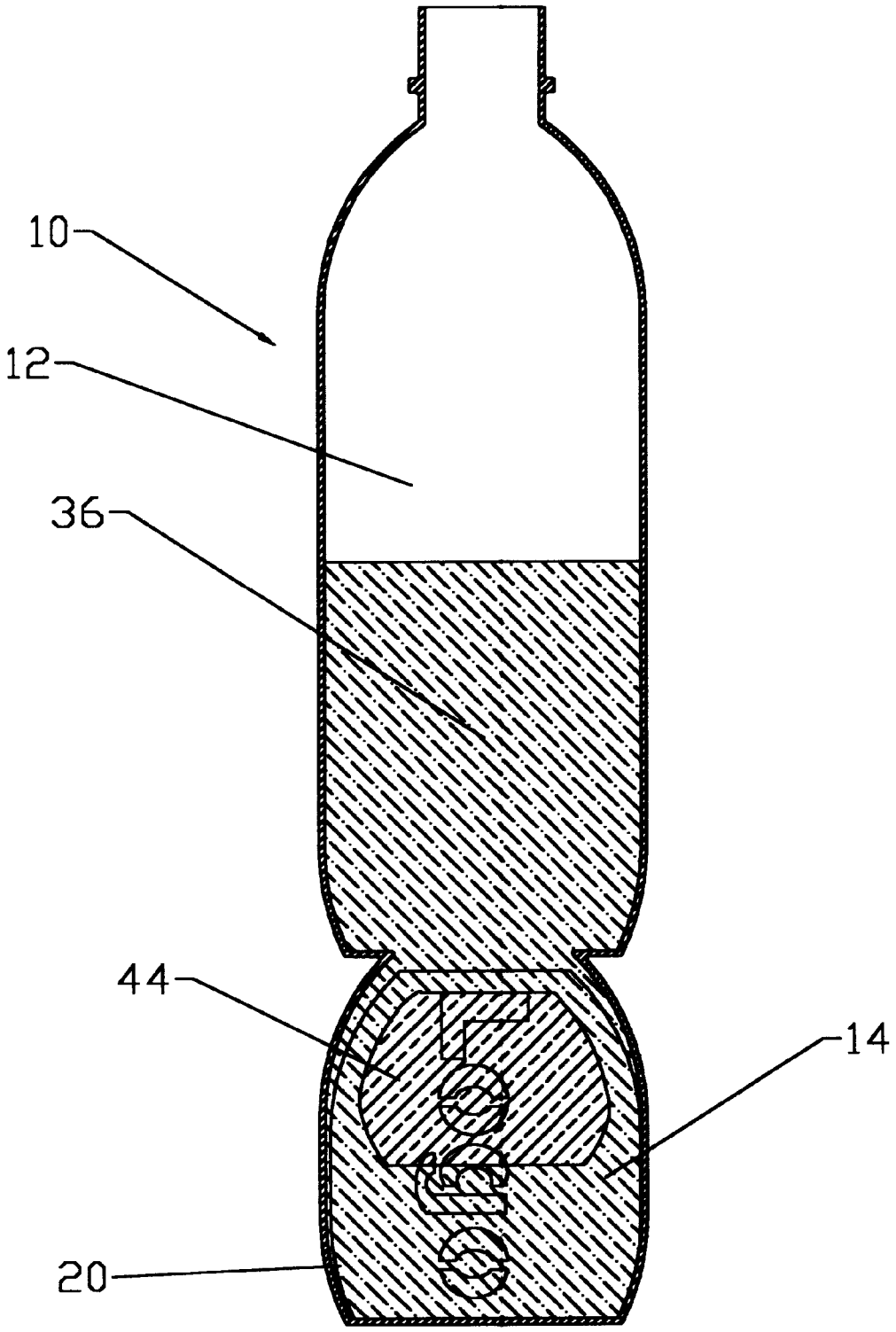
FIG. 13 is a vertical cross-section of the beverage container when it has been opened and unsealed and the ice has begun to melt.

Within a relatively short amount of time after removing container 10 from refrigeration, (e.g., fifteen to thirty minutes), the ice 44 would melt enough to let the beverage 36 seep into and fill ice compartment 14. This would greatly increase the heat transfer between the beverage 36 and the ice 44, cooling the beverage and melting the ice. This condition is illustrated in FIG. 13. Repeated tipping of container 10 at this point will increase the mixing of the beverage 36 and the ice 44, cooling the beverage 36 further. Depending on the ambient temperature, the rate at which the beverage 36 is consumed, and the initial ratio of the volume of ice 44 to beverage 36, the ice 44 in container 10 may keep the beverage 36 cool for four hours or more.

Slow-Melting Feature

Figure 14:
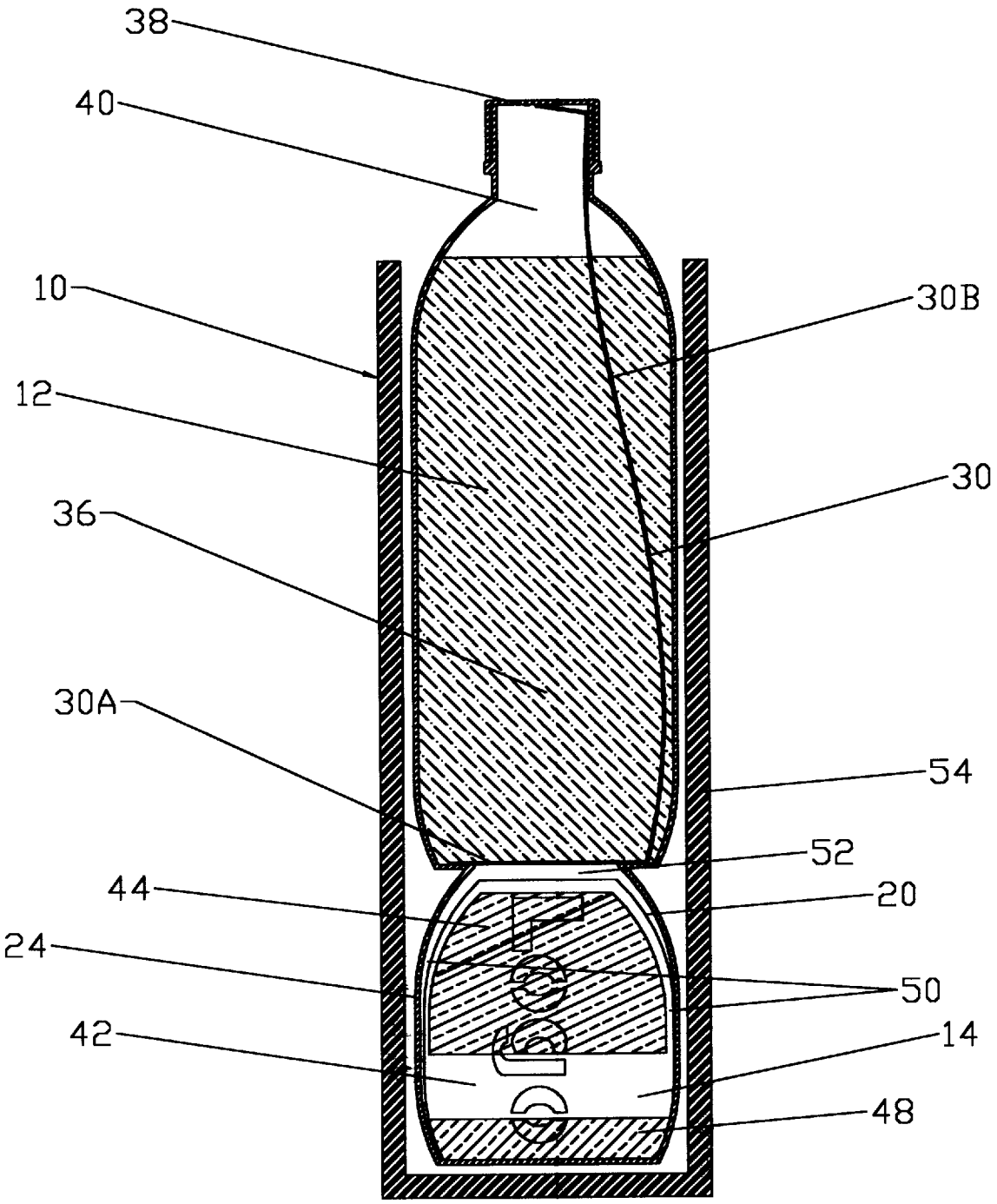
FIG. 14 is a vertical cross-section of the beverage container when the ice has been allowed to melt without removing the seal.

If the consumer does not open container 10 right away, but instead decides to save the beverage 36 for later consumption, the unique slow-melting features of the container 10 will be utilized. FIG. 14 illustrates what happens when the consumer keeps the container 10 upright and does not remove seal 30. The ice 44 that is in contact with the walls 24 of the ice compartment 14 will melt first as the container 10 begins to warm up. The resulting melt water 48 will drain down into the bottom of the ice compartment 14, leaving an air gap 50 between the walls 24 of the ice compartment 14 and the remaining ice 44. This air gap 50 provides an insulating layer of air between the warm walls 24 of the ice compartment 14 and the ice 44, inhibiting heat transfer between the ice 44 and the walls 24 and allowing the ice to melt much more slowly that it would otherwise.

It is the presence of the ice anchor 20 and the ice compartment air gap 42 below the ice 44 that make the slow melting of ice 44 possible. During freezing, the water 28 freezes through perforations 22 in ice anchor 20, locking the ice 44 to the ice anchor 20. Because the ice anchor 20 is securely located inside ice compartment 14, the position of the attached ice 44 is thus also fixed within the ice compartment 14, even as it melts. It is this fixing of the position of the ice 44 within the ice compartment 14 that allows the ice 44 to be suspended within the ice compartment 14 so that it is completely surrounded by an insulating layer of air (i.e., air gap 50). Air gap 42 below the ice 44 gives the melt water 48 a place to go so that the melt water 48 drains out of contact with ice 44.

Without the ice anchor 20 or the air gap 42, the ice 44 would melt away from walls 24, fall to the bottom of the ice compartment 14 and sit in the melt water 48. Because water is a fairly good heat transfer medium, the warm walls 24 would continue to transfer heat through the melt water 48 to the ice 44, melting it at its usual, faster rate. With the ice 44 suspended within air gap 50, the ice 44 will last two to three times as long as it would if it were sitting in the melt water 48.

When the consumer finally decides to open the container 10, he or she can do so simply by removing cap 38 and then pulling seal 30 out of the container 10. This will cause beverage 36 to flow into ice compartment 14 and begin to be cooled by the remaining ice 44. Because of the slow-melting feature of container 10, there will be a substantial amount of ice left in ice compartment 14 even after 6 hours or more without refrigeration, enough to cool the beverage 36 to a desirably cold temperature.

For the ice 44 to melt as slowly as possible, it is important that the ice 44 not lean against or touch the warm walls 24 of the ice compartment 14. That is why the ice anchor 20 must be held securely in place inside the ice compartment 14. If the ice anchor 20 can tip and allow the ice 44 to touch the walls 24 of the ice compartment 14, the ice 44 will melt more quickly than it should. It is also important that the ice 44 not prematurely melt free of the ice anchor 20 and fall into the melt water 48. Because ice 44 will tend to melt at an equal rate on all sides, the last of ice 44 to melt will be located along the centerline and in the upper one third of the ice compartment 14. It is important that the ice anchor 20 pass through that point and have perforations 22 located there. If the ice anchor 20 is off-center in the ice compartment 14, the ice 44 will melt free from it sooner than if the anchor 20 passed directly through the center of the ice compartment 14.

Figure 11:
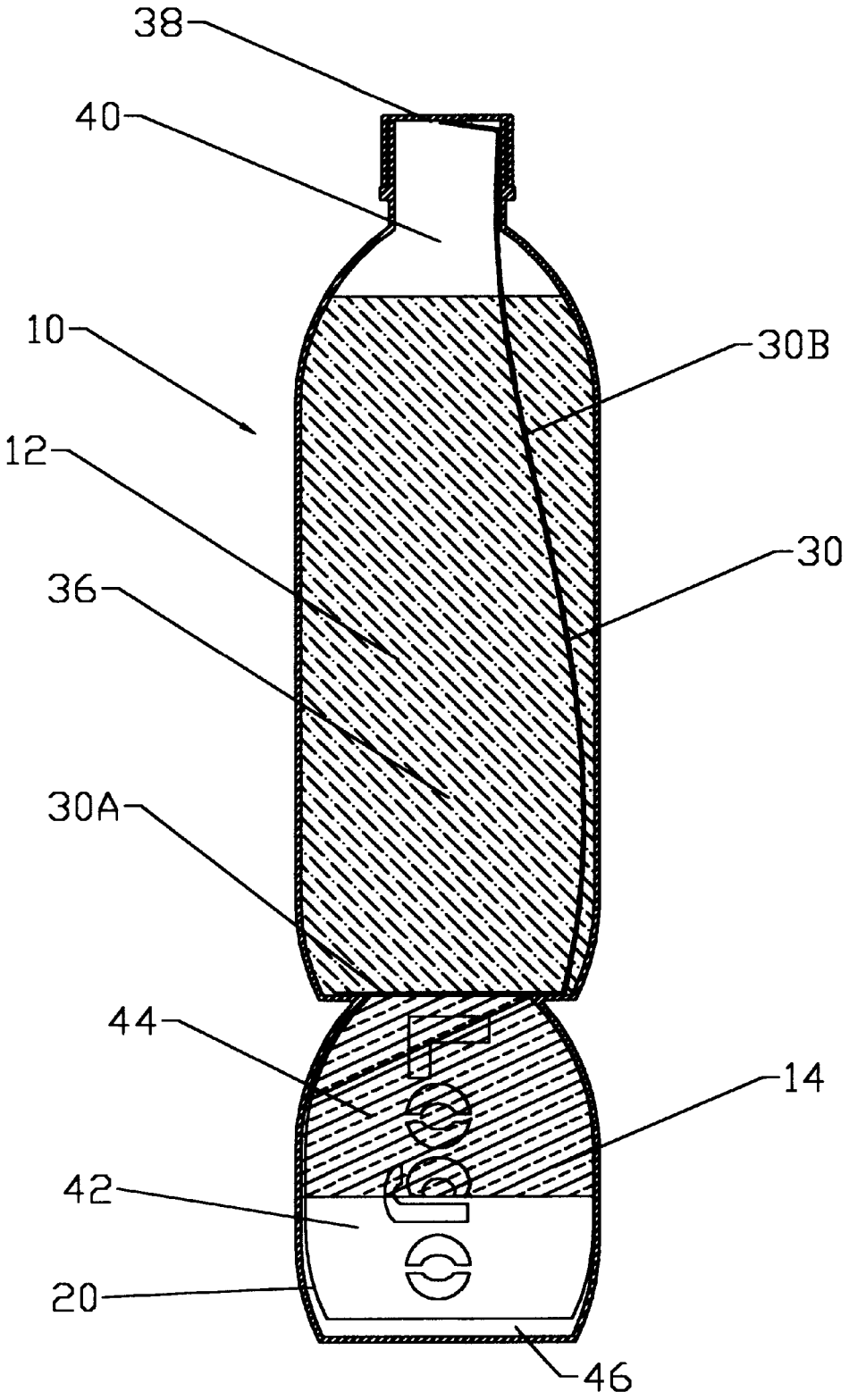
FIG. 11 is a vertical cross-section of the beverage container turned upright after the ice has been frozen into the ice compartment.

Another feature that slows the melting of ice 44 has to do with the gap 46 at the bottom of the ice compartment 14 as can be seen in FIG. 11. When ice 44 first begins to melt with the seal 30 still in place, ice 44 and the ice anchor 20 will drop slightly until ice anchor 20 is resting on the bottom of the ice compartment 14. Thus the gap 46 which existed beneath ice anchor 20 before is now a gap 52 above ice anchor 20 as seen in FIG. 14. This allows the thickness of air gap 52 above the ice 44 to instantly increase, rather than having to wait for the gap to be created completely by melting of ice 44. By instantly creating gap 52 in this way, ice 44 becomes insulated sooner than it would otherwise, and ice 44 will consequently last longer.

Melting of the ice can be further slowed by insulating the outside of the ice compartment 14, for example by coating it with a layer of foam or by placing the container 10 in an insulated sleeve. However, these steps have some drawbacks: adding insulation adds cost to the container, slows the freezing process (since heat transfer to the ice compartment 14 would be inhibited), prevents visual inspection to see how much ice, if any, is in the ice compartment 14 (no one will want to buy or sell a container that had not been fully frozen), and it would prevent the patterns 22 cut into the ice anchor 20 from being visible. These last two drawbacks are also the reason that the container 10 is preferably made from a clear material—that is, so the contents of the ice compartment 14 are visible. However, using container 10 with a removable insulated sleeve 54 (which would not be present during freezing) would be ideal for making the ice 44 last as long as possible. An insulated sleeve 54 is shown in FIG. 14.

Slow-Melting After Seal Removal

Figure 15:
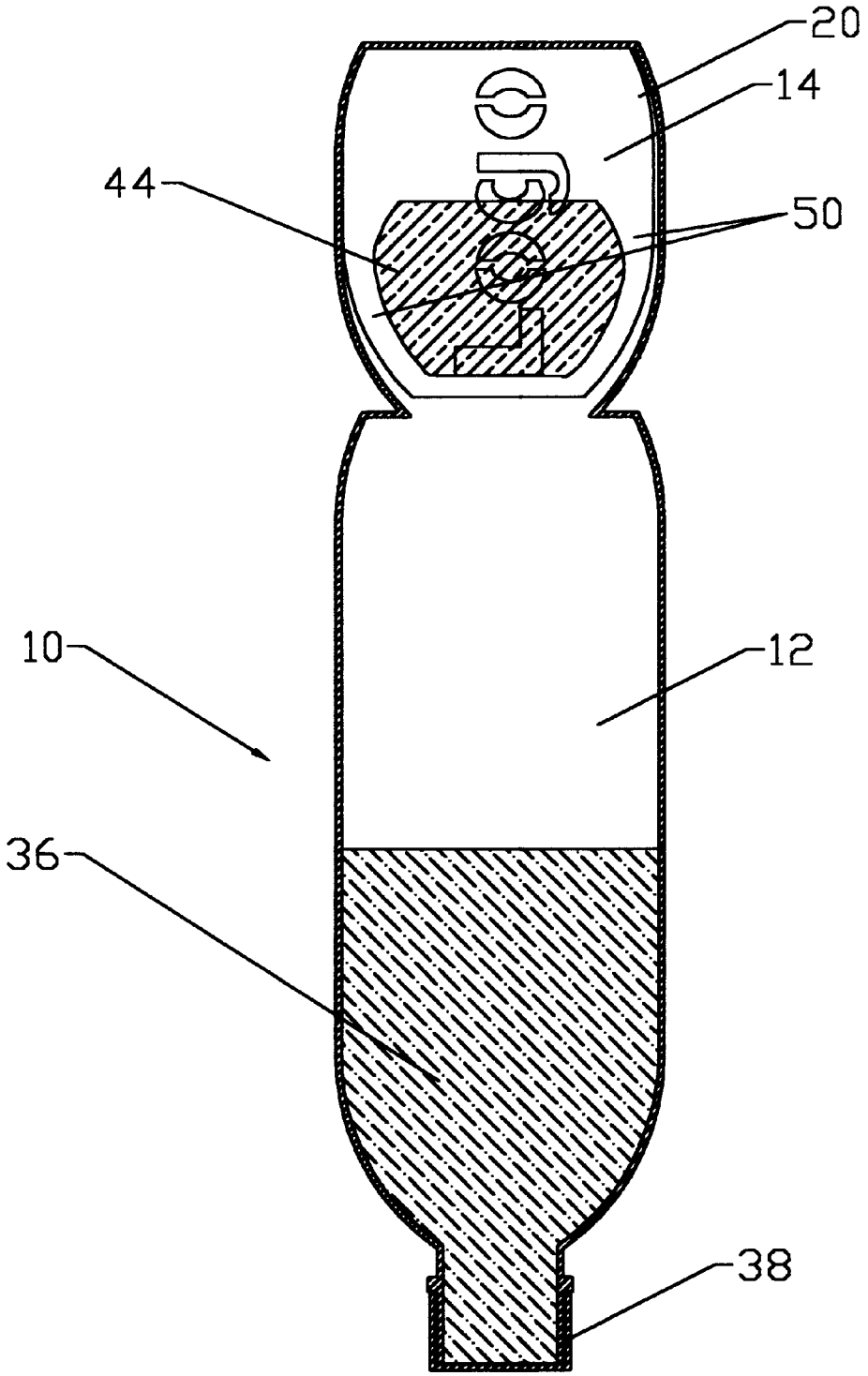
FIG. 15 is a vertical cross-section of the beverage container when it has been unsealed and the container has been inverted to slow the melting of the ice.

If the consumer wants to slow the melt rate again after seal 30 has been removed, he or she can simply put the cap 38 back on container 10 and invert the container 10. This allows the beverage 36 (which is now mixed with the melt water 48) to flow out of the ice compartment 14 and into the beverage compartment 12. This again suspends the remaining ice 44 in an insulating layer of air 50, as can be seen in FIG. 15, thereby slowing the rate of melting.

Using with Carbonated Beverages

Filling the present invention with a carbonated beverage presents some added challenges that do not exist with non-carbonated or lightly carbonated beverages. First, the carbonation greatly increases the pressure that can exist inside the container 10 when it is capped. This pressure makes the size of the seal 30, the seal material and the adhesive used to attach it much more critical. It may be necessary to reduce the size of the opening 18 in order to reduce the force that the seal 30 must withstand. The seal material and the adhesive used to attach it must be strong enough to withstand the pressures involved yet still permit the consumer to easily peel the seal 30 free from the container.

Figure 16:
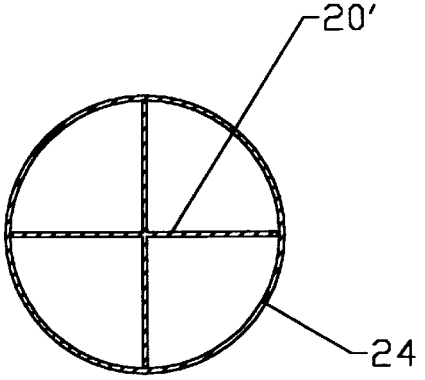
FIG. 16 is a horizontal cross-section of the beverage container taken through the ice compartment showing an alternate embodiment of the ice anchor.

Another step that can be used to add strength to the seal 30 is to have the seal 30 rest on the ice anchor 20. This way the pressure applied to the seal 30 could be transmitted through the ice anchor 20 and down to the much stronger base of the container 10. For example, FIGS. 16 and 17 illustrate an alternate embodiment of the ice anchor 20' that is an extruded plastic form rather than a sheet of plastic film. Such an extruded form would be structurally much stronger than a sheet of plastic film, and could provide much needed support to seal 30 when beverage 36 was a carbonated beverage. FIG. 16 is a horizontal cross-section of the ice compartment 14 with ice anchor 20' inside it. FIG. 17 is a vertical cross-section of an alternate embodiment container 10' containing the anchor 20'. By allowing seal 30 to rest on the top of anchor 20', the pressure inside the beverage compartment 12 can be effectively transmitted to the base of container 10', which can withstand carbonated beverage pressures.

Figure 17A:
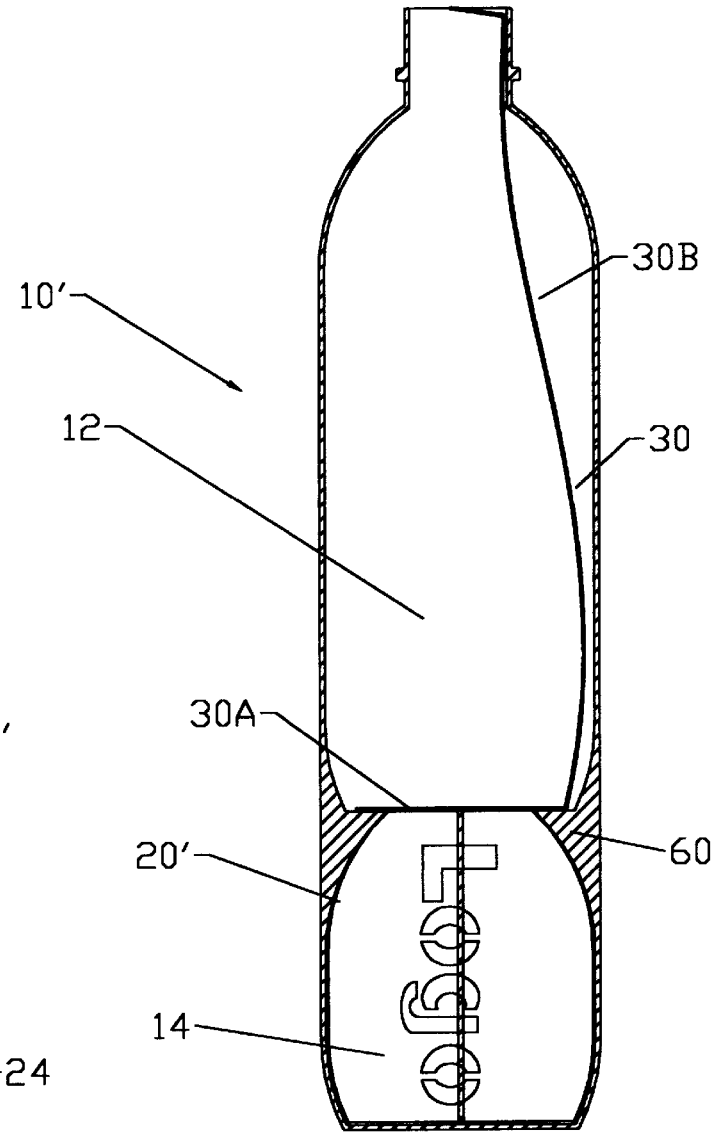
FIG. 17A is a vertical cross-section of an alternate embodiment of the beverage container that has features for accommodating carbonated beverages.
Figure 17B:
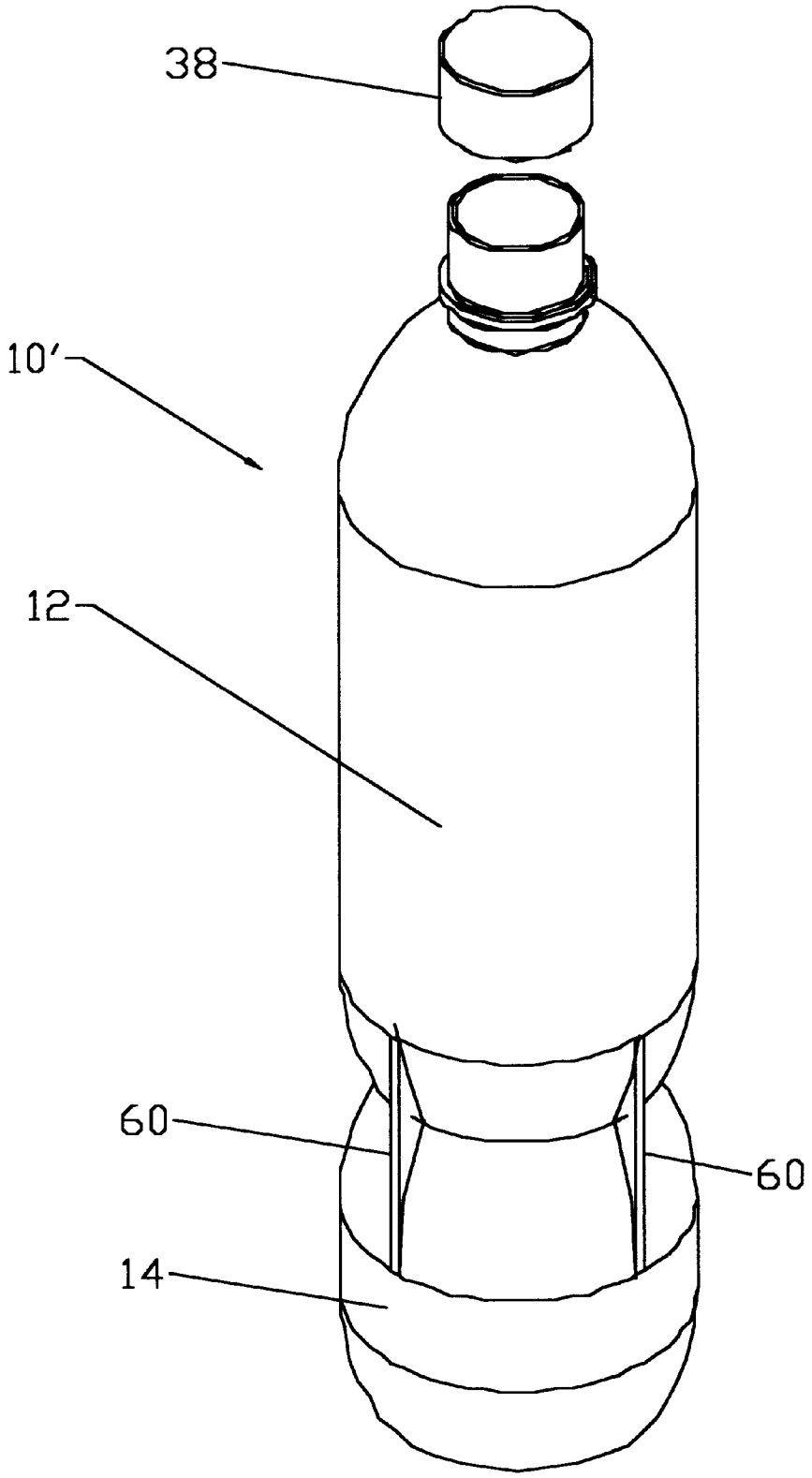
FIG. 17B is an isometric view of an alternate embodiment of the beverage container that has features for accommodating carbonated beverages.

The pressures associated with carbonated beverages may also require that the container 10 be strengthened at its waist 16. FIG. 17A and FIG. 17B illustrate one means for providing additional strength. It shows webs 60 located at waist 16. Webs 60 may be needed at two or more points around the circumference of waist 16 to provide necessary added strength.

Another challenge with carbonated beverages is that they tend to foam when exposed to ice and/or when agitated. One of the reasons the ice 44 should be frozen at the top of ice compartment 14 rather than the bottom of ice compartment 14 has to do with this foaming. Experiments conducted with ice located at the bottom of the ice compartment 14 showed that when the ice was sub-cooled (i.e., the ice was fresh out of the freezer and below 32° F.) and the seal 30 was removed quickly, the cold ice and the agitation created by the beverage falling rapidly into the ice compartment 14 caused the container 10 to overflow with foam. However, with the ice 44 located at the top of the ice compartment 14, when the seal 30 was removed, the beverage 36 hardly foamed at all. This elimination of foaming is a result of three factors. First, because the ice 44 blocked the opening 18 to the ice compartment 14, the beverage 36 did not fall into the ice compartment 14, so there was no agitation of the beverage 36. Second, the surface area of ice exposed to the beverage 36 when the seal 30 was removed was fairly small—only as big around as the opening 18. Because the area of the ice exposed was smaller, its ability to cause a foaming reaction was reduced. Third, because the ice 44 was in contact with the seal 30 prior to its removal, and because the seal 30 was thermally conductive, the ice 44 that was in contact with seal 30 got warmed by the beverage 36 and slightly melted even before the seal 30 was removed. This removed the sub-cooling from the ice 44 and eliminated that part of the foaming reaction that results from a carbonated beverage contacting sub-cooled ice. Thus by having the ice 44 located at the top of the ice compartment 14 as has been proposed in this document, foaming is minimal when the ice is fresh out of the freezer.

When there has been substantial melting of ice 44 prior to opening the seal 30, the beverage will be able to fall into the ice compartment 14 when the seal 30 is removed. This will cause agitation of the beverage and consequently there will be foaming. However, in this case there is no foaming resulting from contact of the beverage with sub-cooled ice (since the ice has warmed to 32° F. at this point). The foaming that does occur is less severe, and can be controlled simply by removing the seal 30 slowly.

Beverage Dilution

One of the drawbacks of the present invention is that the beverage 36 will become diluted when it mixes with the melt water 48. There are four ways to avoid this: 1.) Use the container only with beverages that are minimally affected by dilution (e.g., water, sports drinks), 2.) Increase the concentration of the beverage 36 in the container 10 so that it will be the desired concentration after it is diluted by the melt water 48, 3.) Provide a means for removing the melt water 48 before opening the seal 30, and 4.) Alter container 10 so that the ice 44 and beverage do not mix, but are instead only in heat exchange contact with each other.

Option 1 is the ideal solution, but only works with a few beverages (e.g., water and sports drinks).

Option 2, increased beverage concentration, would be simple to accomplish for most beverages. Since most soft drinks and sports drinks are made by mixing syrup with water or carbonated water, the syrup and carbonation concentrations could easily be increased for use in the present invention. However this option would still result in a drink that got more diluted as the ice melted. It would just start and end tasting "stronger" than if the beverage had not been altered in the first place.

Figure 18:
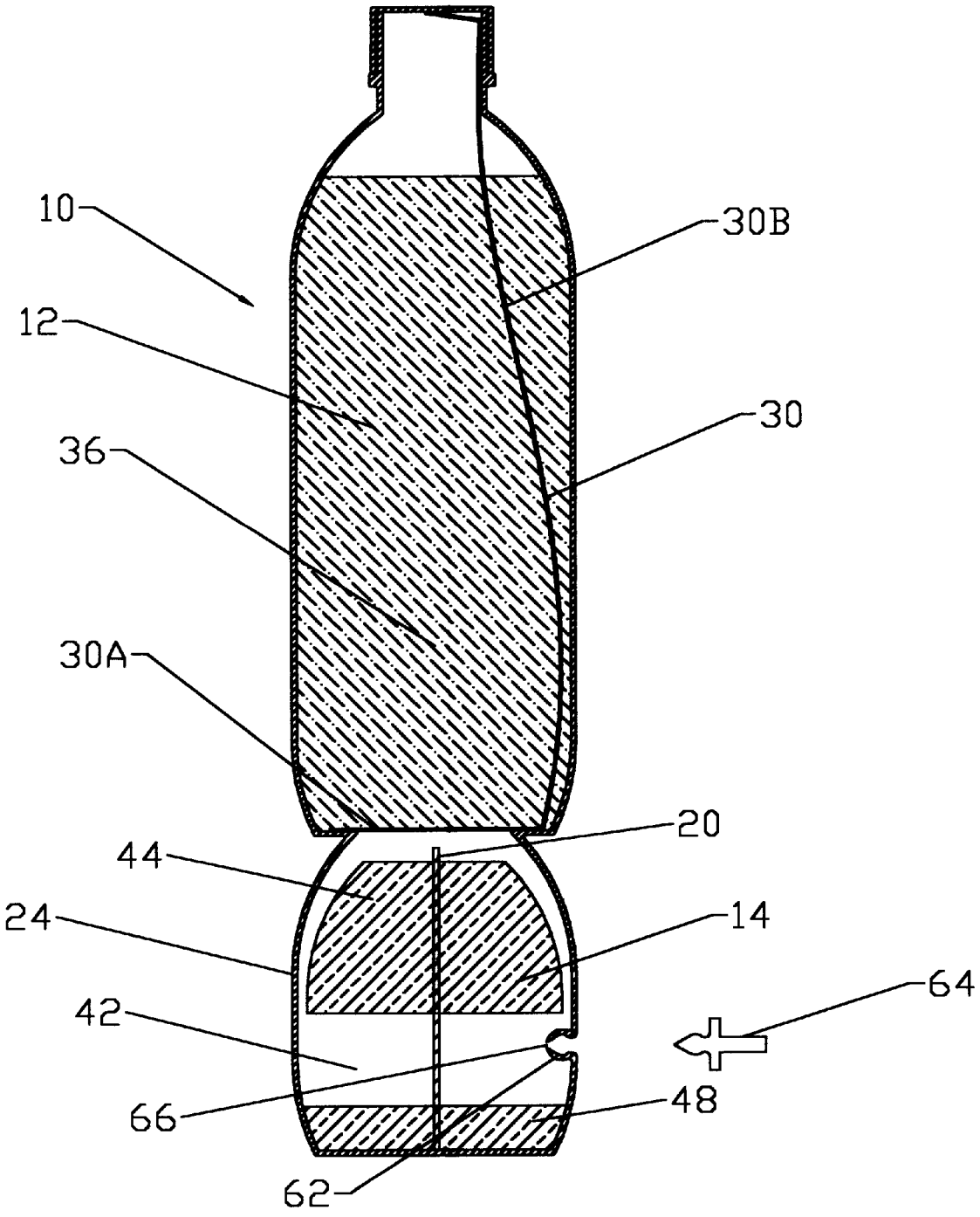
FIG. 18 is a vertical cross-section of an alternate embodiment of the beverage container that has a feature to allow the ice melt water to be drained prior to unsealing.

Option 3, draining the melt water, could be implemented as follows: By including a puncturing means and a puncture-sealing means with container 10, it would be possible for the consumer to puncture the ice compartment 14, drain the melt water 48 and reseal the ice compartment 14 prior to the removal of seal 30. For example as shown in FIG. 18, a dimple 62 could be built into the wall 24 of the ice compartment 14 and a small plastic tack 64 could be provided with the container 10. By pushing the tack 64 into dimple 62 and then removing it, a small hole 66 could be made in the ice compartment wall 24 that could be used to drain melt water 48 from ice compartment 14. Tack 64 could then be reinserted into dimple 62 to seal the hole 66.

Option 4 involves a fairly different container design that would not allow the ice and the beverage to mix, but would instead have a heat exchange surface that would allow the ice to cool the beverage. This no-mix beverage container is shown in FIG. 19 through FIG. 22.

Figure 19:
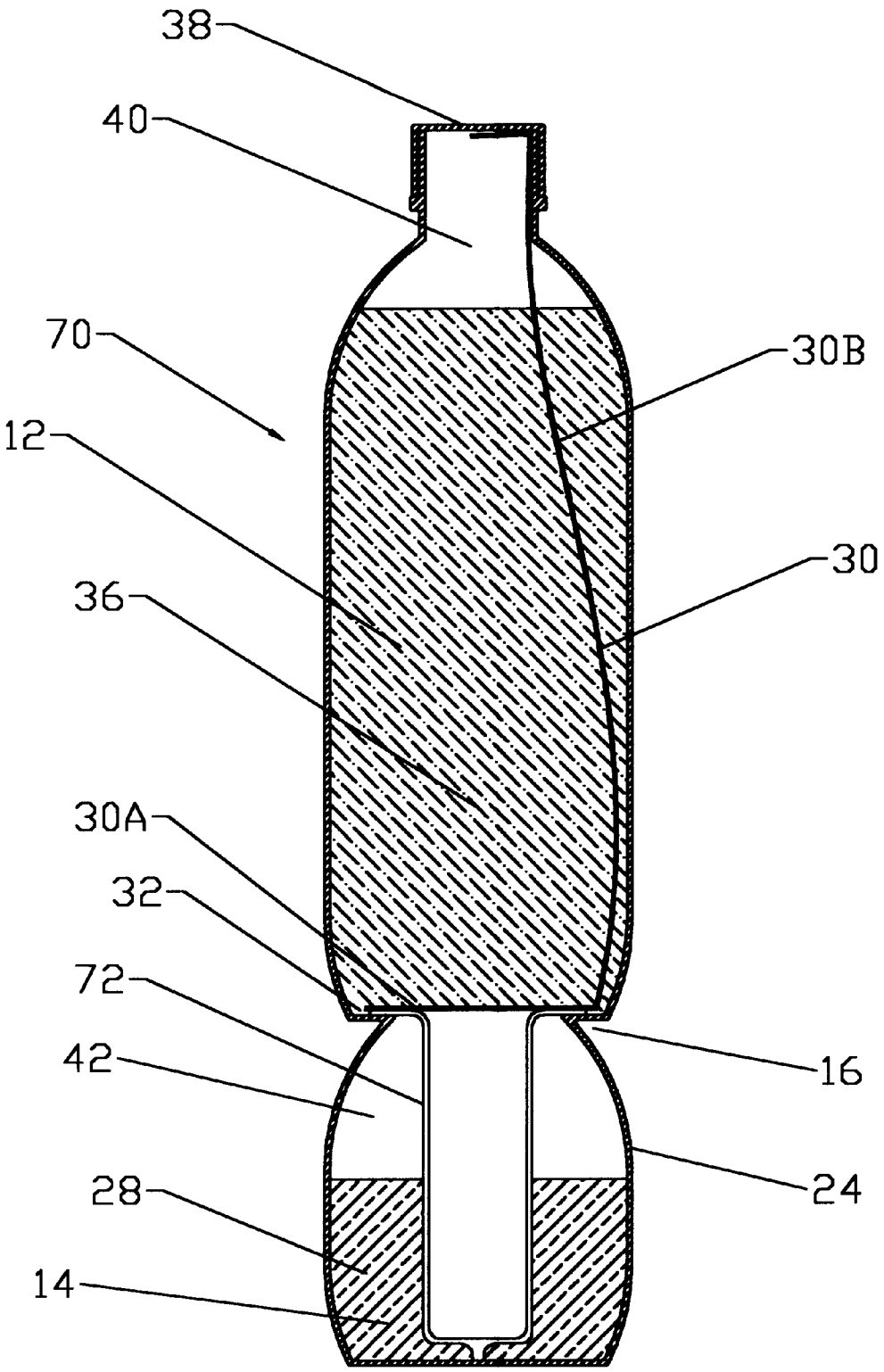
FIG. 19 is a vertical cross-section of an alternate embodiment of the beverage container that has a heat exchange barrier to allow the ice to cool the beverage without the melt water mixing with the beverage.

FIG. 19 shows a vertical cross-section of a no-mix beverage container 70 that is very much like the container 10 shown in the previous figures. The difference is that container 70 has a heat exchange barrier 72 instead of an ice anchor 20. Heat exchange barrier 72 is a hollow tube (which could be made of plastic, metal or any other suitable material) that is filled with air and capped on one end by seal 30. It is permanently attached to ledge 32 such that it blocks opening 18, permanently sealing the ice compartment 14 from the beverage compartment 12. Heat exchange barrier 72 is installed after ice compartment 14 has been filled with water 28. Ice compartment 14 is filled only partially with water 28 in order that a gap 42 is left in the ice compartment 14.

Figure 20:
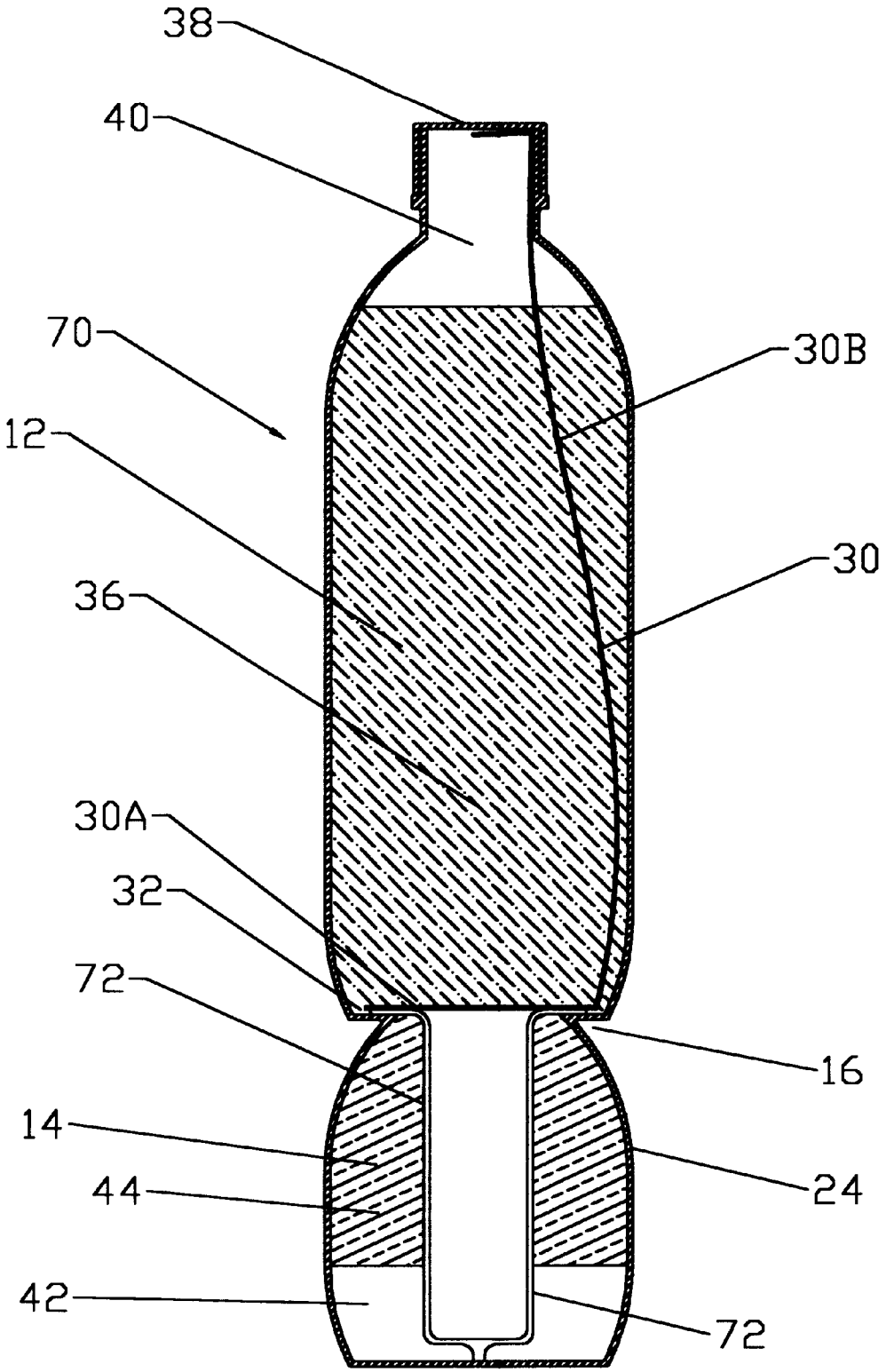
FIG. 20 is a vertical cross-section of the alternate embodiment of the beverage container after the water has been frozen.

The water 28 in ice compartment 14 would be frozen by inverting container 70 and exposing ice compartment 14 to sub-freezing temperatures while exposing the beverage compartment 12 to above-freezing temperatures. The resulting ice 44 is located at the top of the ice compartment 14 with an air gap 42 below it, as shown in FIG. 20.

Figure 21:
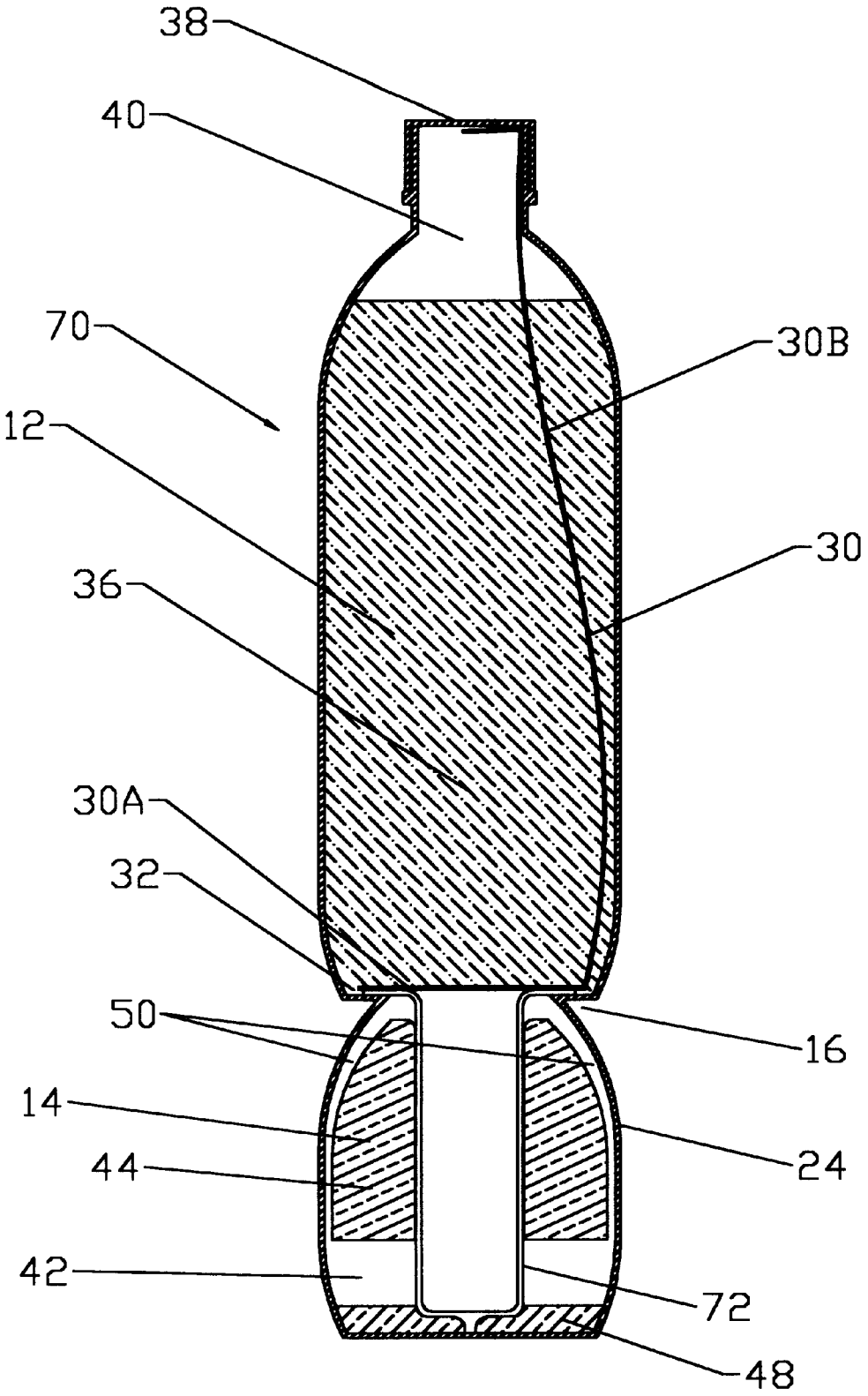
FIG. 21 is a vertical cross-section of the alternate embodiment of the beverage container when the ice has started to melt prior to unsealing.

Once container 70 is removed from refrigeration and held upright (e.g., prior to beverage consumption) the ice 44 that is in contact with the warm container walls 24 will melt, leaving a gap 50 between the ice 44 and the walls 24, as shown in FIG. 21. Melt water 48 will drain down out of gap 50 and into gap 42 at the bottom of the ice compartment 14. Once again melting of the ice 44 will be slowed considerably by the of air gap 50 that now surrounds ice 44.

Because the walls of heat exchange barrier 72 are initially thermally isolated from both the beverage 36 and the warm walls 24 of ice compartment 14, the ice 44 in contact with the heat exchange barrier 72 will melt very slowly. This will allow ice 44 to stay stuck (frozen) to heat exchange barrier 72. This prevents ice 44 from prematurely falling to the bottom of the ice compartment 14 and into the melt water 48. Thus the heat exchange barrier 72 will cause the ice 44 to be suspended in air gap 50 within the ice compartment 14, slowing the melting of ice 44.

Figure 22:
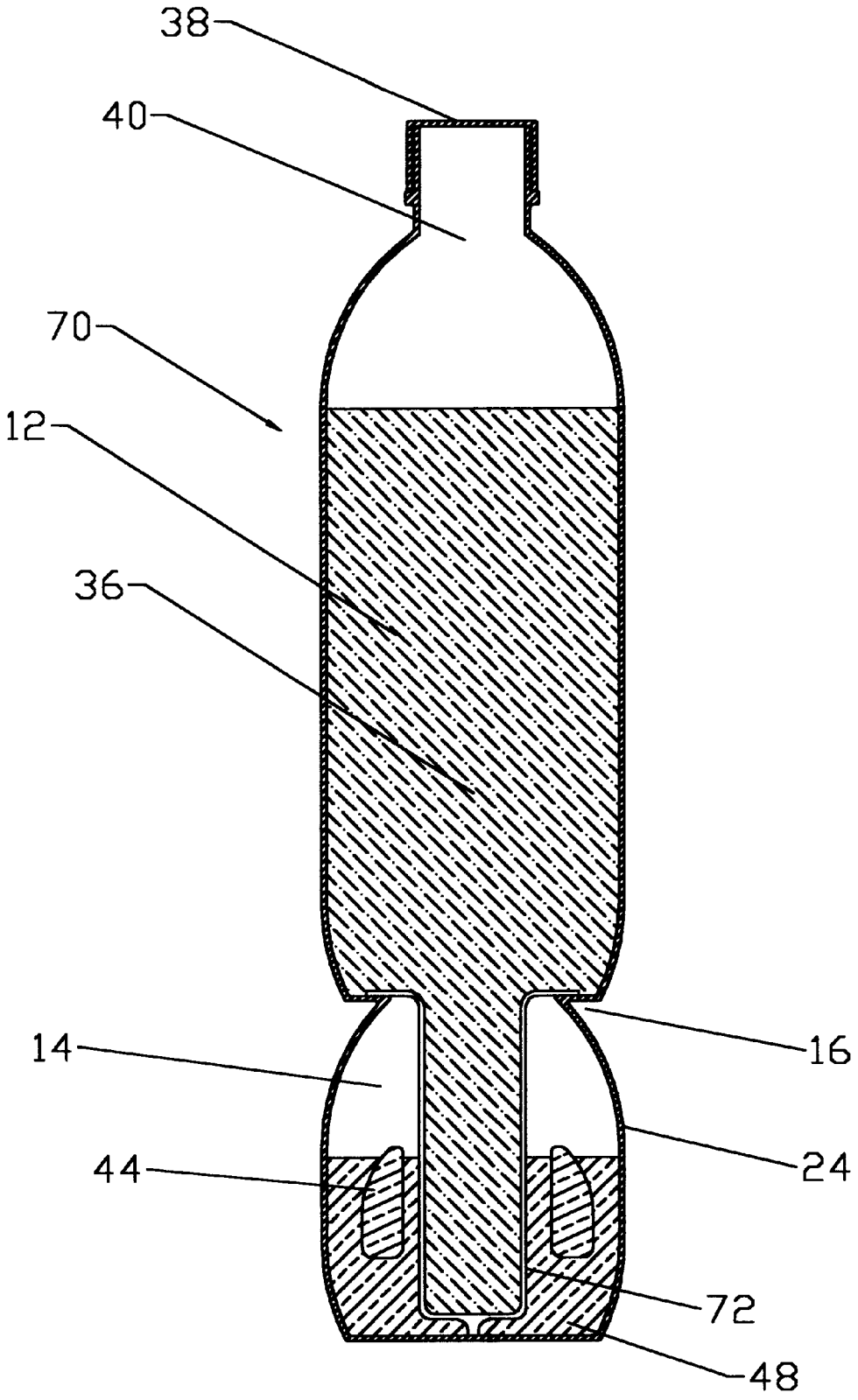
FIG. 22 is a vertical cross-section of the alternate embodiment of the beverage container after the ice has started to melt and the container has been unsealed.

When the consumer removes seal 30, however, beverage 36 will flow into contact with heat exchange barrier 72 as shown in FIG. 22. This will cause the ice 44 that is in contact with the heat exchange barrier 72 to melt free from it. The ice 44 will then drop down into the melt water 48. Because melt water 48 and/or ice 44 will be in contact with the outside of heat exchange barrier 72 and the beverage 36 will be in contact with the inside of heat exchange barrier 72, heat will be transferred from the warmer beverage 36, through the walls of heat exchange barrier 72, and into the ice 44 and cold melt water 48. This allows beverage 36 to be cooled by the ice 44 without diluting beverage 36.

Figure 23:
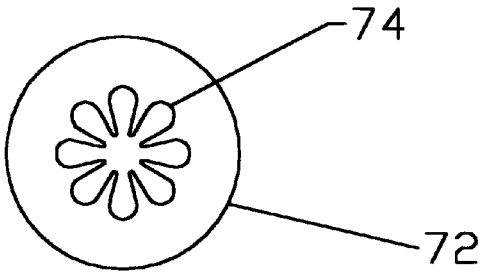
FIG. 23 is a top view of the heat exchange barrier showing the profile of its walls.
Figure 24:
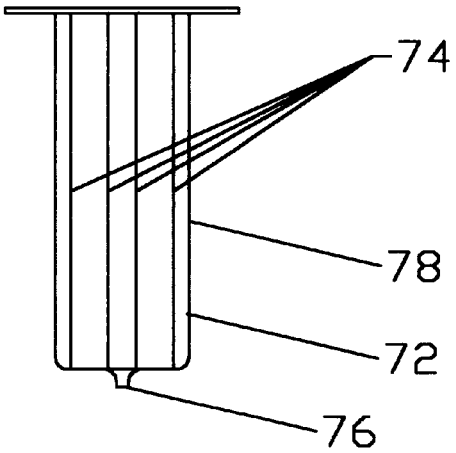
FIG. 24 is a side view of the heat exchange barrier.

FIG. 23 and FIG. 24 show additional features of heat exchange barrier 72 that could be used to improve its performance. FIG. 23 is a top view of heat exchange barrier 72 showing the profile of the walls of the heat exchange barrier 72. As can be seen in FIG. 23, the walls of the heat exchange barrier 72 have a number of convolutions 74. The purpose of these convolutions 74 is to increase the heat transfer surface area of the heat exchange barrier 72. These convolutions 74 also provide structural support to seal 30 that is attached to the top of heat exchange barrier 72. This support will help seal 30 withstand the pressure it is under due to the weight of beverage 36 and the gas pressure that beverage 36 may create inside the beverage compartment 12 (for example due to carbonation).

FIG. 24 is a side view of heat exchange barrier 72. In this view convolutions 74 can be seen as well as a protrusion 76 at the bottom of heat exchange barrier 72. Protrusion 76 allows any force applied to the top of heat exchange barrier 72 or seal 30 to be transmitted through the heat exchange barrier 72 and onto the bottom of container 70. The protrusion 76 does this while still allowing melt water 48 to flow underneath heat exchange barrier 72, maximizing the amount of surface area available for heat transfer.

Figure 25:
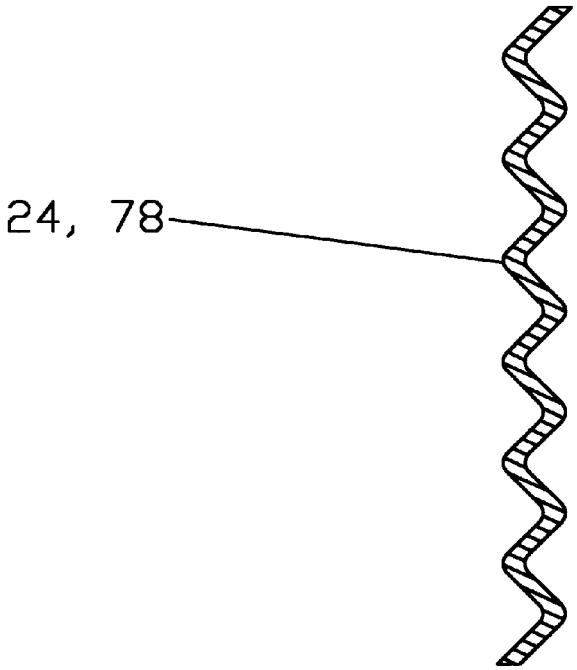
FIG. 25 is a close-up cross-section of the wall of heat exchange barrier or the ice compartment, showing ridges that could be used to withstand freezing-related expansion.

Because the walls 78 of the heat exchange barrier 72 will be exposed to the ice 44 while it is freezing, it is important that the walls 78 be able to accommodate and/or tolerate the associated expansion of the ice 44. This may be accomplished by having ridges molded into the walls 78 of the heat exchange barrier 72 such as those shown in FIG. 25. FIG. 25 is a close-up cross-section of part of the wall 78 of heat exchange barrier 72, showing ridges that could be used to tolerate freezing-related expansion. A similar ridge configuration could be used for the walls 24 of the ice compartment 14 to help it cope with the expansion of the ice 44.

Figure 26:
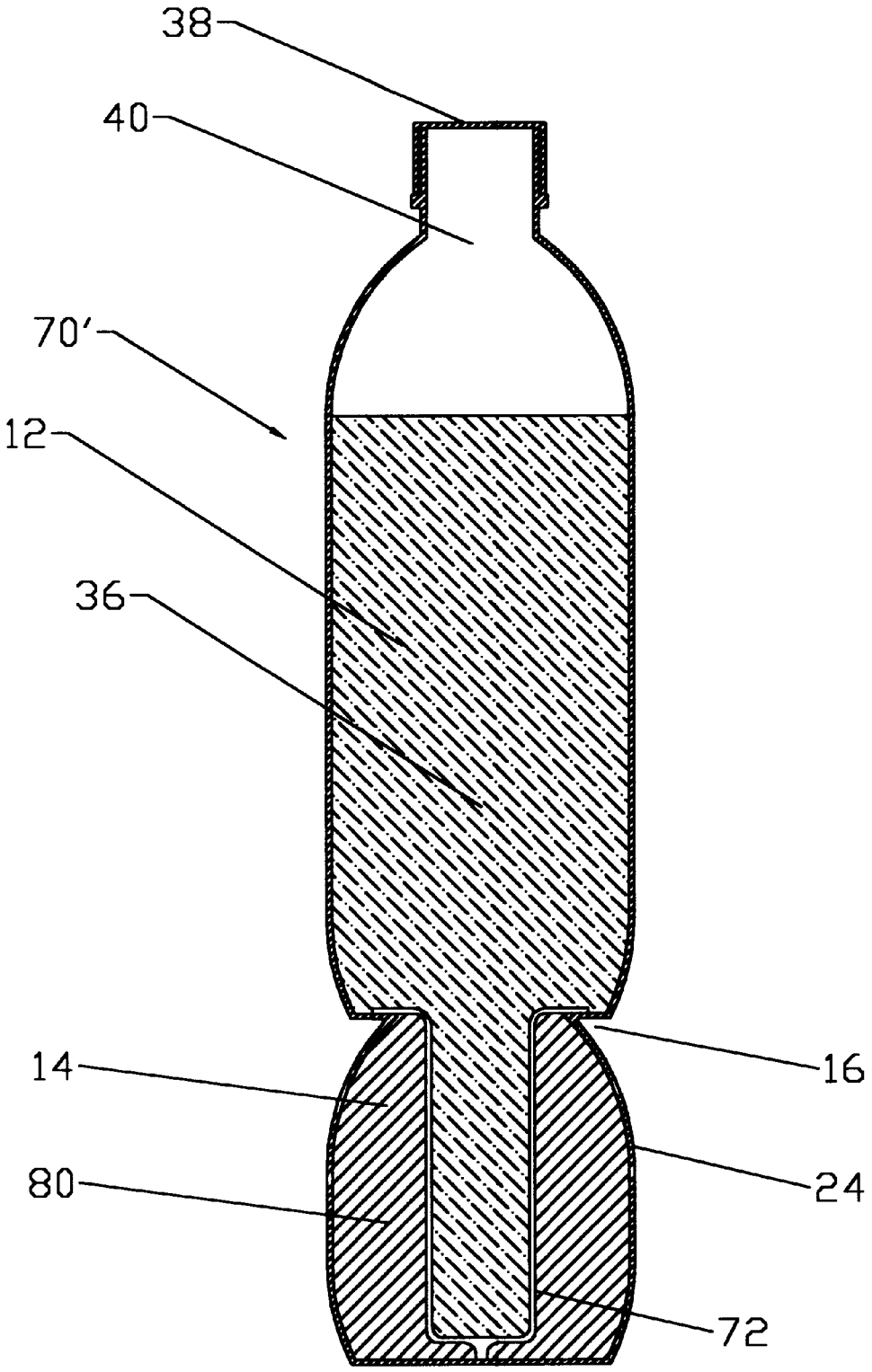
FIG. 26 is a vertical cross-section of the alternate embodiment of the beverage container in which the ice compartment has been filled with "Blue Ice".

Because the no-mix beverage container 70 described above does not allow the beverage 36 to come into contact with the ice 44, it would be possible to use refrigerating means other than ice in the ice compartment 14. FIG. 26 shows vertical cross-section of a container 70' with ice compartment 14 filled with reusable refrigerant known as "Blue Ice" 80 instead of ice 44. Container 70' would function like container 70 (which contains ice 44) except it would not need to be inverted for freezing.

Figure 27:
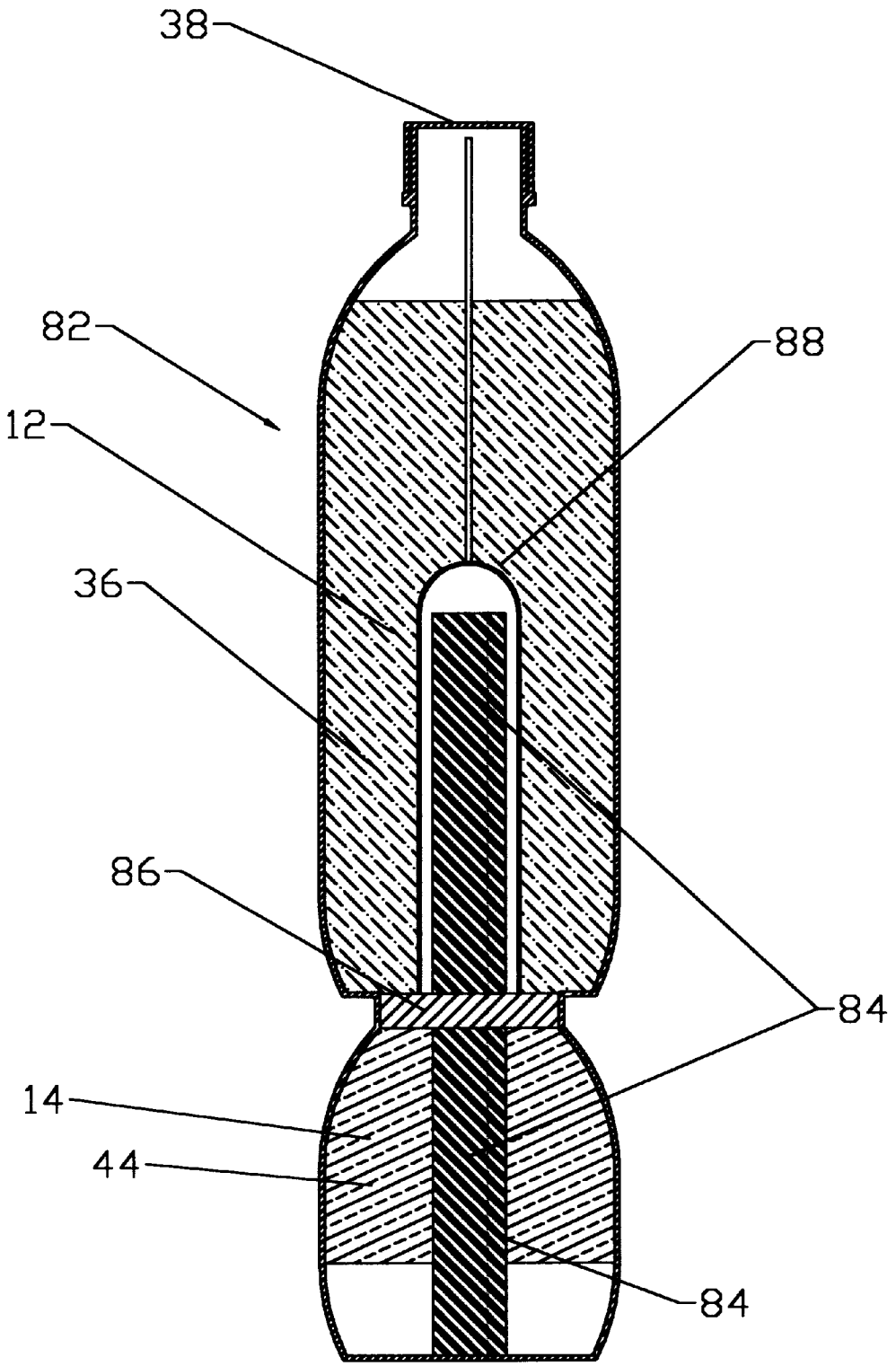
FIG. 27 is a vertical cross-section of a second alternate embodiment of the beverage container that has a heat exchange element to allow the ice to cool the beverage without the melt water mixing with the beverage.

FIG. 27 shows a vertical cross-section of an alternate embodiment of a no-mix container 82 in which the heat exchange element 84 is a conductive metal bar rather than a hollow tube as was illustrated in FIGS. 19–22. In this embodiment, the heat exchange element 84 would be mounted in a barrier 86 that would separate the beverage compartment 12 from the ice compartment 14. The portion of the heat exchange element 84 that was located within the beverage compartment 12 would be covered with a seal 88. Seal 88 would prevent the beverage 36 from contacting the surface of the heat exchange element 84 until seal 88 was removed by the consumer just prior to the consumption of beverage 36.

This alternate embodiment container 82 would work as follows: Ice 44 would be frozen inside ice compartment 14 while the container 82 was inverted. This would leave ice 44 located in the top portion of ice compartment 14. When removed from refrigeration, the ice 44 would begin to melt. However, since seal 88 would prevent heat from beverage 36 to be conducted into heat exchange element 84, the ice 44 would remain frozen to heat exchange element 84 and thus stay stuck (frozen) to it. This would suspend the ice 44 within the ice compartment 14 and allow it to melt more slowly as has previously been explained. To cool the beverage 36, the consumer would pull seal 88 out of container 82. This would allow beverage 36 to come into contact with the surface of heat exchange element 84, and allow heat to be conducted from the beverage 36, through the metal heat exchange element 84 by conduction, into the ice 44 and/or melt water in ice compartment 14, thus cooling the beverage 36.

Alternate Embodiments

The embodiments of the present invention described above reflect the preferred means of accomplishing the desired objectives. However, there are a number other alternate embodiments of the various components that could be substituted. For example, the seal 30 which separates the ice compartment 14 from the beverage compartment 12 has been described as being made from metal foil and attached using an adhesive. It would also be possible to make the seal out of any other suitable material (i.e., paper, plastic, metal or some combination thereof). Likewise, the seal could be accomplished with a rigid mechanical plug that is pulled out rather than a flexible seal that is peeled out. Or it could also be a frangible barrier that the consumer would break or rupture to initiate cooling. Alternatively, it could be an inflatable barrier that would be deflated by the consumer to initiate cooling.

Figure 28:
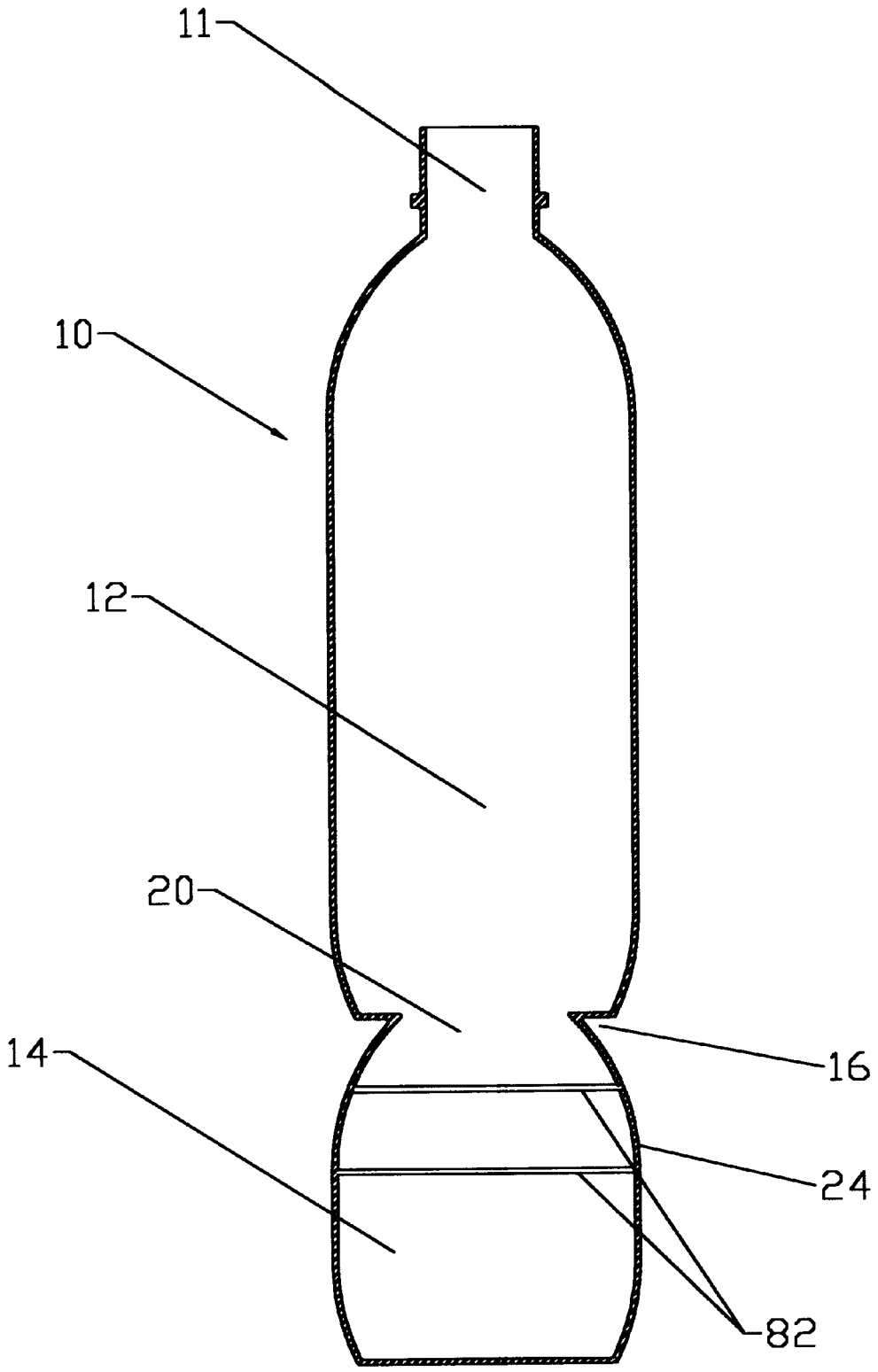
FIG. 28 is a vertical cross-section of an alternate embodiment of the beverage container in which the ice anchor in the ice compartment consists of plastic webs which have been molded in to the container.

The ice anchor 20 could also be accomplished in ways other than having it be a perforated sheet of plastic. Instead, it could be made of any suitable material (i.e., plastic, paper, metal, wood or some combination thereof) and could be of any number of configurations so long as it could be rigidly captured within the ice compartment 14 and it had either surface characteristics (e.g., roughness) or physical geometry that would allow it to hold the ice 44 out of contact with the warm walls 24 of the ice compartment 14 and the melt water 48 below. The ice anchoring means could also be built into the bottle wherein the walls 24 of ice compartment 14 included features that protruded into the ice compartment 14 so as to be able to prevent the ice 44 inside from moving around. For example, FIG. 28 shows a vertical cross-section of container 10 with two rods 92 that traverse ice compartment 14. These rods 92 provide a surface on which the ice 44 can attach itself. Each of these rods 92 would be a thin plastic "thread" that would be molded into the ice compartment 14 walls during the blow-molding process. The ice 44 would freeze around these rods 92 and would remain attached to them until the ice 44 was almost completely melted.

The configuration of the container itself could be different than has been shown. The container could be made of any suitable material (not just clear PETF,) and fabricated using any appropriate means (not just blow-molding). The ice compartment could be above or along side the beverage compartment. And the shapes and relative sizes of the ice compartment 14 and beverage compartment 12 could be whatever was desired. One desirable configuration will be for the ice compartment 14 to be larger in diameter than the beverage compartment 12. Having the ice compartment 14 larger would give additional stability to the bottle and it could be used to prevent the bottle from being inserted into the refrigeration equipment in the wrong orientation, as will be described.

The thermal barrier between the beverage compartment 12 and the ice compartment 14 could also be achieved in other ways. For example, rather than leaving an air gap either in the beverage compartment 12 or the ice compartment 14, it would also be possible to make the seal 30 from a thermally insulating material. Such an insulating seal 30 could also provide the thermal barrier needed so that the ice 44 could be frozen without also freezing some of the beverage 36. however, if the seal 30 were made of a thermally insulating material and the water 28 was frozen while it was in contact with the seal 30, it is possible that the seal 30 would stick to the ice 44 and thus make it difficult for the consumer to remove the seal 30.

The ice 44 itself could be replaced with a different consumable frozen material, for example ice cream. By filling ice compartment 14 with ice cream, attaching the seal 30, then filling the beverage compartment 12 with a compatible beverage such as root beer, it would be possible to sell pre-packaged "floats", in this example a root beer float. To keep the ice cream from degrading due to melting and re-freezing, it would be necessary to keep the container refrigerated all the time, with the ice compartment 14 continuously exposed to temperatures suitable for ice cream and the beverage compartment continuously exposed to temperatures above freezing. For the consumer to enjoy the "float", he or she would simply remove the cap 38, then pull out the seal 30. This would allow the ice cream and beverage to mix, creating the desired beverage treat. An ice anchoring means would not be useful when the container was used for this purpose except possibly to provide structural support for seal 30. Other beverages beside root beer and other frozen materials besides ice cream could also be combined in this manner.

The contents of the two compartments of the container need not be limited to a liquid and a frozen material. Instead, they could be any two mixable constituents (e.g., two beverages, or a beverage and a powder, a beverage and a dissolvable solid, etc.) which must not be mixed until just prior to consumption (or other use). For example, if it were desired to create a beverage combining a milk product and a juice product (e.g., milk and lemon juice), the two compartment container 10 could be used to hold the two components separate until just prior to consumption. This would prevent the curdling that would occur if the milk and the juice were combined sooner.

Separate Ice Container

Figure 29:
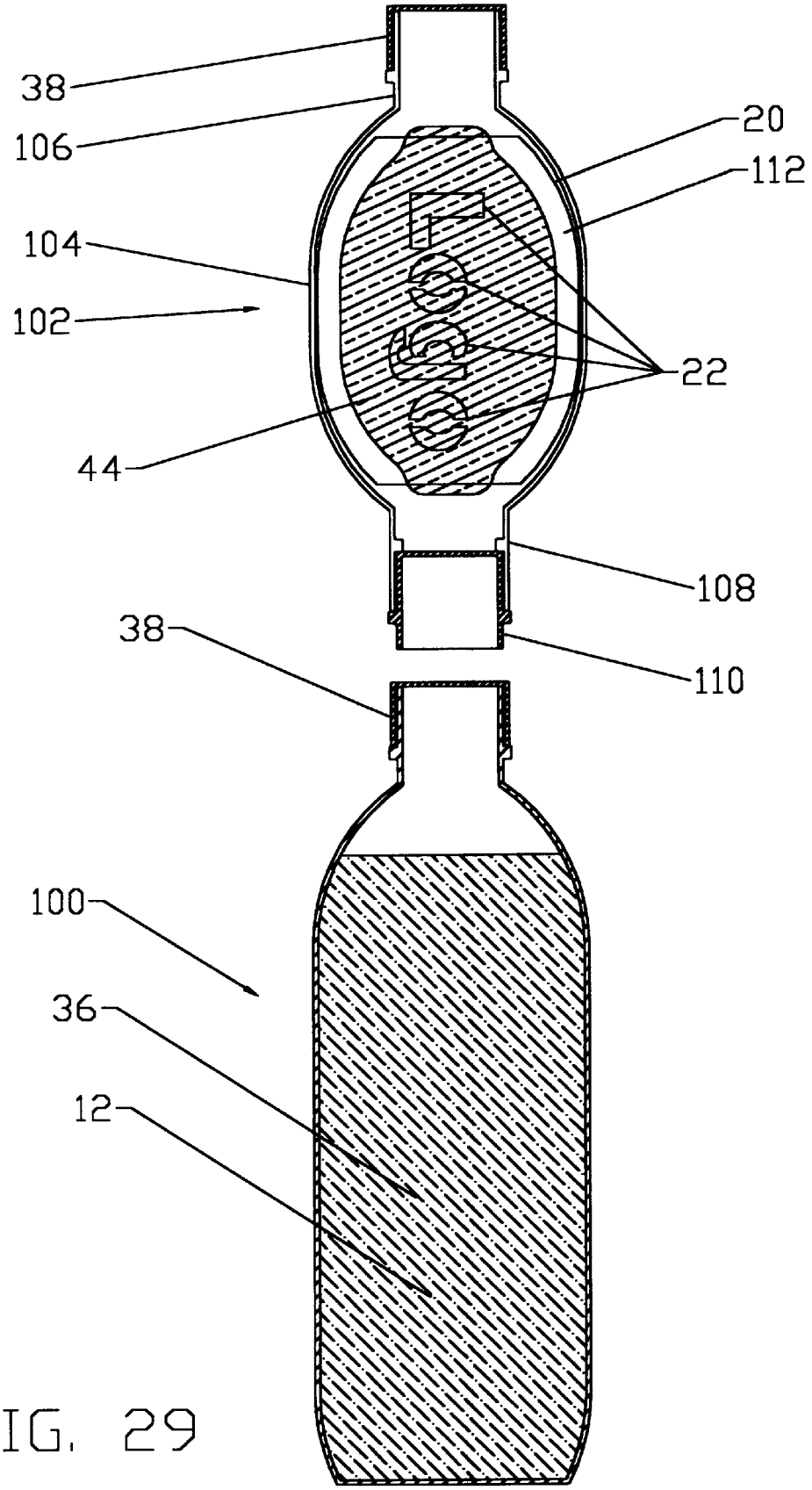
FIG. 29 is a vertical cross-section of a beverage container and a separate ice container before attaching the two together.
Figure 30:
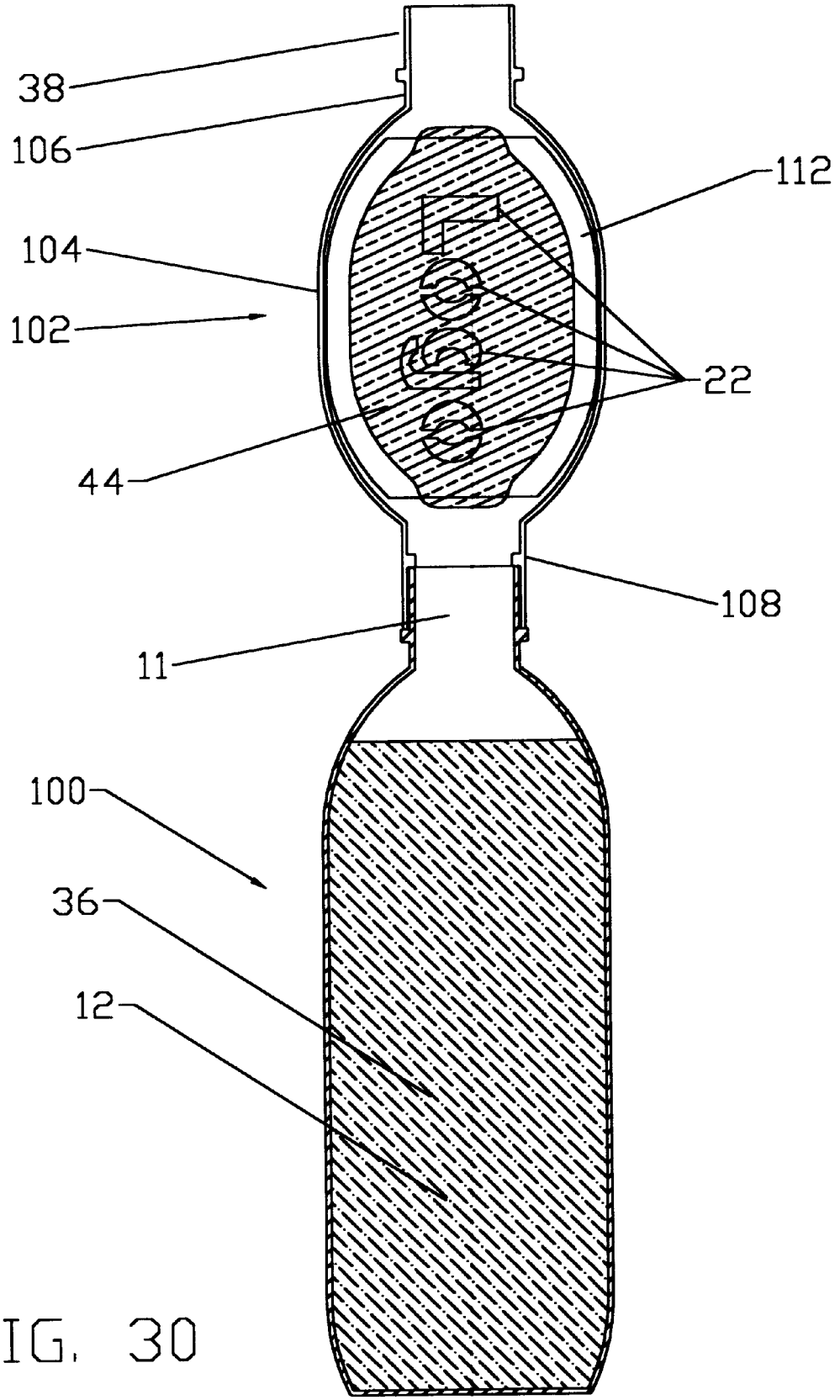
FIG. 30 is a vertical cross-section of a beverage container and a separate ice container after the two have been attached to each other.

An extreme alternate embodiment of the container itself would be for the ice compartment to be a separate container altogether. FIG. 29 and FIG. 30 illustrate this configuration. FIG. 29 is a vertical cross-section of a beverage container 100 and a separate ice container 102. Beverage container 100 is a conventional beverage container having one main beverage compartment 12 containing beverage 36. It has a mouth 11 and a cap 38. The ice container 102 consists of an ice compartment 104, a top opening 106, a cap 38, a bottom opening 108, and a bottom plug 110. Bottom opening 108 would have internal threading so that it could be screwed onto the beverage container 100.

Ice container 102 could contain an ice anchor 20 having perforation 22, or some other ice anchoring means, as has been described earlier. The ice anchor 20 would slow the melting of the ice 44 by suspending the ice within ice compartment 104, keeping it from touching the warm walls of the ice container 102. The ice anchor 20 would also keep the ice 44 inside from floating around and potentially plugging either the top opening 106 or the bottom opening 108 of the ice container 102.

To use ice container 102, the consumer would either buy it filled and already frozen from a store, or, if he had an empty one at home, he could fill it and freeze it at himself. When bought from a store, the ice container 102 would come frozen, already filled with ice 44. A gap 112 between ice 44 and the container walls would already exist. To use it, the consumer would remove cap 38 from the beverage container 100 and bottom plug 110 from the ice container 102. He would then screw the ice container 102 onto the beverage container 100. By removing cap 38 from ice container 102, the consumer would be able to drink the beverage 36 through ice container 102 by tipping up the assembled containers and letting the beverage flow around the ice 44 to cool it before it left through top mouth 106. When the containers were upright in this connected configuration, as illustrated in FIG. 30, the ice would again be suspended within ice container 102, slowing the melting. Any melt water would drain into beverage container 100, allowing the ice 44 to stay well insulated by air gap 112.

To get the ice container 102 configured in the store as shown in FIG. 29, the ice container 102 would be filled with water and then frozen. To create gap 112, the ice container would be allowed to warm up so that the ice in contact with the walls of the container could be melted. Submerging the ice container 102 in a warm fluid (e.g., water) could accelerate this process. Any melt water in the ice container 102 would then be drained out, and the container would be capped. This process would create gap 112. Gap 112 is needed so that the beverage can flow through ice container 102. The resulting ice container 102 would of course need to be stored in a freezer.

If the ice container were used at home, the user would simply fill the ice container 102 with water and put it into the freezer overnight to freeze it. If it were going to be used immediately after taking it out of the freezer, the consumer would need to run the ice container 102 under warm water for a minute to create gap 112. If he wasn't going to use it right away, he could simply let gap 112 occur naturally (by melting) as the ice container 102 warmed up.

This approach of having a separate ice container 102 has advantages and disadvantages when compared with the preferred all-in-one embodiment. The advantages are: 1.) The ice container could be kept in the freezer—no need for dual-temperature refrigeration, thus it would be ideal for home use, 2.) Any melt water in the ice container could be drained prior to attaching it to a beverage container, limiting dilution of the beverage, 3.) The ice container would be reusable and could be used with virtually any brand or size of beverage container.

The disadvantages of the separate ice container are: 1.) It requires a separate container and two additional caps—thus it would be more expensive, 2.) The ice container would either have to have a one-size-fits-all bottom opening 108 or it would need to be sold with an array of adapters in order for it to fit more than one size or brand of beverage container, 3.) Since existing beverage containers are not designed for use with an ice container, it is likely that when assembled, with the heavy ice container on top, the combination would be unstable and prone to tipping over, 4.) When used with freshly opened carbonated beverages, there could be excessive foaming when tipped-up for drinking. This could cause beverage and foam to be forced into the consumer's mouth, resulting in an unpleasant and messy situation. However, this would only occur with carbonated beverages, not bottled water or lightly carbonated sports drinks.

Melting Upright

There is an alternate method for freezing the container in addition to the preferred "inverted" method described above.

Figure 31:
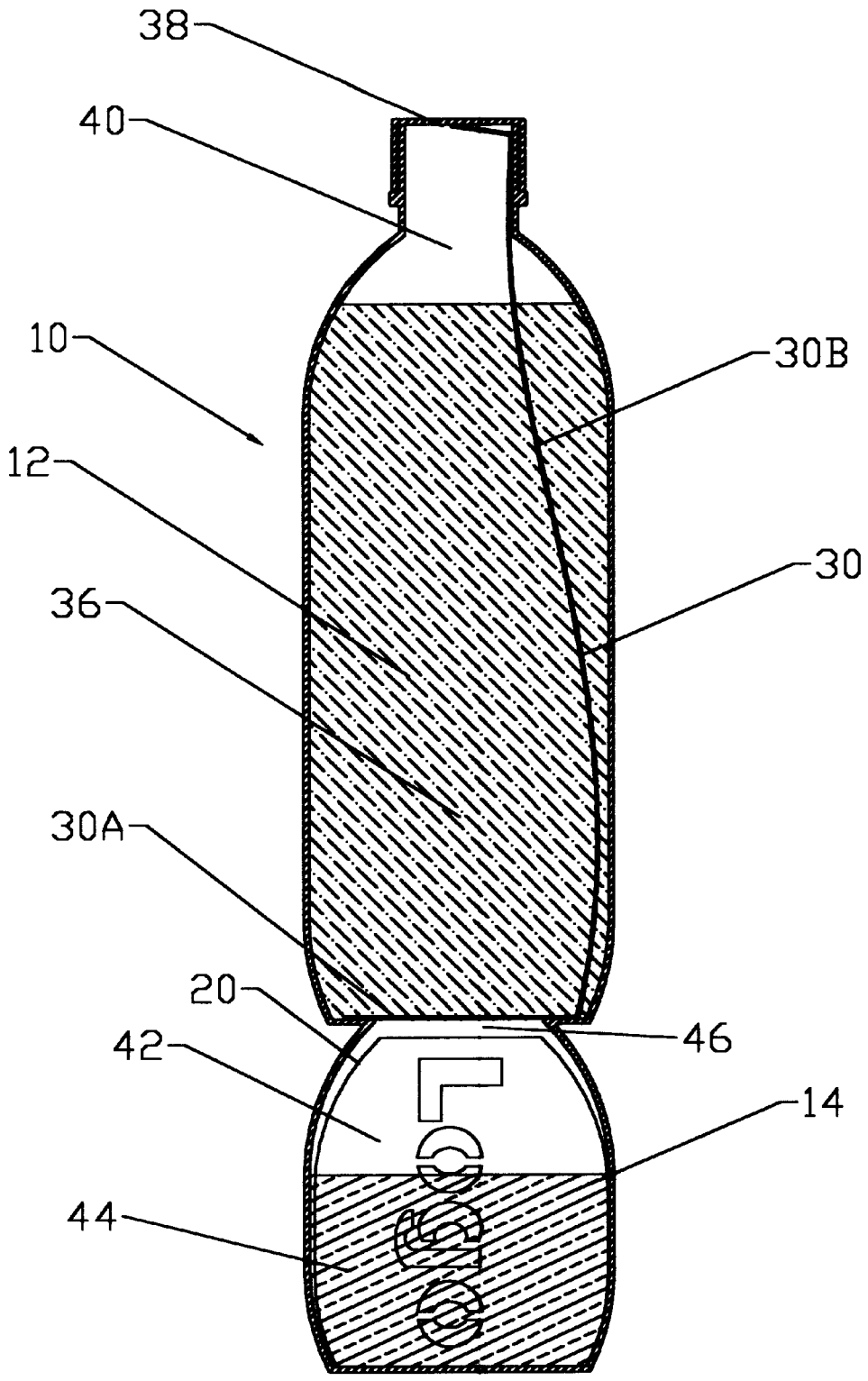
FIG. 31 is a vertical cross-section of the beverage container wherein the ice was frozen while the container was upright.

It would also be possible to freeze the preferred embodiment of the container while it is upright. FIG. 31 shows a vertical cross-section of container 10 with the ice 44 frozen when the container 10 was upright, with the ice 44 being located at the bottom of ice compartment 14. However, there are two main drawbacks to the upright freezing method that make it inferior to the preferred inverted method. First, while the upright freezing method could also allow slow-melting feature to work, achieving the slow melting would require that the container be inverted during melting. This would be necessary to have the ice 44 above ice compartment air gap 42 so that the melt water 48 could properly drain away from the ice 44. Inverting the container during melting will be non-obvious for the consumer and may be difficult because it would involve balancing the container upside-down on its cap 38. The second drawback to this method of freezing occurs when used with carbonated beverages and sub-cooled ice (i.e., ice cooled below 32° F.). When seal 30 is opened, the beverage 36 will rush down into the ice compartment 14 very quickly. Testing has shown that the resulting agitation of the of the beverage and immediate exposure of the beverage 36 to a large area of sub-cooled ice 44 results in severe foaming of the carbonated beverage 36 which will cause the container 10 to overflow. This problem of course does not occur with non-carbonated or lightly carbonated beverages.

Other Applications of the Technology

The ice anchoring, slow-melting concepts described herein have applications beyond a self-cooling beverage container designed for the retail sale of beverages. For example, this concept could be used in recreational water bottles (e.g., hiking, bicycling, etc.), insulated mugs, insulated thermos bottles, coolers or portable medicine coolers, to name a few.

The basic slow-melting concept works as follows: Ice, or some other phase-change material, is suspended within a container such that it is not in contact with the container walls, the melt water, or any other conductive material within the container (e.g., a beverage). A space is provided within the container for the melt water to run into. By suspending the ice in this way, the ice remains surrounded by an insulating air gap, thereby greatly reducing the melt rate of the ice.

Some type of ice-anchoring device would be used to suspend the ice within the container. The ice-anchoring device can be any thermally non-conductive structure that has a surface or physical geometry that will allow it to suspend the ice. The ice itself can be produced by freezing water inside the container, or the ice can be frozen outside the container and then mounted inside the container after it is frozen. If the ice is frozen inside the container, the container can be inverted to get the ice to the top of the container and/or above the drainage gap.

Recreational Water Bottle #1

Figure 32:
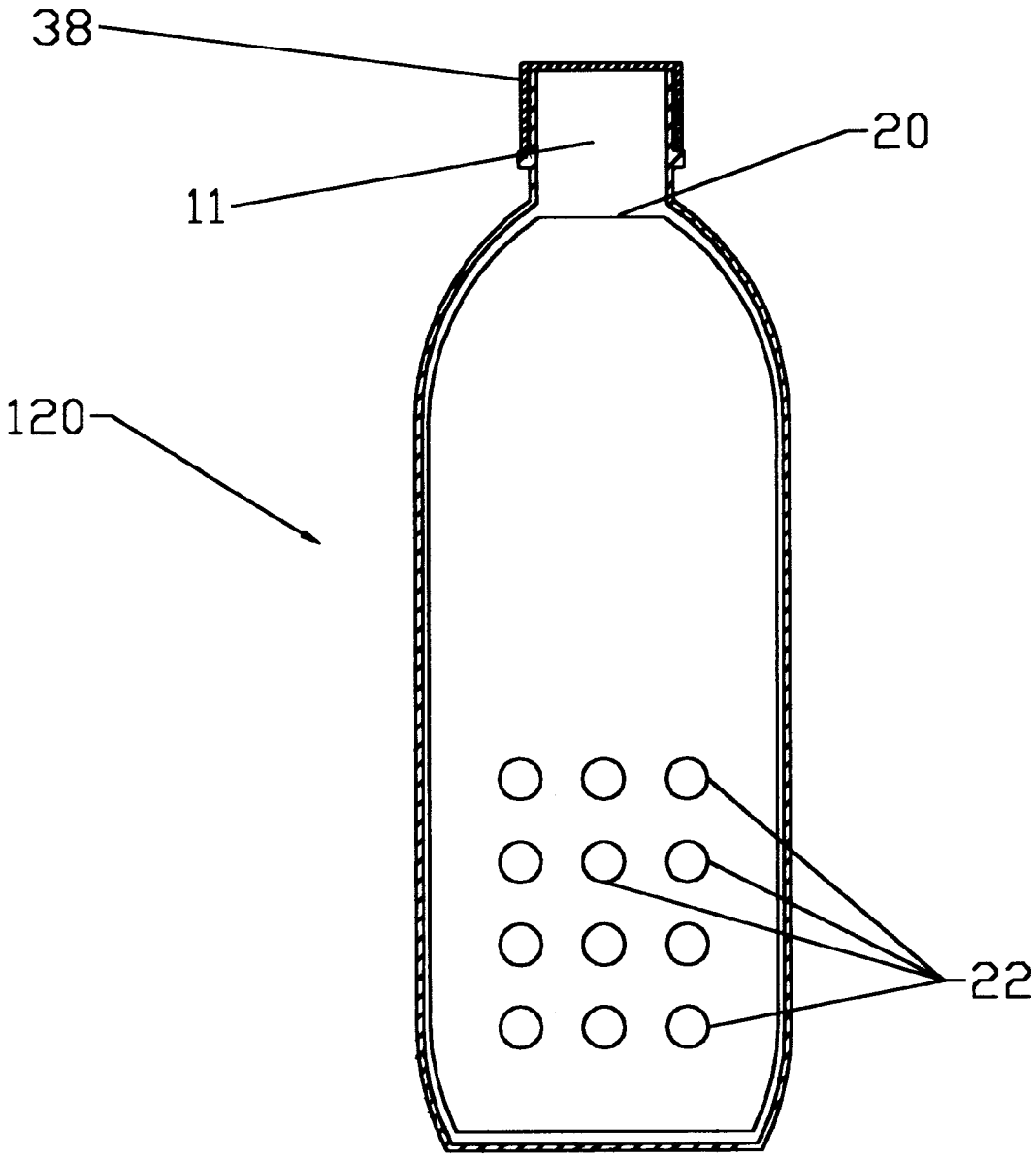
FIG. 32 is a vertical cross-section of a conventional plastic water bottle into which has been inserted an ice anchoring device.

For example, a recreational water bottle (for hiking, bicycling, etc.) with an ice anchor would allow a person to bring along a beverage that would stay cold for hours, without the need to lug a large thermos or insulated bottle. In its simplest form, such a water bottle might look like bottle 120 illustrated in FIG. 32. FIG. 32 shows a vertical cross-section of a conventional plastic water bottle 120 into which has been inserted an ice-anchoring device 20. This anchoring device 20 would be a perforated sheet of plastic film that was rolled-up in order to fit through the mouth 11 of the bottle, and which would subsequently unroll once inside the bottle 120.

Figure 33:
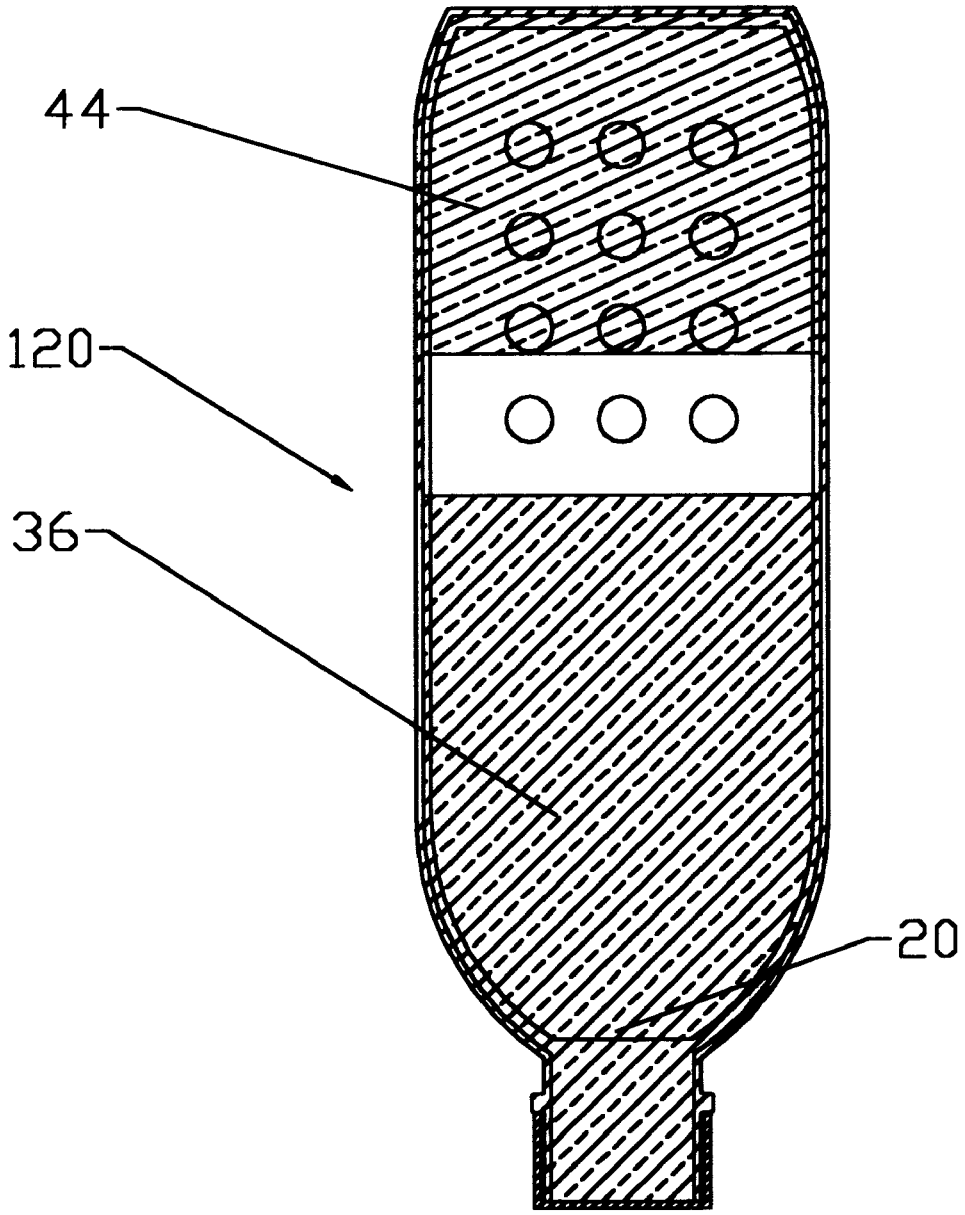
FIG. 33 is a vertical cross-section of a conventional plastic water bottle having an ice anchor after the ice has been frozen inside the bottle, the bottle filled with a beverage, and then the bottle has been inverted for slow melting.

To use the bottle, the user would first fill the bottle 120 about ⅓ full of water, then put the bottle 120, right side up, into the freezer until the water was completely frozen (typically overnight). Because the ice anchor 20 would be submerged in the water when it was frozen, the ice would freeze onto the ice anchor 20 and its perforations 22. On the day that it was to be used, the user would remove the bottle 120 from the freezer, fill the remaining volume of the bottle 120 with water (or any other beverage) and then invert the bottle 120. FIG. 33 illustrates bottle 120 after the ice 44 has been frozen, the bottle 120 filled with a beverage 36, and then inverted. Inverting the bottle would put the ice at the top of the bottle 120, enabling the slow-melting feature. Having the ice suspended in this way will allow the contents of the bottle 120 to remain cold two to three times as long as a bottle that was completely filled with water and frozen solid.

Recreational Water Bottle #2

Figure 34:
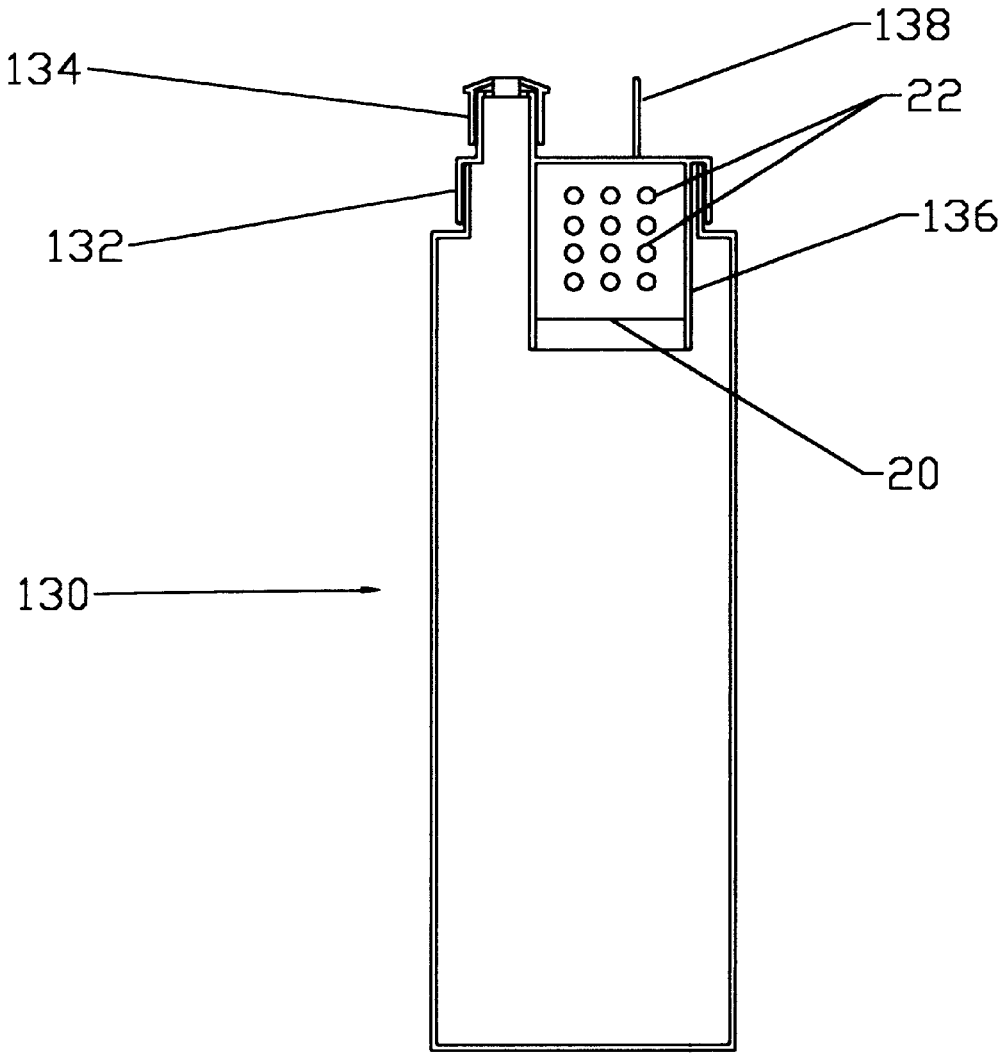
FIG. 34 is a vertical cross-section of a water bottle in which ice is anchored to the cap of the bottle.
Figure 35:
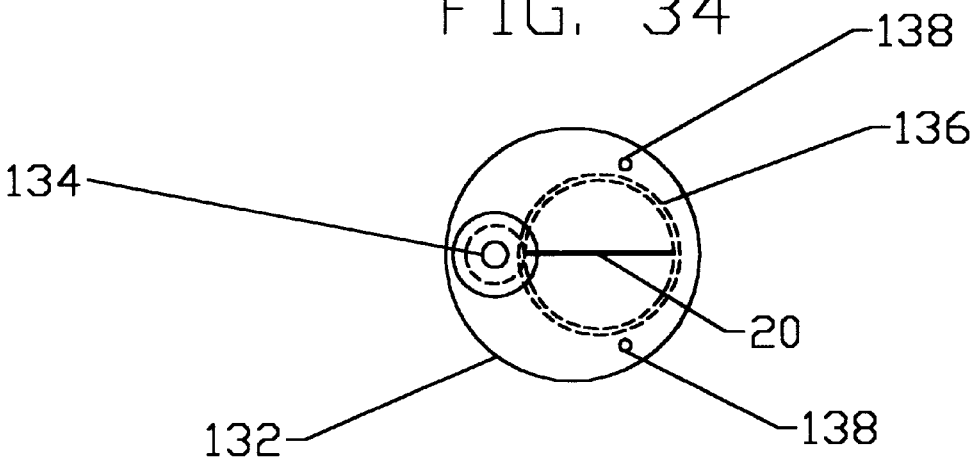
FIG. 35 is a top view of the cap for the water bottle to which the ice is anchored.

An alternate embodiment of a recreational water bottle could be accomplished by having the ice anchored to the cap of the bottle, rather than at the bottom of the bottle. FIG. 34 is a vertical cross-section of such a bottle. FIG. 34 shows a sports-type water bottle 130 that is very similar to a conventional sports water bottle. It has a cap 132 with a spout 134. Cap 132 however is specially configured to hold ice, having an inverted ice cup 136 on its bottom side that in turn contains ice anchor 20 with perforations 22. The spout 134 of cap 132 is offset from the center of the cap so that it is not coaxial with the ice cup 136. A top view of cap 132 is illustrated in FIG. 35, illustrating the relative positions of the spout 134 and the ice cup 136. There are also two pins 138 located on the top of cap 132 to allow the cap 132 to balance in an inverted position, as will be shown.

Figure 36:
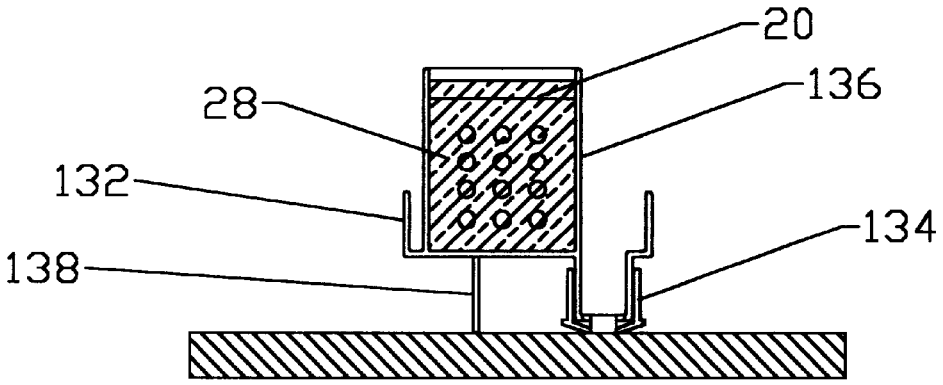
FIG. 36 is a vertical cross-section of the cap for the water bottle as ice is being frozen into it.
Figure 37:
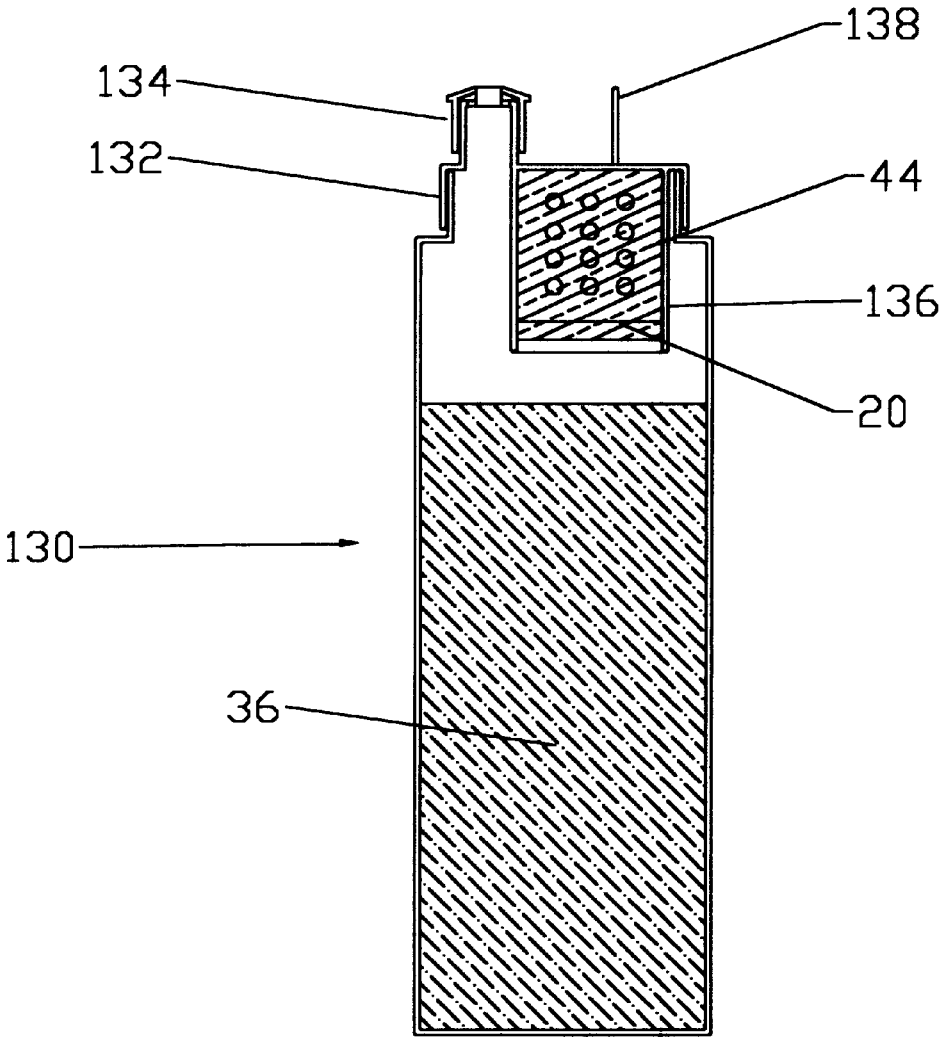
FIG. 37 is a vertical cross-section of a water bottle in which ice is anchored to the cap of the bottle, showing ice and a beverage in the bottle.

To use the bottle 130, one would first remove cap 132, invert it (so the ice cup 136 is facing up) and then fill the ice cup 136 with water 28. The cap 132 would then be placed in a freezer so that water 28 would freeze into ice 44. In the freezer, the cap 132 would rest on the spout 134 and the two pins 138 in a tripod-like manner, as shown in FIG. 36. Once the water 28 in cap 132 had frozen, bottle 130 would be filled with a beverage 36 (e.g., water) and cap 132 would be screwed onto it. This is shown in FIG. 37. It is important that bottle 130 be filled with beverage 36 to a level that is below the bottom of ice cup 136, to leave a gap for the ice 44 to melt into.

If left upright, the ice 44 would melt away from the walls of the ice cup 136 but remain attached to ice anchor 20. This would allow the ice 44 to remain suspended and surrounded by an insulating layer of air, thereby greatly reducing the rate of melting of ice 44. To cool beverage 36 for drinking, one could either invert the bottle 130 thereby submerging ice 44 in beverage 36, or one could shake the bottle 130 to cause beverage 36 and ice 44 to mix.

High-performance Thermos Bottle for Cold Beverages

Figure 38:
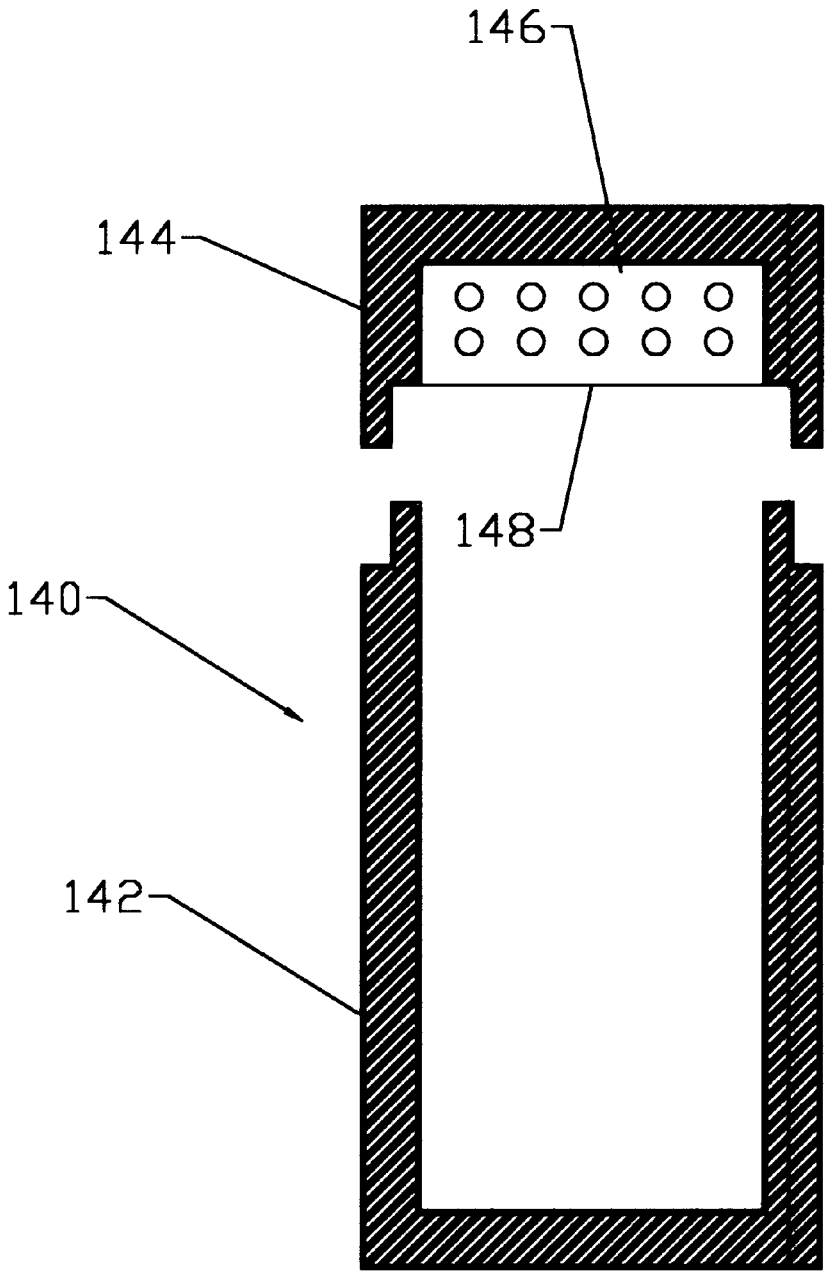
FIG. 38 is a vertical cross-section of an insulated jug or thermos bottle designed to utilize the slow-melting invention.

FIG. 38 is a vertical cross-section of an insulated jug or thermos bottle 140 designed to utilize the slow-melting invention described herein. It consists of an insulated container 142, an insulated lid 144 that includes a cup 146 for ice. Cup 146 has an ice anchor 148 inside it.

To use the thermos bottle 140, the user removes the lid 144 from the container 142, turns the lid 144 over so the cup 146 is facing up, and then fills the cup 146 with water. The cup 146 is then placed in a freezer (typically overnight) to freeze the water completely into ice 44. The water that freezes in the cup 146 will freeze securely onto the ice anchor 148. Once the ice 44 in cup 146 has been frozen, the insulated container 142 can be filled with a beverage and the lid 144, with the ice attached, can be screwed back on to it.

Figure 39:
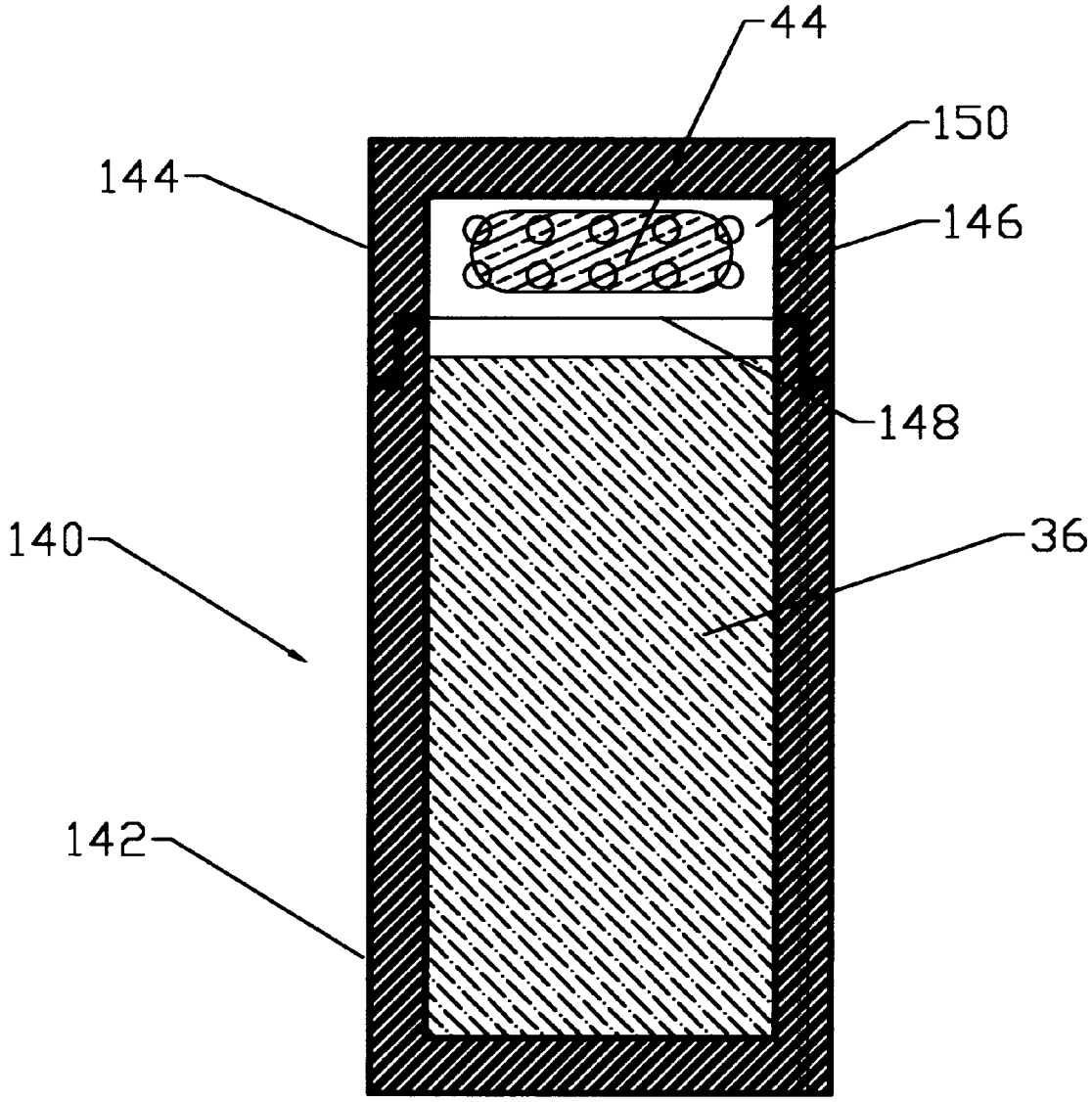
FIG. 39 is a vertical cross-section of an insulated jug or thermos bottle having an ice anchor after ice has been frozen into it and it has been filled with a beverage.

FIG. 39 shows insulated thermos bottle 140 after ice 44 has started to melt. As can be seen in FIG. 39, the ice 44 is attached to the ice anchor 148 and has started to melt. Ice 44 has melted out of gap 150 and the resulting melt water has drained into the beverage 36. The gap 150 between the ice 44 and the cup 146 now functions as an insulating barrier between the ice 44 and its warm surroundings (i.e., the cup 146 and the beverage 36), allowing the ice to melt much more slowly that it would otherwise. To retain this reduced melt rate, the thermos bottle 140 must be kept upright. To cool the beverage 36 prior to its consumption, the thermos could either be turned upside down, or it could be shaken or tipped back and forth to thoroughly mix the beverage 36 and the ice 44.

The melting of the ice 44 in thermos bottle 140 is so greatly reduced from that of a standard type thermos container that it will now be possible to either keep beverages colder for a much longer time, or the thickness of the insulation of the thermos bottle 140 could be reduced. Using this slow-melting effect to reduce the container's thickness would have the advantage of also reducing its cost, weight and bulkiness, making it much more desirable than a traditional thermos bottle (although it would only work for cold beverages, not hot ones).

Dual-Temperature Refrigerating Equipment

In order to freeze and store the preferred embodiment of the invention, special equipment is needed to expose the ice compartment 14 of the beverage container 10 to sub-freezing temperatures while simultaneously exposing the beverage compartment 12 to temperatures above freezing. The equipment needed to do that will now be described in detail.

Heated Insulated Box

The simplest apparatus for providing the dual temperature environment for beverage container 10 is to use an insulated, internally heated box placed inside a freezer. Such a box is illustrated in cross-section in FIG. 40. Heated, insulated box 160 would surround the beverage compartment 12 of the container, keeping that part of the container warm (above freezing). The ice compartment 14 of the container, however, would protrude out the top of the box and into the surrounding below-freezing temperature environment. There would be a heat source 170 inside the box to keep the beverage compartment 12 above freezing temperatures while the ice compartment 14 would see the sub-freezing temperatures of the freezer.

The box 160 would, in its most basic form, have four sides 162, a bottom 164 and a top 166 having an opening 168 to permit the ice compartment 14 of the beverage container 10 to protrude outside the box 160. The box walls should be insulated or thermally non-conductive, although this is not a necessity. The box 160 must have a heat source 170 inside it to keep it warm. This heat source is preferably an electrical resistance type heater. Although it is a simple matter to control an electrical resistance heater with a thermostat 172, this may not be cost-effective since the amount of power required to keep a well-insulated box warm inside a freezer is small. It may be more practical to design the heater to be turned-on continually, thus eliminating the cost of a thermostat 172.

Figure 40:
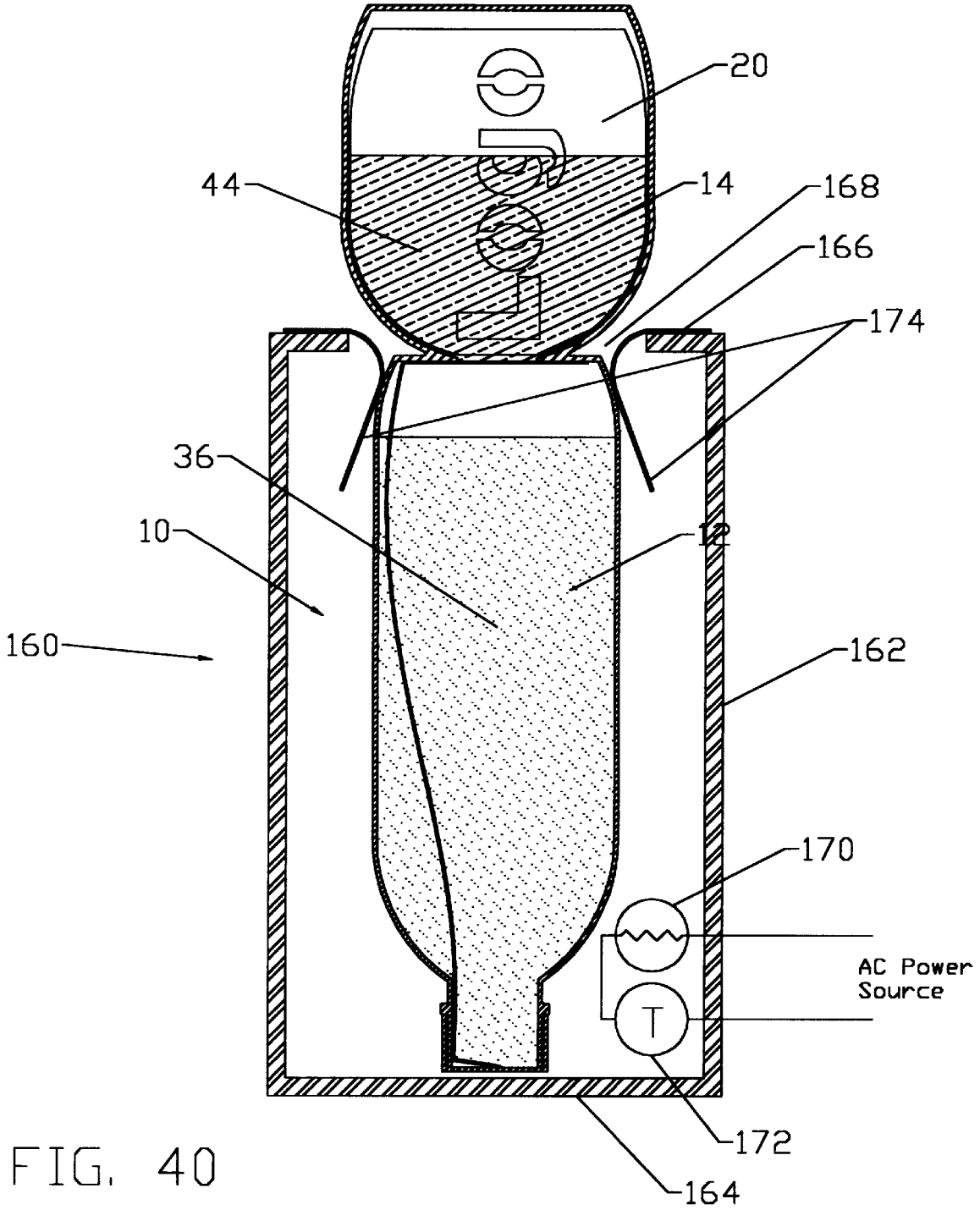
FIG. 40 is a vertical cross-section of the preferred embodiment of the beverage container located inside a heated box. This heated box is used to create a dual-temperature environment inside a freezer.

The preferred heat source 170 for box 160 is a small-wattage light bulb. Using a light bulb as the heat source 170 has several inherent advantages. Light bulbs are: 1.) Inexpensive, 2.) Readily available, 3.) Easily replaced, 4.) Safe, 5.) Will shine through the beverage container 10, drawing customer's attention to it, and 6.) Give a visual indication of failure. Having one or more light bulbs inside box 160 would keep the inside of the box warm, draw attention to the box and thereby promote sales, and let the store personnel know if the heat had somehow been turned off. Loss of heat is undesirable in that it would result in the beverage 36 in beverage container 10 freezing solid. Using a light bulb as the heat source 170 would negate the use of a thermostat 172, since it would be desirable to have the lights on all the time The ice compartment 14 of beverage container 10 shown in FIG. 40 is wider than beverage compartment 12, and also slightly larger than opening 168. This configuration prevents anyone from inserting the beverage container 10 into box 160 in the wrong orientation (i.e., right-side-up when its supposed to be upside down), since only the beverage compartment 12 will fit through opening 168. Sizing the beverage container 10 and the opening 168 in this manner is important in that it prevents store personnel and/or customers from putting the beverage container 10 into box 160 in a way that would result in the beverage 36 freezing instead of the ice 44.

Also shown in FIG. 40 is a compliant barrier 174. This compliant barrier 174 is intended to seal any gap between beverage container 10 and opening 168 so that the warmer air inside box 160 does not escape unnecessarily into the surrounding freezer. This feature is important if box 160 is constructed to hold more than one beverage container 10, and not all the containers are in the box 160. In that situation, the compliant barrier 174 will seal the hole left by the missing container(s), making it easier for the heat source 170 to keep the inside of the box warm. Compliant barrier 174 could be constructed from flexible plastic, brush bristles or any other flexible material that would prevent the unwanted flow of air from box 160.

Figure 41:
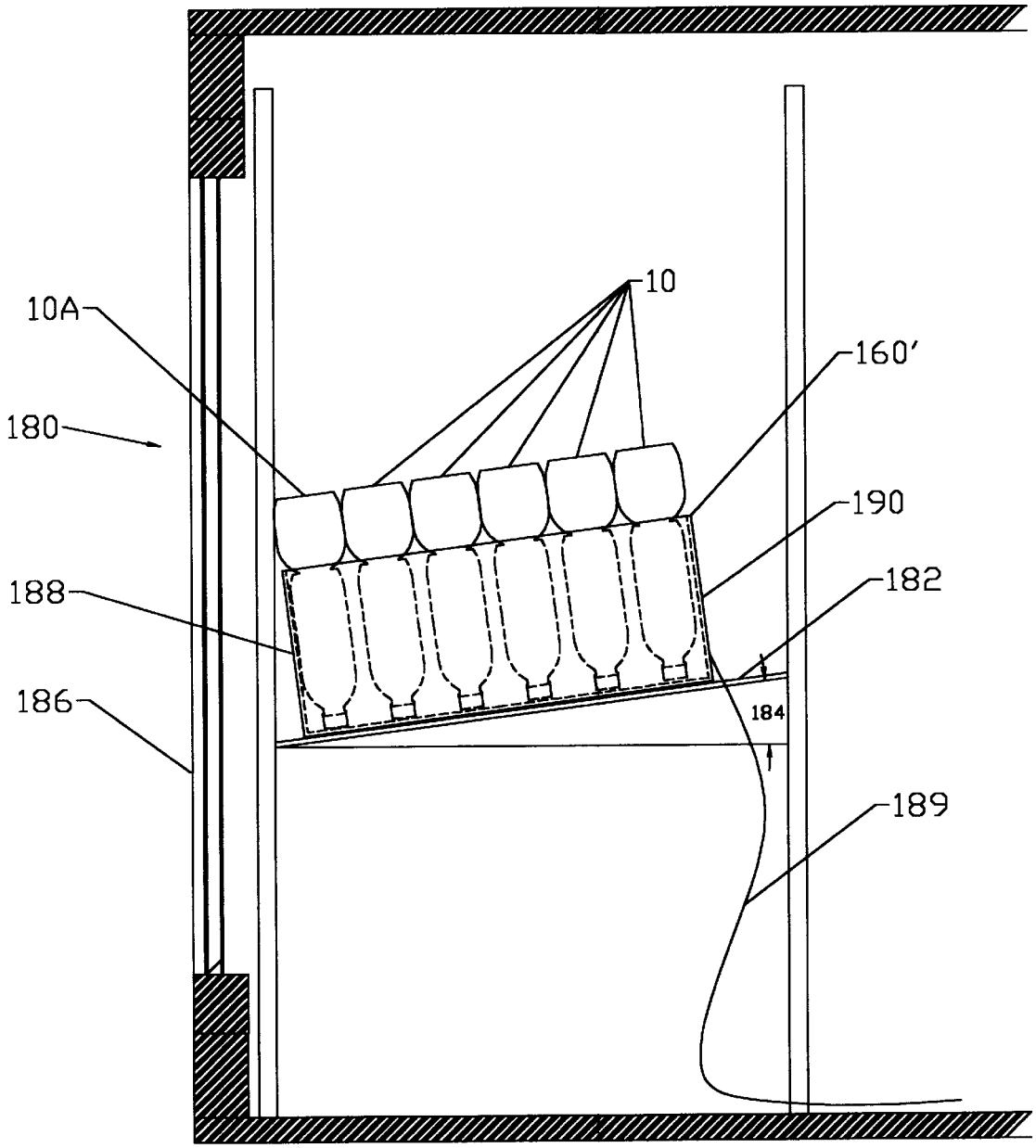
FIG. 41 is a vertical cross-section of a heated box holding six beverage containers within a walk-in freezer so that a dual temperature environment is provided for the containers.

FIG. 41 shows a box 160' holding six beverage containers 10 within a walk-in freezer 180. Box 160' is shown sitting on a display rack 182 tipped at angle 184 behind display door 186 in freezer 180 as it might be positioned in a convenience store. A front wall 188 of box 160' would face the display door 186, and would be the portion of box 160' visible to customers in the convenience store. A back wall 190 of box 160' would face the inside of the walk-in freezer 180. A customer picking up one of the beverage containers would pull out the first container 10A from the front of the box 160'. Because of the angle 184 of the box 160', the remaining bottles would then slide forward to the front of the box 160'. Compliant barrier 174 (not shown in FIG. 41) would seal the opening 168 in the top of the box 160' left by the removal of the container 10A. Front wall 188 of box 160' may consist of a translucent plastic panel having advertising on it and being back-lit by the light bulbs in box 160' that are acting as the heat source 170 (not shown in FIG. 41) within the box. Electrical power for heat source 170 (not shown in FIG. 41) would be provided through cord 189.

Freezing Channel

Another apparatus that could be used to provide the dual-temperature environment for the preferred embodiment of the invention is a refrigerated channel that would surround the ice compartment 14 of the beverage container 10. This refrigerated channel would be located within a refrigerated enclosure (e.g., a walk-in or reach-in type refrigerator) and would provide the additional cooling needed to keep the ice in beverage container 10 frozen. The source of cooling for the refrigerated channel could be the same one used for the refrigerator, or in the case of a retrofit application, could be an additional, second refrigeration system.

Figure 42:
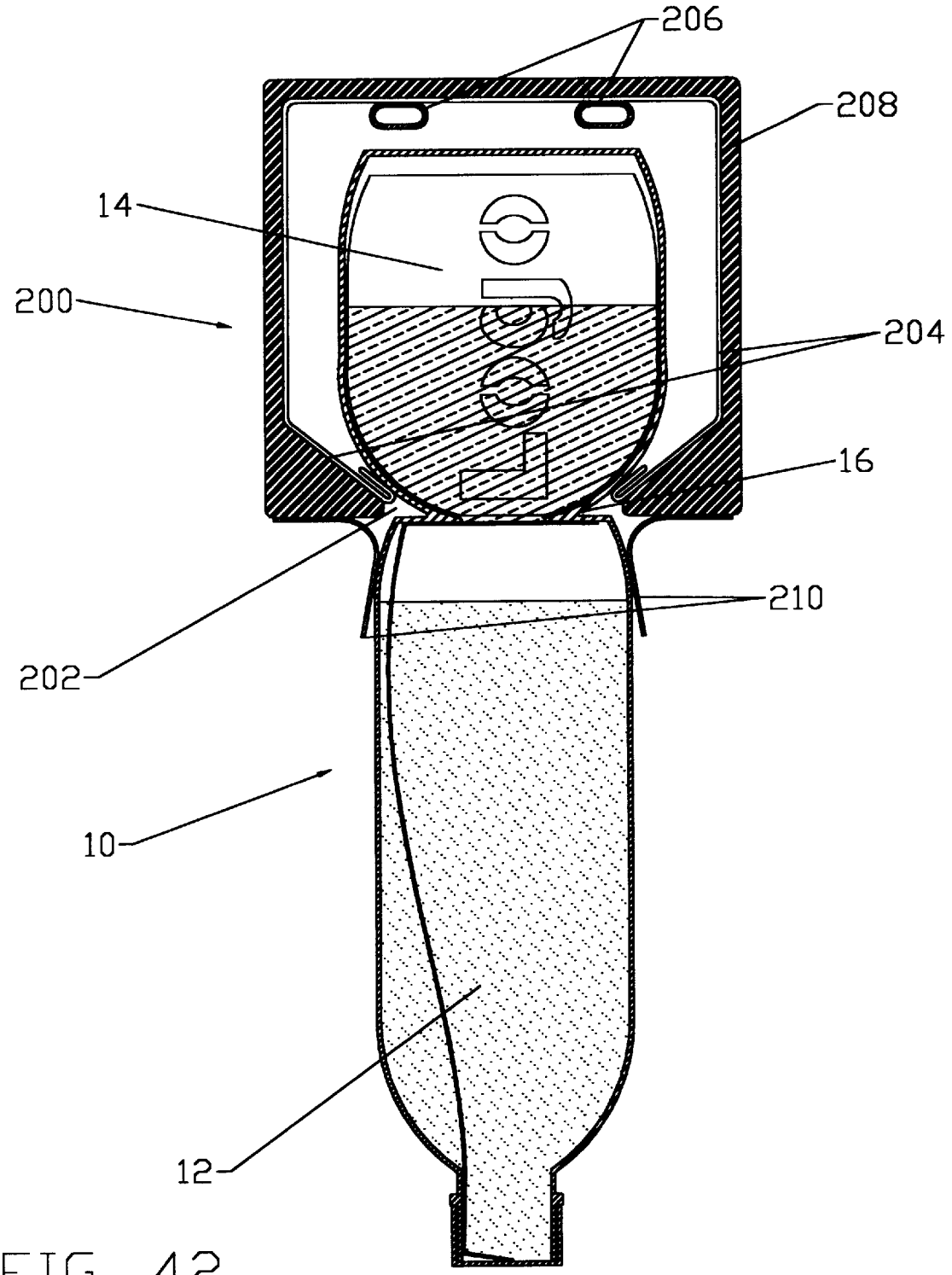
FIG. 42 is a vertical cross-section of a refrigerated channel used to hold a beverage container and provide it with a dual temperature environment within a refrigerator.

FIG. 42 is a vertical cross-section of a refrigerated channel 200 holding a beverage container 10. As shown in FIG. 42, the refrigerated channel 200 would surround the ice compartment 14 of the inverted beverage container 10. The beverage compartment 12 of container 10 would hang down through opening 202 and below channel 200. Beverage compartment 12 would thus be exposed to the warmer temperatures (above freezing) within the enclosing refrigerator. The opening 202 in channel 200 would taper around the waist 16 of container 10 and support it from that point. That is, the container 10 would essentially hang by its waist 16 from channel 200.

Cooling of the ice compartment 14 of container 10 could be provided either through conduction, natural convection or forced convection. To provide cooling through conduction, the walls 204 of channel 200 would need to be refrigerated so that heat could be conducted from the walls of container 10, through the walls 204 of channel 200 and into a refrigerant. For example, tubes 206 shown in FIG. 42 could carry refrigerant and be conductively connected to walls 204 in order to provide conduction cooling to container 10. If walls 204 were not made of a conductive material, a similar configuration could be used to provide cooling to container 10 through natural convection. That is, if tubes 206 carried a refrigerant, the air inside channel 200 would be cooled through natural convection and would consequently provide natural convection cooling to container 10. To provide forced convection cooling, cold, sub-freezing air would be forced through channel 200 (a separate system, not shown, would be needed to generate this cold airflow). This flow of cold air would in turn cool ice compartment 14 of container 10.

If either conduction or natural convection is used to provide the cooling, frost will form inside channel 200. This is because the walls 204 of channel 200 will be the coldest surface within the enclosing refrigerator, and thus any moisture in the air inside the refrigerator will condense out there. So if either of those means are used for cooling, some provision must be made for defrosting the walls 204 of channel 200. Some means for draining away the water that results from melting the frost would also be necessary. If forced convection is used, the frost will occur back at the heat exchanger that is used to cool the air, and the air that flows through channel 200 will essentially be dehumidified before it gets to channel 200. In that case, frosting within channel 200 will be minimized.

Because the inside of channel 200 is maintained at a temperature below freezing, it is desirable to cover the outside of channel 200 with insulation 208. Without this insulation, the outside of walls 204 of channel 200 would condense moisture from the air inside the refrigerator and frost would form. The insulation 208 would also prevent unnecessary cooling of the refrigerated compartment that surrounds channel 200. However it would be possible to create a refrigerator where the channel 200 was the means for cooling the entire refrigerator, in which case insulation 208 would be undesirable.

Also shown in FIG. 42 is a compliant barrier 210. This compliant barrier 210 is intended to seal any gap between beverage container 10 and opening 202 so that the cold air inside channel 200 does not escape unnecessarily into the surrounding refrigerator. The presence of compliant barrier 210 helps temperatures to be maintained both inside channel 200 and inside the surrounding refrigerator.

Figure 43:
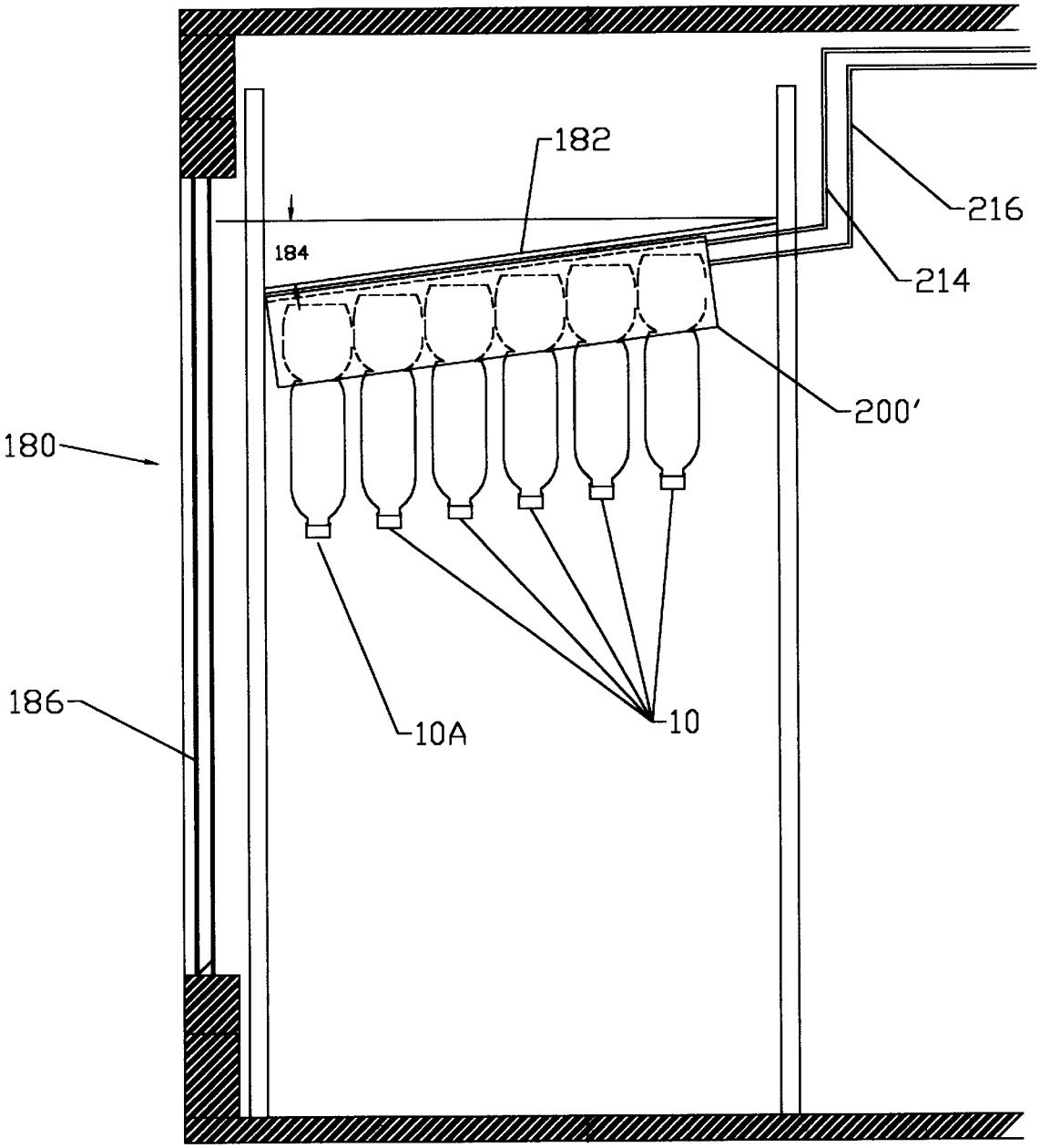
FIG. 43 is a vertical cross-section of a refrigerated channel holding six beverage containers installed onto a display rack within a walk-in refrigerator.

FIG. 43 shows refrigerated channel 200' installed onto display rack 182 within a walk-in refrigerator 212 and holding six containers 10. Channel 200' would be installed at an angle 184 so that when the first container 10A is removed, the others would slide forward, toward display door 186. Channel 200' would be connected to a refrigeration system using refrigerant lines 214 and 216. Alternately, a source of cold airflow could also be connected to the end of channel 200 to provide the cooling needed to keep the ice in containers 10 frozen.

Vending Machines

Dispensing the dual-compartment beverage container 10 described herein will require special vending machines. These special machines must differ from conventional beverage bottle vending machines in two ways: First, the machines must be configured to provide the dual-temperature environment required to freeze and store the beverage containers 10. Second, the vending machines must store the containers 10 in such a way that the beverage 36 in the containers does not touch the seal 30 within the container 10. If the beverage 36 is allowed to touch the seal 30 (by positioning the containers 10 on their sides, for example), the beverage 36 will freeze.

Figure 44:
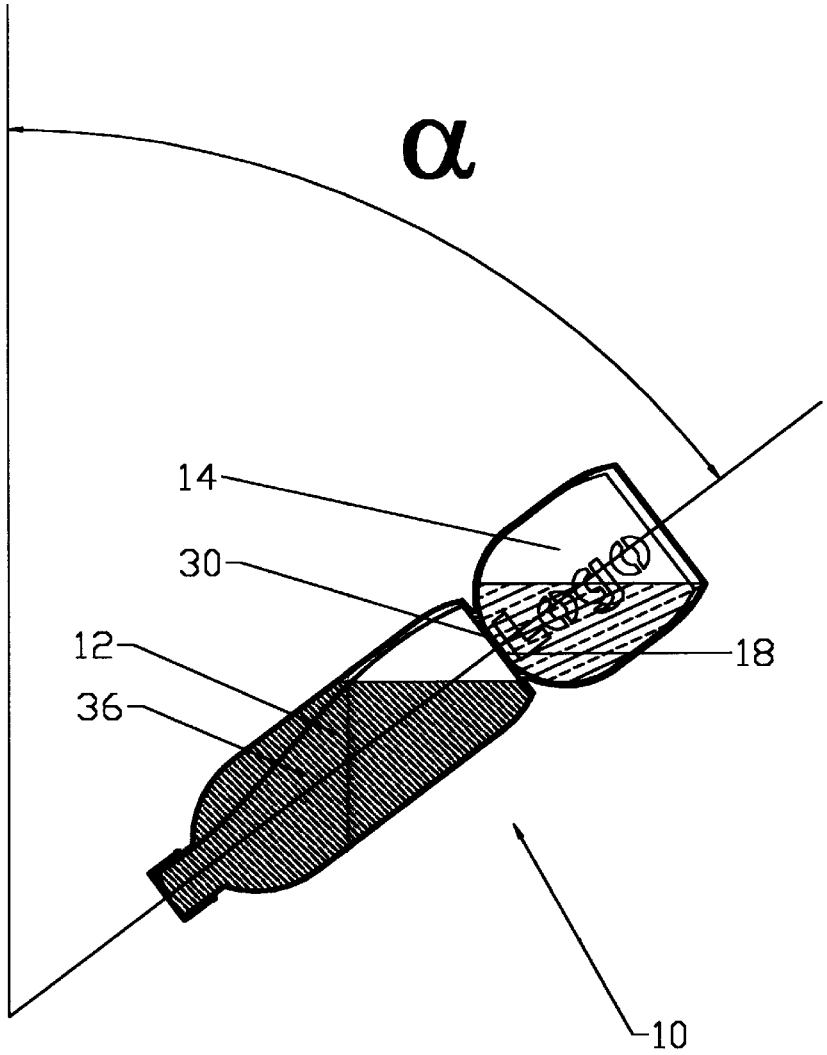
FIG. 44 is a vertical cross-section of a beverage container tipped at an angle that would allow proper freezing of the ice without freezing the beverage.

How this is specifically accomplished within any vending machine can vary, but at a minimum requires the following: The vending machine must store the containers 10 either vertically (with the cap 38 of the container 10 directly beneath the bottom of the container 10 as illustrated in FIG. 42) or at an angle cc relative to vertical that is less than that which causes the beverage 36 to come into contact with seal 30 at a point where seal 30 covers opening 18. This angle will vary depending on the specific geometry of container 10 and the level to which the container 10 has been filled with beverage 36. FIG. 44 shows a container 10 tipped to this angle $\alpha$.

The second requirement for a vending machine is that it expose the ice compartment 14 of each stored beverage container 10 to temperatures at or below 32° F., and that it simultaneously expose the beverage compartment 12 of each stored container 10 to temperatures above 32° F. These conditions must exist so that the ice 44 in the ice compartments 14 becomes or stays frozen, while the beverage 36 in the beverage compartments 12 does not begin to freeze or become frozen.

Domestic Refrigerator/Freezers

Figure 45:
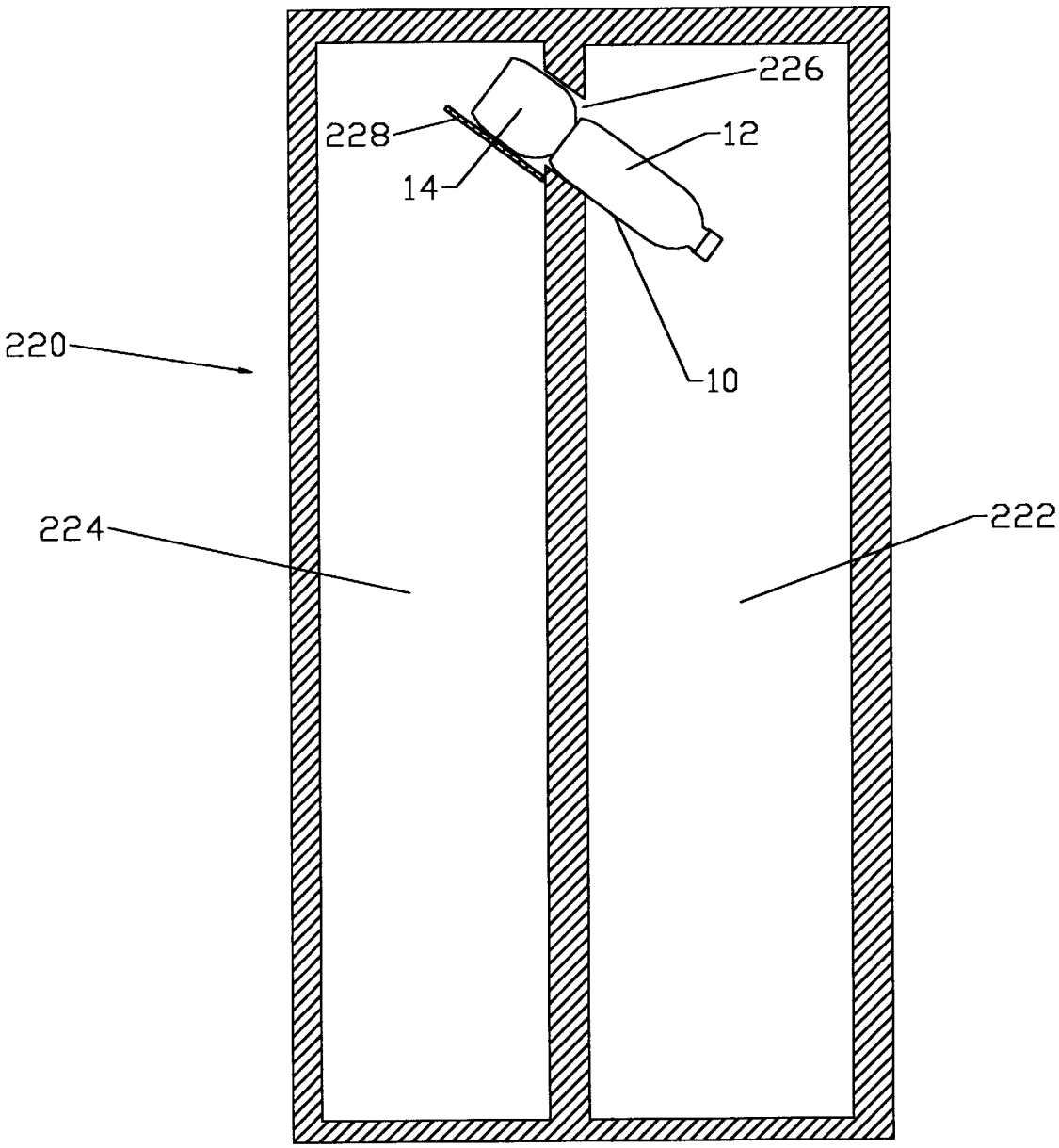
FIG. 45 is a vertical cross-section of a domestic refrigerator/freezer that has been configured to provide a dual temperature environment for a beverage container.

It may become desirable to build domestic refrigerator/freezers to be capable of storing beverage containers 10 without the need for any additional equipment (e.g., heated boxes). This would be a rather simple matter to accomplish. FIG. 45 illustrates a side-by-side style refrigerator/freezer 220 configured for this purpose. Between refrigerator compartment 222 and freezer compartment 224 in refrigerator/freezer 222 there is an aperture 226. Aperture 226 is sized and located such that one or more containers 10 may be placed inside aperture 226 so that their the beverage compartments 12 are exposed to the air in the refrigerator compartment 222 while their ice compartments 14 are exposed to the air in the freezer compartment 224. This will allow the ice in the ice compartment 14 of container 10 to freeze or stay frozen while the beverage in beverage compartment 12 does not freeze.

A door 228 or other sealing means next to aperture 226 would be used to keep refrigerator compartment 222 and freezer compartment 224 sealed from each other when there is no container 10 in aperture 226. Door 228 or other sealing means may also be designed to minimize air infiltration between the two compartments 222 and 224 when a container 10 is positioned within the aperture 226.

Heated Insulated Sleeve

Figure 46:
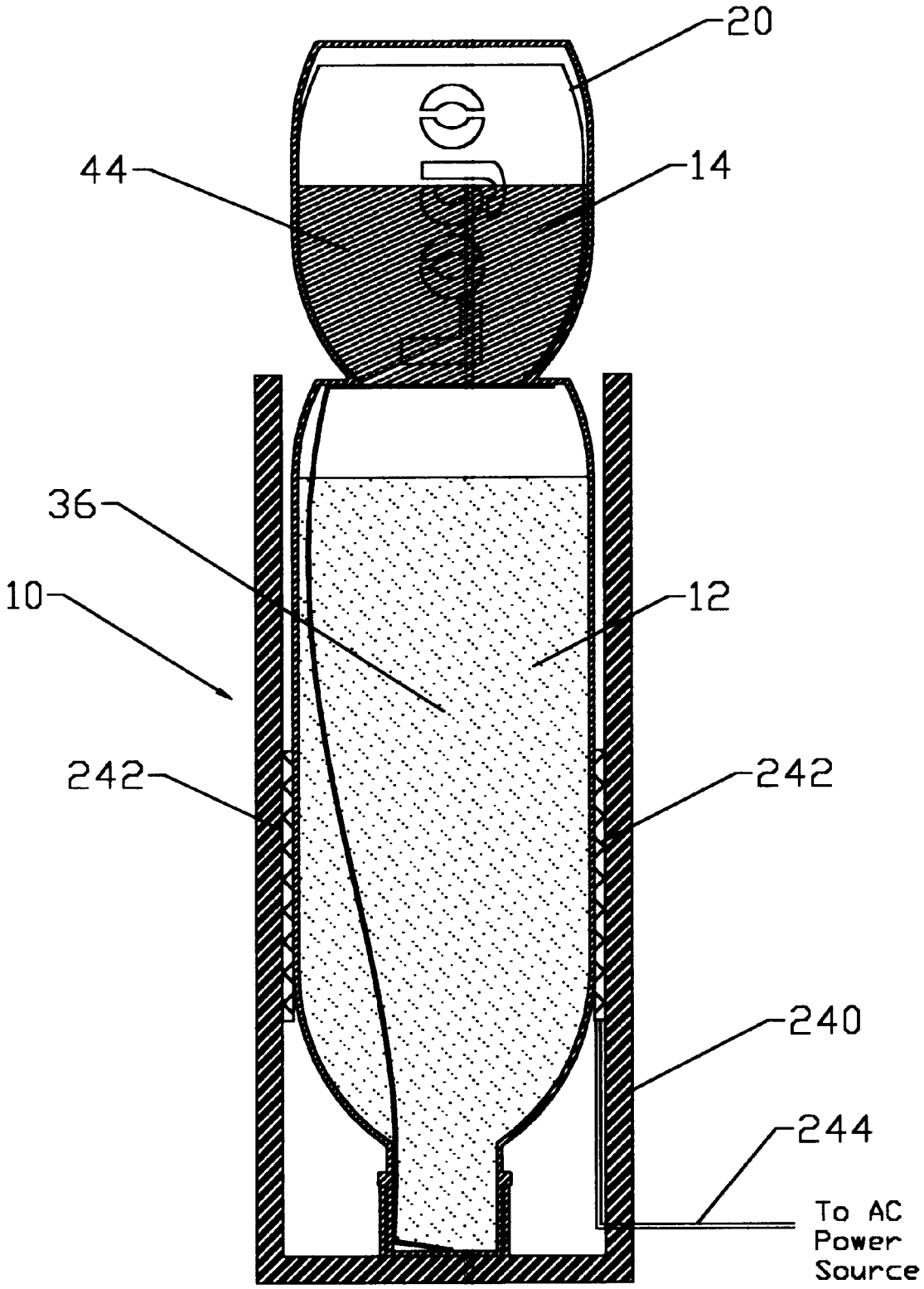
FIG. 46 is a vertical cross-section of an inverted beverage container placed inside a heated insulated sleeve for freezing.
Figure 47:
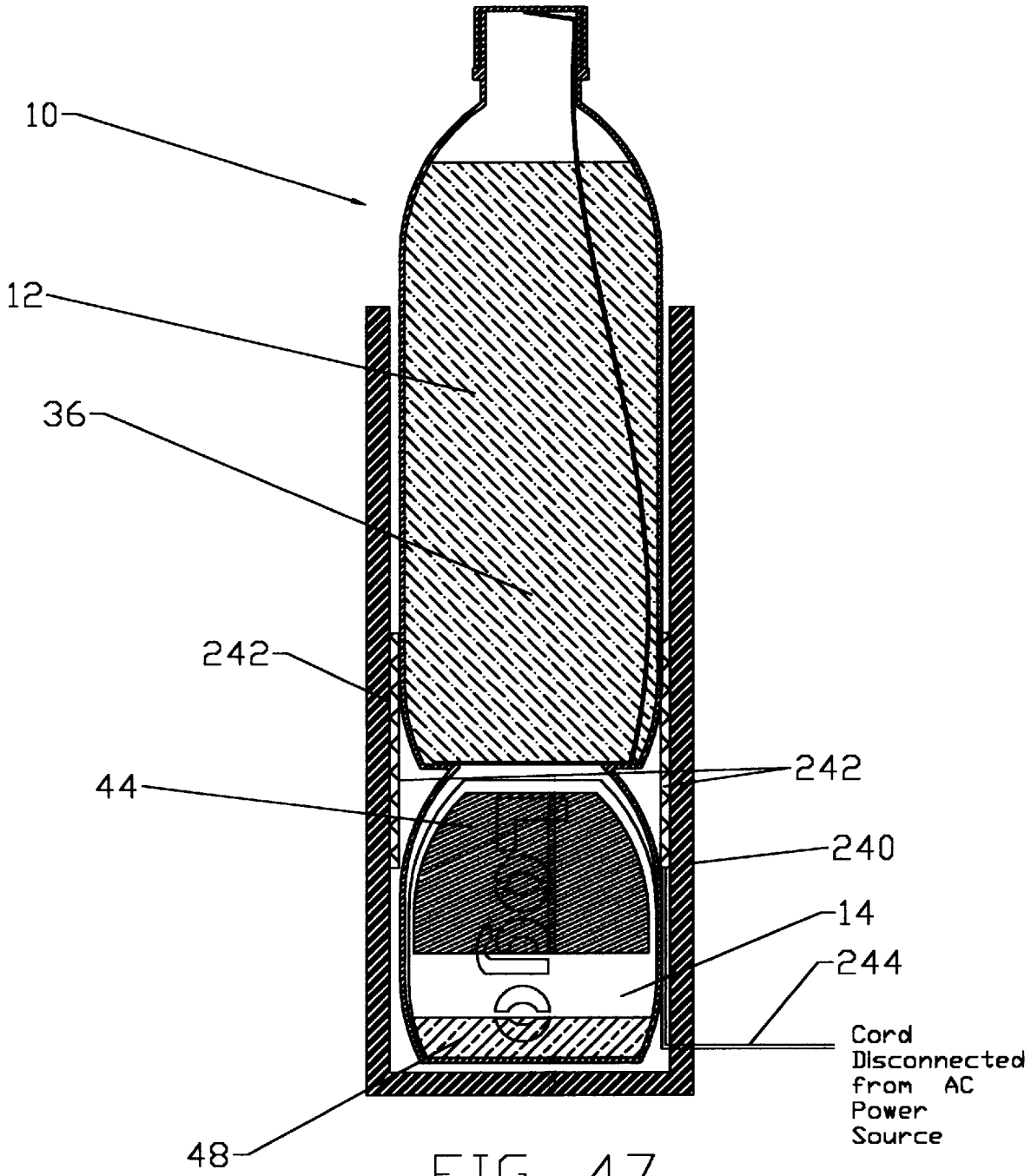
FIG. 47 is a vertical cross-section of a beverage container placed right side-up inside a heated insulated sleeve to keep the container cold longer.

For home or individual use, it may be desirable to have an insulated sleeve (like insulated sleeve 54 shown in FIG. 14) that also contains an electrical resistance heater. Such a sleeve could be used both for freezing the beverage container 10 and for keeping it cold longer. FIG. 46 and FIG. 47 illustrate such a device. FIG. 46 shows a vertical cross-section of beverage container 10, in an inverted orientation, placed inside a heated insulated sleeve 240. Sleeve 240 has an electrical resistance type heater 242 inside it which could be connected via power cord 244 to an AC power source. By placing the sleeve 240, with container 10 inverted inside it, into a freezer and connecting power cord 244 to a power source, the proper dual-temperature environment needed for freezing container 10 would be provided. The ice compartment 14 would protrude out from sleeve 240 and thus be exposed to the low temperatures in the freezer, while the beverage compartment 12 would be kept warm inside sleeve 240 by heater 242.

Once removed from the freezer, cord 244 would be unplugged and beverage container 10 would be removed from sleeve 240, righted, and placed back inside sleeve 240 as shown in FIG. 47. In this configuration, with the ice compartment 14 and the majority of the beverage compartment 12 inside sleeve 240, the contents of container 10 can be kept cold much longer.

In addition to the matter that is claimed, the applicant considers the following to be inventive:

I. A fluid container and method for filling said container including:

a. said fluid container having a first compartment and a second compartment;

b. filling said first compartment at least partially with a refrigerant;

c. attaching a seal to said container between said first compartment and said second compartment;

d. filling said second compartment at least partially with a fluid;

e. a thermal barrier between said first compartment and said second compartment, whereby freezing of said refrigerant does not cause freezing of said fluid;

f. said seal being openable, whereby opening of said seal allows said fluid to mix with said refrigerant.

II. A method of cooling a two-compartment container including:

a. said two-compartment container comprising:

i) a fluid compartment containing a fluid;

ii) a refrigerant compartment containing a refrigerant;

iii) a seal located between two said compartments, said seal preventing said fluid in said fluid compartment from mixing with said refrigerant;

iv) a thermal barrier between said fluid and said refrigerant, whereby freezing of said refrigerant does not cause freezing of said fluid;

v) said seal being openable, whereby opening of said seal allows said fluid to mix with said refrigerant;

b. placing said container in a dual-temperature environment in which said refrigerant compartment is exposed to temperatures at or below the liquid-solid phase change temperature of said refrigerant while said fluid compartment is simultaneously exposed to temperatures at or above the liquid-solid phase change temperature for said fluid, whereby said refrigerant in said refrigerant compartment is caused to freeze and said fluid in said fluid compartment is not caused to freeze.

III. A method of using a two-compartment container including:

a. said two-compartment container comprising:

i) a fluid compartment containing a fluid;

ii) a refrigerant compartment containing a refrigerant;

iii) a seal located between two said compartments, said seal preventing said fluid in said fluid compartment from mixing with said refrigerant;

iv) a thermal barrier between said fluid and said refrigerant, whereby freezing of said refrigerant does not cause freezing of said fluid;

v) said seal being openable, whereby opening of said seal allows said fluid to mix with said refrigerant;

b. opening said seal, allowing said fluid and said refrigerant to mix, whereby said fluid is cooled.

IV. A fluid container and method for filling said container including:

a. a fluid container having a first compartment and a second compartment;

b. said first compartment containing a refrigerant anchor;

c. filling said first compartment at least partially with a refrigerant;

d. attaching a seal to said container between said first compartment and said second compartment;

e. filling said second compartment at least partially with a fluid;

f. a thermal barrier between said first compartment and said second compartment whereby freezing of said refrigerant does not cause freezing of said fluid;

g. said seal being openable, whereby opening of said seal allows said fluid to mix with said refrigerant.

V. A method of cooling a two-compartment container including:

a. said two-compartment container comprising:

i) a fluid compartment containing a fluid;

ii) a refrigerant compartment containing a refrigerant;

iii) said refrigerant compartment containing a refrigerant anchor and an air gap;

iv) a seal located between two said compartments, said seal preventing said fluid in said fluid compartment from mixing with said refrigerant;

v) a thermal barrier between said fluid and said refrigerant, whereby freezing of said refrigerant does not cause freezing of said fluid;

vi) said seal being openable, whereby opening of said seal allows said fluid to mix with said refrigerant;

b. orienting said container so that said refrigerant compartment is located above said fluid compartment and placing said container in a dual-temperature environment in which said refrigerant compartment is exposed to temperatures at or below the liquid-solid phase change temperature of said refrigerant while said fluid compartment is simultaneously exposed to temperatures at or above the liquid-solid phase change temperature for said fluid, whereby said refrigerant in said refrigerant compartment is caused to freeze and said fluid in said fluid compartment is not caused to freeze and said air gap in said refrigerant compartment is located on the opposite side of said frozen refrigerant as said fluid compartment.

VI. The method of V above, further comprising:

a. removing said container from said dual-temperature environment;

b. orienting said container so that said fluid compartment is located above said refrigerant compartment, whereby the portion of said refrigerant that is in contact with the walls of said refrigerant compartment melts and flows into said air gap in said refrigerant compartment, thereby leaving the remaining refrigerant suspended by said refrigerant anchor within said refrigerant compartment, said remaining refrigerant being surrounded by a layer of air which thermally insulates said remaining refrigerant and thereby reduces the rate of melting of said remaining refrigerant.

VII. A method of using a two-compartment container including:

a. said two-compartment container comprising:
   i) a fluid compartment containing a fluid;
   ii) a refrigerant compartment containing a refrigerant;
   iii) said refrigerant compartment containing a refrigerant anchor;
   iv) a seal located between two said compartments, said seal preventing said fluid in said fluid compartment from mixing with said refrigerant;
   v) a thermal barrier between said fluid and said refrigerant, whereby freezing of said refrigerant does not cause freezing of said fluid;
   vi) said seal being openable, whereby opening of said seal allows said fluid to mix with said refrigerant, thereby cooling said fluid;

b. opening said seal, allowing said fluid and said refrigerant to mix, whereby said fluid is cooled.

VIII. The method of VII above, including the additional steps of:

a. orienting said container so that said refrigerant compartment is above said fluid compartment, whereby said fluid and melted refrigerant flow into said fluid compartment and out of contact with said refrigerant, thereby reducing the melt rate of said refrigerant.

IX. A method for cooling a fluid including:

a. a two-compartment container comprising:
   i) a fluid compartment containing a fluid;
   ii) a refrigerant compartment containing a refrigerant;
   iii) said refrigerant compartment containing a refrigerant anchor and an air gap;
   iv) a seal located between two said compartments, said seal preventing said fluid in said fluid compartment from mixing with said refrigerant;
   v) a thermal barrier between said fluid and said refrigerant, whereby freezing of said refrigerant does not cause freezing of said fluid;
   vi) said seal being openable, whereby opening of said seal allows said fluid to mix with said refrigerant;

b. orienting said container so that said refrigerant compartment is located above said fluid compartment and placing said container in a dual-temperature environment in which said refrigerant compartment is exposed to temperatures at or below the liquid-solid phase change temperature of said refrigerant while said fluid compartment is simultaneously exposed to temperatures at or above the liquid-solid phase change temperature for said fluid, whereby said refrigerant in said refrigerant compartment is caused to freeze and said fluid in said fluid compartment is not caused to freeze and said air gap in said refrigerant compartment is located on the opposite side of said frozen refrigerant as said fluid compartment;

c. removing said container from said dual-temperature environment;

d. orienting said container so that said fluid compartment is located above said refrigerant compartment, whereby the portion of said refrigerant that is in contact with the walls of said refrigerant compartment melts and flows into said air gap in said refrigerant compartment, thereby leaving the remaining refrigerant suspended by said refrigerant anchor within said refrigerant compartment, said remaining refrigerant being surrounded by a layer of air which thermally insulates said remaining refrigerant and thereby reduces the rate of melting of said remaining refrigerant;

e. opening said seal, allowing said fluid and said refrigerant to mix, whereby said fluid is cooled.

X. A fluid container comprising:

a. a fluid compartment containing a fluid;

b. a refrigerant compartment containing a refrigerant;

c. a containment means between two said compartments, said containment means preventing said fluid in said fluid compartment from contacting said refrigerant;

d. a heat exchange element in contact with said refrigerant and in contact with said fluid such that heat can be transferred through said heat exchange element between said refrigerant and said fluid;

e. an openable seal preventing said fluid from contacting said heat exchange element, whereby opening said seal allows said fluid to contact said heat exchange element thereby allowing heat transfer between said refrigerant and said fluid.

XI. A method of cooling a fluid including:

a. a fluid container comprising:
   i) a fluid compartment containing a fluid;
   ii) a refrigerant compartment containing a refrigerant;
   ii) a containment means between two said compartments, said containment means preventing said fluid in said fluid compartment from contacting said refrigerant;
   iv) a heat exchange element in contact with said refrigerant and in contact with said fluid such that heat can be transferred through said heat exchange element between said refrigerant and said fluid;
   v) an openable seal preventing said fluid from contacting said heat exchange element, whereby opening said seal allows said fluid to contact said heat exchange element thereby allowing heat transfer between said refrigerant and said fluid;

b. placing said container in a dual-temperature environment in which said refrigerant compartment is exposed to temperatures at or below the liquid-solid phase change temperature of said refrigerant while said fluid compartment is simultaneously exposed to temperatures at or above the liquid-solid phase change temperature for said fluid, whereby said refrigerant in said refrigerant compartment is caused to freeze and said fluid in said fluid compartment is not caused to freeze;

c. removing said container from said dual-temperature environment;

d. opening said seal, allowing said fluid to contact said heat exchange element, whereby heat is transferred from said fluid into said refrigerant, thereby cooling said fluid.

XII. A container comprising:

a. a main compartment;

b. a refrigerant anchor located within said compartment;

c. means for solidifying a phase-change refrigerant onto said anchor;

d. means for positioning said anchor and said solidified refrigerant above the bottom of said compartment, whereby when said solidified refrigerant begins to melt and create liquid refrigerant, said liquid refrigerant can flow beneath and out of contact with said solidified refrigerant, whereby the rate of melting of said solidified refrigerant is reduced.

XIII. The container of XII above, further comprising a lid, said refrigerant anchor being attached to said lid.

XIV. The container of XIII above, wherein said lid forms a cup containing said anchor.

XV. The container of XIV above, wherein said lid has a spout.

XVI. The container of XIV above, wherein said lid and main compartment are thermally insulated, whereby the rate of heat transfer between the contents of said container and its surroundings is reduced.

XVII. A method of slowing the melt rate of a phase-change refrigerant including:

a. a container comprising:
   i) a main compartment;
   ii) a refrigerant anchor;

b. freezing said phase-change refrigerant onto said anchor;

c. orienting said frozen refrigerant within said compartment so that a gap exists below said refrigerant, whereby when said refrigerant melts, the melted refrigerant will flow into said gap and out of contact with said refrigerant, thereby causing said refrigerant to be suspended within an insulating air gap with said compartment, thereby reducing the rate of melting of said refrigerant.

XVIII. A method of slowing the melt rate of a phase-change refrigerant including:

a. a container comprising:
   i) a main compartment;
   ii) a lid, said lid forming an inverted cup;
   iii) a refrigerant anchor attached to said lid within said cup;

b. freezing a phase-change refrigerant onto said anchor;

c. attaching said lid to said container whereby said frozen refrigerant is located at the top of said compartment and a gap exists below said refrigerant, whereby when said refrigerant melts, the melted refrigerant will flow into said gap and out of contact with said refrigerant, thereby causing said refrigerant to be suspended within an insulating air gap with said compartment, thereby reducing the rate of melting of said refrigerant.

XIX. An ice container comprising:

a. an ice compartment;

b. a first opening;

c. a closure means for said first opening;

d. a second opening, said second opening being connectable to the mouth of a beverage bottle containing a beverage;

e. a closure means for said second opening;

f. said ice compartment containing ice.

XX. A method for cooling a beverage including:

a. a beverage container containing a beverage;

b. an ice container comprising:
   i) an ice compartment;
   ii) a first opening;
   iii) a second opening, said second opening being connectable to the mouth of said beverage container;
   iv) said ice compartment containing ice;
   v) a passageway through said ice compartment, whereby a fluid can pass through said ice compartment from said second opening to said first opening;

c. connecting said second opening of said ice container to said mouth of said beverage container;

d. causing said beverage in said beverage container to flow through said passageway in said ice container, whereby said beverage transfers heat to said ice, thereby cooling said beverage.

XXI. An enclosure for a two-compartment located within a refrigerated environment having:

a. an opening in said enclosure;

b. said opening allowing a first compartment of a two-compartment container to be placed inside said enclosure while a second compartment of said container protrudes out through said opening;

c. a heating means for said enclosure, whereby said heating means keeps the inside of said enclosure and said first compartment at a temperature warmer than the temperature that exists outside of said enclosure.

XXII. An enclosure for a two-compartment container having:

a. an opening in said enclosure;

b. said opening allowing a first compartment of said two-compartment container to be placed in said enclosure while a second compartment of said container protrudes out through said opening;

c. a refrigerating means for said enclosure, whereby said refrigerating means keeps the inside of said enclosure and said first compartment at a temperature colder than the temperature that exists outside of said enclosure.

XXIII. A machine for vending two-compartment containers, said vending machine including a dual-temperature refrigeration system to keep the first compartments of said containers at a first temperature and the second compartments of said containers at a second temperature.

XXIV. A combination refrigerator/freezer having:

a. a refrigerator compartment wherein the temperature is maintained between 32° F. and 50° F.;

b. a freezer compartment wherein the temperature is maintained below 32° F.;

c. an opening between said refrigerator compartment and said freezer compartment to allow a two-compartment container to be placed through said opening so that a first compartment of said container is exposed to the temperatures inside the freezer compartment while a second compartment of said container is exposed to the temperatures inside said refrigerator compartment, whereby said first compartment is maintained at a temperature at or below 32° F. and said second compartment is maintained at or above 32° F.

What I claim is:

1. A fluid container comprising:

a. a fluid compartment containing a fluid;

b. a refrigerant compartment containing a refrigerant;

c. a seal located between two said compartments, said seal preventing said fluid from mixing with said refrigerant;

d. a thermal barrier between said fluid and said refrigerant, whereby freezing of said refrigerant does not cause freezing of said fluid;

e. said seal being openable, whereby opening of said seal allows said fluid to mix with said refrigerant, thereby cooling said fluid.

2. The container of claim 1 wherein said refrigerant is a consumable material which can be frozen.

3. The container of claim 2 wherein said consumable material is water or ice.

4. The container of claim 2 wherein said consumable material is ice cream.

5. The container of claim 1 wherein said container has an opening adjacent to said fluid compartment and said fluid compartment is located between said refrigerant compartment and said opening.

6. The container of claim 1 wherein said thermal barrier is an air gap located between said fluid and said refrigerant.

7. The container of claim 6 wherein said air gap is located within said fluid compartment.

8. The container of claim 6 wherein said air gap is located within said refrigerant compartment.

9. The container of claim 1 wherein said seal is thermally insulated and said seal is said thermal barrier.

10. The container of claim 1 wherein said seal is an adhesively-adhered non-permeable membrane.

11. The container of claim 1 wherein said fluid is a beverage.

12. The container of claim 1 wherein said fluid is water.

13. The container of claim 1 wherein said container is made of plastic.

14. The container of claim 13 wherein said container is manufactured using blow molding.

15. The container of claim 1 further comprising a drain for draining said refrigerant compartment, whereby any melted refrigerant in said refrigerant compartment can be drained from said container prior to opening of said seal, thereby minimizing dilution of said fluid.

16. The container of claim 1 further comprising a removable, thermally insulating sleeve covering at least a portion of the outside of said container, whereby the contents of said container are kept cold longer by the insulating properties of said sleeve.

17. A fluid container comprising:

a. a fluid compartment containing a fluid;

b. a refrigerant compartment containing a refrigerant;

c. a refrigerant anchor located within said refrigerant compartment, whereby while said refrigerant melts, the position of said refrigerant stays relatively fixed with respect to said refrigerant compartment;

d. a seal located between two said compartments, said seal preventing said fluid from mixing with said refrigerant;

e. a thermal barrier between said fluid and said refrigerant, whereby freezing of said refrigerant does not cause freezing of said fluid;

f. said seal being openable, whereby opening of said seal allows said fluid to mix with said refrigerant, thereby cooling said fluid.

18. The container of claim 17 wherein the geometric configuration of said anchor allows said refrigerant to stay relatively fixed with respect to said refrigerant compartment while said refrigerant melts.

19. The container of claim 18 wherein said refrigerant freezes to said geometric configuration of said anchor, whereby said refrigerant stays relatively fixed with respect to said refrigerant compartment while said refrigerant melts.

20. The container of claim 17 wherein holes through said anchor are provided to allow said refrigerant to freeze through said holes, whereby said refrigerant stays relatively fixed with respect to said refrigerant compartment while said refrigerant melts.

21. The container of claim 17 wherein the surface characteristics of said anchor allows said refrigerant to stay relatively fixed with respect to said refrigerant compartment while said refrigerant melts.

22. The container of claim 17 wherein said anchor is a separate part that is inserted into said container after said container is molded.

23. The container of claim 22 wherein said separate part is made of plastic.

24. The container of claim 23 wherein said plastic part has perforations through it to allow said refrigerant to freeze through said holes, whereby said refrigerant stays relatively fixed with respect to said refrigerant compartment while said refrigerant melts.

25. The container of claim 24 wherein said perforations are in the shape of a design or logo.

26. The container of claim 25 wherein said plastic is colored or non-clear.

27. The container of claim 17 wherein said anchor is free to move up and down within said refrigerant compartment.

28. The container of claim 17 wherein said anchor is an integral part of said refrigerant compartment.

29. The container of claim 17 wherein said anchor is located adjacent to said seal whereby said anchor provides structural support for said seal.

30. The container of claim 17 further comprising a drain for draining said refrigerant compartment, whereby any melted refrigerant in said refrigerant compartment can be drained from said container prior to opening of said seal, thereby minimizing dilution of said fluid.

31. The container of claim 17 further comprising a removable, thermally insulating sleeve covering at least a portion of the outside of said container, whereby the contents of said container are kept cold longer by the insulating properties of said sleeve.

* * * * *